US008808952B2

(12) United States Patent
Iwadate et al.

(10) Patent No.: US 8,808,952 B2
(45) Date of Patent: Aug. 19, 2014

(54) COMPOSITION FOR FORMING CHARGE TRANSPORTING FILM, ELECTROPHOTOGRAPHIC PHOTORECEPTOR, PROCESS CARTRIDGE, AND IMAGE FORMING APPARATUS

(75) Inventors: Yuko Iwadate, Kanagawa (JP); Katsumi Nukada, Kanagawa (JP); Wataru Yamada, Kanagawa (JP); Hidekazu Hirose, Kanagawa (JP); Tomoya Sasaki, Kanagawa (JP); Kenji Kajiwara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/610,372

(22) Filed: Sep. 11, 2012

(65) Prior Publication Data

US 2013/0260295 A1 Oct. 3, 2013

(30) Foreign Application Priority Data

Mar. 28, 2012 (JP) ..... 2012-073009

(51) Int. Cl.
*G03G 5/047* (2006.01)

(52) U.S. Cl.
USPC ..... 430/58.7; 399/159

(58) Field of Classification Search
USPC ..... 430/58.7
See application file for complete search history.

(56) References Cited

U.S. PATENT DOCUMENTS

| | | | | |
|---|---|---|---|---|
| 5,411,827 | A | 5/1995 | Tamura et al. | |
| 5,427,880 | A | 6/1995 | Tamura et al. | |
| 5,456,989 | A | 10/1995 | Nogami et al. | |
| 5,695,898 | A | 12/1997 | Go et al. | |
| 2002/0119382 | A1 | 8/2002 | Nakata et al. | |
| 2004/0043312 | A1 | 3/2004 | Kikuchi et al. | |
| 2004/0063014 | A1 | 4/2004 | Yoshimura et al. | |
| 2004/0248024 | A1 | 12/2004 | Suzuki et al. | |
| 2004/0253527 | A1 | 12/2004 | Suzuki et al. | |
| 2005/0026058 | A1 * | 2/2005 | Kami et al. | 430/66 |
| 2007/0122724 | A1 | 5/2007 | Suzuki et al. | |
| 2007/0178400 | A1 * | 8/2007 | Kikuchi et al. | 430/133 |
| 2008/0020305 | A1 | 1/2008 | Suzuki et al. | |

FOREIGN PATENT DOCUMENTS

| | | |
|---|---|---|
| JP | A-62-251757 | 11/1987 |
| JP | A-5-40360 | 2/1993 |
| JP | A-5-216249 | 8/1993 |
| JP | A-7-72640 | 3/1995 |
| JP | A-7-146564 | 6/1995 |
| JP | A-2000-19749 | 1/2000 |
| JP | A-2000-206715 | 7/2000 |
| JP | A-2001-175016 | 6/2001 |
| JP | A-2002-82469 | 3/2002 |
| JP | B2-3287678 | 3/2002 |
| JP | A-2003-15328 | 1/2003 |
| JP | A-2004-12986 | 1/2004 |
| JP | A-2004-46221 | 2/2004 |
| JP | A-2004-302450 | 10/2004 |
| JP | A-2005-292560 | 10/2005 |
| JP | A-2006-84711 | 3/2006 |

* cited by examiner

*Primary Examiner* — Peter Vajda
(74) *Attorney, Agent, or Firm* — Oliff PLC

(57) ABSTRACT

Provided is a composition for forming a charge transporting film, including a solvent having a dielectric constant of 5.0 or more, at least one kind of compound selected from a group consisting of the following compounds (I-a), (I-b), (I-c), and (I-d) and a compound represented by the following Formula (II), fluorine-containing resin particles, and a fluorine-containing dispersant, Formula (II)

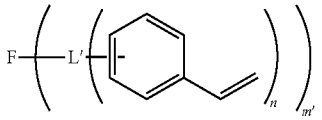

(I-a): a compound represented by the following Formula (III)

(III)

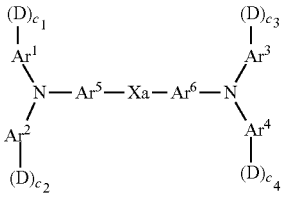

(I-b): a compound represented by the following Formula (V)

(V)

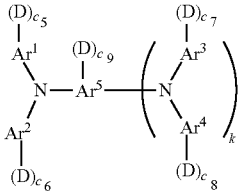

(I-c): a compound represented by the following Formula (V)

(V)

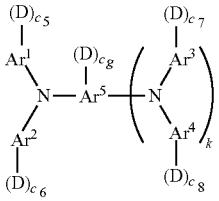

(VI)

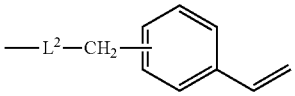

(I-d): a compound represented by the following Formula (V)

(V)

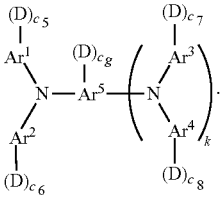

16 Claims, 11 Drawing Sheets

COMPOSITION FOR FORMING CHARGE TRANSPORTING FILM, ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-073009 filed Mar. 28, 2012.

BACKGROUND

1. Technical Field

The present invention relates to a composition for forming a charge transporting film, an electrophotographic photoreceptor, a process cartridge, and an image forming apparatus.

2. Related Art

An electrophotographic image forming apparatus generally has the following constitution and process. That is, the surface of an electrophotographic photoreceptor is charged with a predetermined polarity and potential by a charging device, the charged surface of the electrophotographic photoreceptor is selectively erased by image exposure so as to form an electrostatic latent image, a toner is then attached to the electrostatic latent image by a developing unit so as to develop the latent image as a toner image, and the toner image is transferred to a recording medium by a transfer unit so as to be discharged as a formed image.

For example, a method of improving strength by providing a protective layer onto the surface of the electrophotographic photoreceptor has been proposed.

In recent years, a protective layer formed of an acrylic material has drawn attention.

These acrylic materials are strongly affected by curing conditions, curing atmosphere, and the like.

SUMMARY

According to an aspect of the invention, there is provided a composition for forming a charge transporting film, including a solvent having a dielectric constant of 5.0 or more, at least one kind of compound selected from a group consisting of the following compounds (I-a), (I-b), (I-c), and (I-d) and a compound represented by the following Formula (II), fluorine-containing resin particles, and a fluorine-containing dispersant, Formula (II)

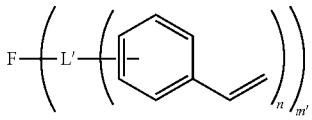

wherein F represents a charge transporting skeleton, L' represents a linking group with a valency of (n+1) having one or more kinds selected from a group consisting of tri- or tetravalent groups derived from alkane, an alkylene group, an alkenylene group, —C(=O)—, —N(R)—, —S—, and —O—, R represents a hydrogen atom, an alkyl group, an aryl group, or an aralkyl group, m' represents an integer of 1 to 6, and n represents an integer of 2 to 3, (I-a): a compound represented by the following Formula (III)

(III)

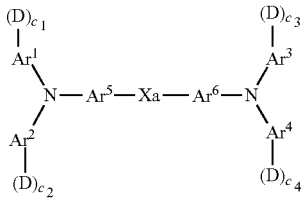

wherein each of $Ar^1$ to $Ar^4$ independently represents a substituted or unsubstituted aryl group, each of $Ar^5$ and $Ar^6$ independently represents a substituted or unsubstituted arylene group, Xa represents a divalent group that is a combination of groups selected from an alkylene group, —O—, —S—, and an ester, D represents a group represented by the following Formula (IV), each of $c_1$ to $c_4$ independently represents an integer of 0 to 2, and the total number of D is 1 or 2, (IV)

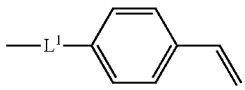

wherein $L^1$ represents a linking group that is represented by $*—(CH_2)_{n''}—O—CH_2—$ and directly linked to the aryl group represented by $Ar^1$ to $Ar^4$ via *, and n" represents 1 or 2, (I-b): a compound represented by the following Formula (V)

(V)

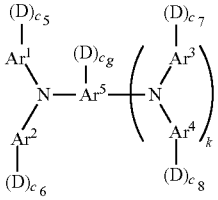

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VI), each of $c_5$ to $c_9$ represents an integer of 0 to 2, k represents 0 or 1, and the total number of D is 1 or 2, (VI)

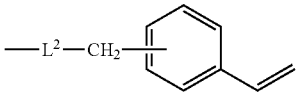

wherein in formula (VI), $L^2$ represents a divalent linking group having a group represented by $—(CH_2)_n—O—$ directly linked to the aryl group represented by $Ar^1$ to $Ar^4$ or to the aryl group or arylene group represented by $Ar^5$, and n represents an integer of 3 to 6, (I-c): a compound represented by the following Formula (V)

(V)

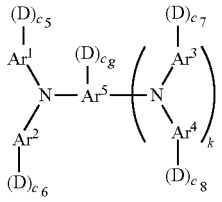

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VI), each of $c_5$ to $c_9$ represents an integer of 0 to 2, k represents 0 or 1, and the total number of D is from 3 to 8, (VI)

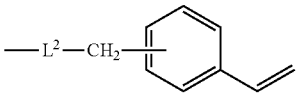

wherein $L^2$ represents a divalent linking group having a group represented by $—(CH_2)_n—O—$ directly linked to the aryl group represented by $Ar^1$ to $Ar^4$ or to the aryl group or arylene group represented by $Ar^5$, and n represents an integer of 1 to 6, (I-d): a compound represented by the following Formula (V)

(V)

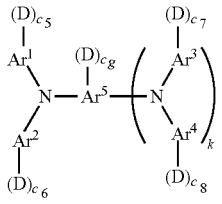

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VII), each of $c_5$ to $c_9$ represents an integer of 0 to 2, k represents 0 or 1, and the total number of D is from 1 to 8, (VII)

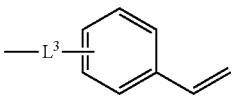

wherein $L^3$ represents a divalent linking group having one or more groups selected from a group consisting of —C(=O)—, —N(R)—, —S—, and a group that is a combination of —C(=O)— with —O—, —N(R)—, or —S—, and R represents a hydrogen atom, an alkyl group, an aryl group, or an aralkyl group.

BRIEF DESCRIPTION OF THE DRAWINGS

Exemplary embodiments of the present invention will be described in detail based on the following figures, wherein.

DETAILED DESCRIPTION

Figure 1:
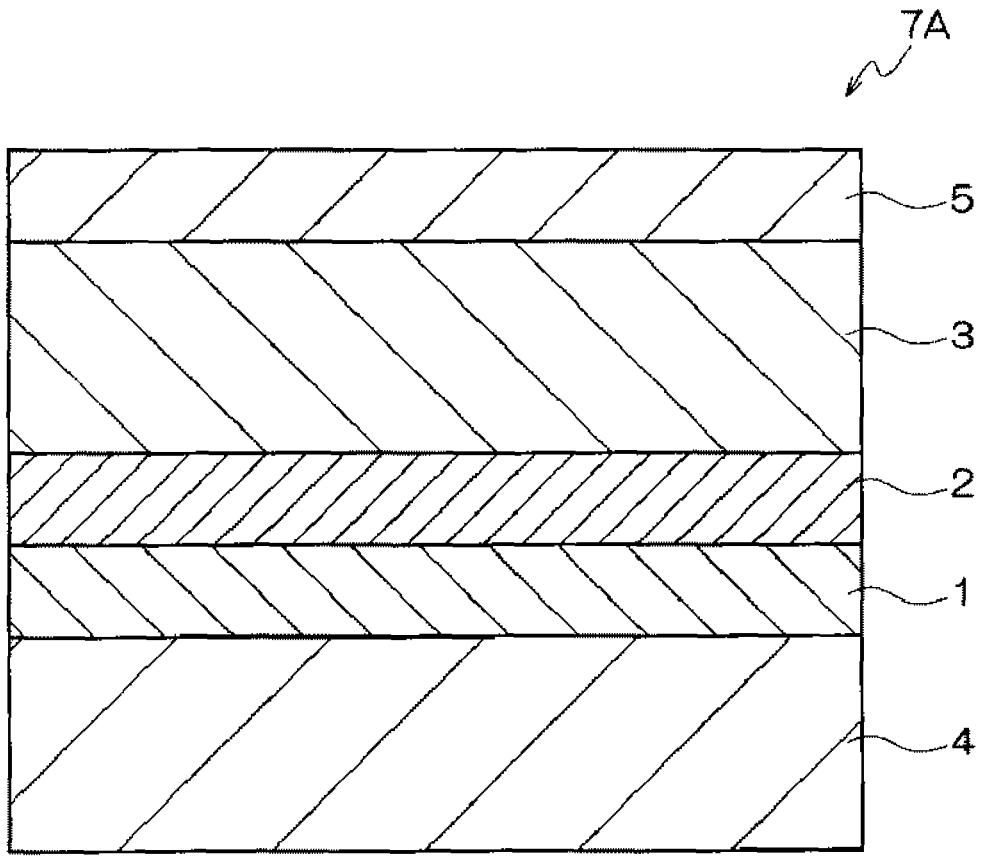
FIG. 1 is a schematic partial cross-sectional view showing an example of the layer constitution of an electrophotographic photoreceptor according to the present exemplary embodiment.

Hereinbelow, the composition for forming a charge transporting film according to the present exemplary embodiment and an electrophotographic photoreceptor, a process cartridge, and an image forming apparatus using the composition will be described in detail.

The composition for forming a charge transporting film (hereinbelow, referred to as a "specific reactive group-containing charge transport material" in some cases) according to the present exemplary embodiment is constituted with a solvent having a dielectric constant of 5.0 or more, at least one kind of compound (hereinbelow, referred to as a "specific reactive group-containing compound" in some cases) selected from a group consisting of the following compounds (I-a), (I-b), (I-c), and (I-d) among compounds represented by the following Formula (I) and a compound represented by the following Formula (II), fluorine-containing resin particles, and a fluorine-containing dispersant.

(I)

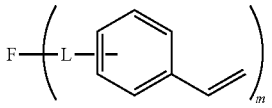

In Formula (I), F represents a charge transporting skeleton, L represents a divalent linking group having two or more kinds selected from a group consisting of an alkylene group, an alkenylene group, —C(=O)—, —N(R)—, —S—, and —O—, R represents a hydrogen atom, an alkyl group, an aryl group, or an aralkyl group, and m represents an integer of 1 to 8.

Formula (II)

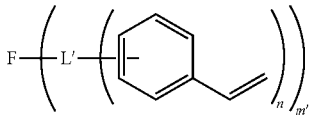

In Formula (II), F represents a charge transporting skeleton, L' represents a linking group with a valency of (n+1) having one or more kinds selected from a group consisting of tri- or tetravalent groups derived from an alkylene group, an alkenylene group, —C(=O)—, —N(R)—, —S—, —O—, and alkane, R represents a hydrogen atom, an alkyl group, an aryl group, or an aralkyl group, m' represents an integer of 1 to 6, and n represents an integer of 2 to 3.

(I-a): A compound represented by the following Formula (III) and defined to be as below (III)

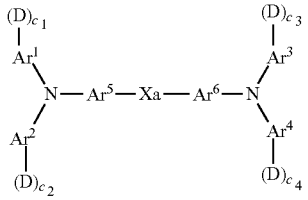

In Formula (III), each of $Ar^1$ to $Ar^4$ independently represents a substituted or unsubstituted aryl group, each of $Ar^5$ and $Ar^6$ independently represents a substituted or unsubstituted arylene group, Xa represents a divalent group that is a combination of groups selected from an alkylene group, —O—, —S—, and an ester, D represents a group represented by the following Formula (IV), each of $c_1$ to $c_4$ independently represents an integer of 0 to 2, and the total number of D is 1 or 2.

(IV)

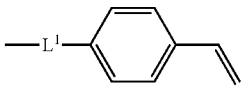

In Formula (IV), $L^1$ represents a linking group that is represented by *—$(CH_2)_{n''}$—O—$CH_2$— and directly linked to the aryl group represented by $Ar^1$ to $Ar^4$ via *, and n" represents 1 or 2.

(I-b): A compound represented by the following Formula (V) and defined to be as below (V)

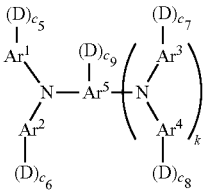

In Formula (V), each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VI), each of $c_5$ to $c_9$ represents an integer of 0 to 2, k represents 0 or 1, and the total number of D is 1 or 2.

(VI)

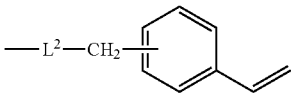

In Formula (VI), $L^2$ represents a divalent linking group having a group represented by —$(CH_2)_n$—O— directly linked to the aryl group represented by $Ar^1$ to $Ar^4$ or to the aryl group or arylene group represented by $Ar^5$, and n represents an integer of 3 to 6.

(I-c): A compound represented by the following Formula (V) and defined to be as below (V)

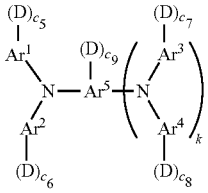

In Formula (V), each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VI), each of $c_5$ to $c_9$ represents an integer of 0 to 2, k represents 0 or 1, and the total number of D is from 3 to 8.

(VI)

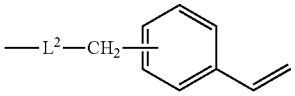

In Formula (VI), $L^2$ represents a divalent linking group having a group represented by —$(CH_2)$—O— directly linked to the aryl group represented by $Ar^1$ to $Ar^4$ or to the aryl group or arylene group represented by $Ar^5$, and n represents an integer of 1 to 6.

(I-d): A compound represented by the following Formula (V) and defined to be as below (V)

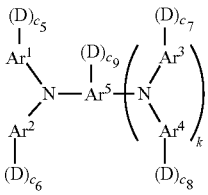

In Formula (V), each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VII), each of $c_5$ to $c_9$ represents an integer of 0 to 2, k represents 0 or 1, and the total number of D is from 1 to 8.

(VII)

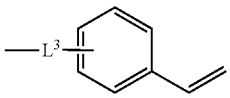

In Formula (VII), $L^3$ represents a divalent linking group having one or more groups selected from a group consisting of —C(═O)—, —N(R)—, —S—, and a group that is a combination of —C(═O)— with —O—, —N(R)—, or —S—, and R represents a hydrogen atom, an alkyl group, an aryl group, or an aralkyl group.

The use of a charge transporting film formed using the composition for forming a charge transporting film according to the present exemplary embodiment is not particularly limited. However, the charge transporting film is suitable as, for example, an uppermost surface layer of an electrophotographic photoreceptor (hereinbelow, also simply referred to as a "photoreceptor").

In order to extend the life of an electrophotographic photoreceptor by improving abrasion resistance thereof, a method of providing a cured type (cross-linked type) uppermost surface layer is known, and an acrylic curable material is generally used for this. Since the composition for forming a charge transporting film of the present exemplary embodiment is more hydrophobic than an acrylic material is, moisture is not easily attracted to the composition, hence electrical characteristics thereof are maintained excellently for a long time.

In order to reduce a coefficient of friction of the photoreceptor surface, a method of internally adding fluorine-containing resin particles is known. However, when the fluorine-containing particles are internally added to the uppermost surface layer, tiny lumps of the fluorine-containing resin particles are partially formed in some cases. If there are lumps of the fluorine-containing resin particles on the uppermost surface layer, cleaning defectiveness is caused since the torque applied to a cleaning blade during cleaning of the photoreceptor differs from place to place, and consequently, image quality may deteriorate.

The present inventors have found that by using a solvent having a dielectric constant of 5.0 or more as a solvent that is used when the uppermost surface layer of a photoreceptor is formed by coating, the lumps formed by aggregation of the fluorine-containing resin particles in the surface layer may be inhibited, and an electrophotographic photoreceptor in which the resin particles are dispersed excellently may be obtained. Though unclear, presumably, the reason is that since the dielectric constant of the solvent is 5.0 or more, a fluorine-containing dispersant is present without being concentrated to the fluorine-containing resin particles or to the solvent, hence the aggregation of particles is inhibited.

Hereinbelow, description will be made focusing mainly on an electrophotographic photoreceptor in which a protective layer is formed as an uppermost surface layer by using the composition for forming a charge transporting film according to the present exemplary embodiment.

Electrophotographic Photoreceptor

The electrophotographic photoreceptor according to the present exemplary embodiment includes a conductive supporter and a photosensitive layer disposed on the conductive supporter, and an uppermost surface layer of the photoreceptor is formed of the composition for forming a charge transporting film according to the present exemplary embodiment.

The electrophotographic photoreceptor according to the present exemplary embodiment has a layer containing a polymer of the specific reactive group-containing charge transport material as an uppermost surface layer. The uppermost surface layer just needs to be formed on the uppermost surface of the electrophotographic photoreceptor itself, and is provided as a layer functioning as a protective layer or a charge transport layer.

When the uppermost surface layer is a layer functioning as a protective layer, below the protective layer, there is a photosensitive layer consisting of a charge transport layer and a charge generating layer, or a single layer type photosensitive layer. In addition, an exemplary embodiment is exemplified in which the protective layer is a polymer of a specific reactive group-containing compound.

On the other hand, when the uppermost surface layer functions as a charge transport layer, an exemplary embodiment is exemplified in which a charge generating layer and a composition as an uppermost surface layer containing the specific reactive group-containing charge transport material or a layer containing a cured substance of the composition are provided on the conductive supporter.

The specific reactive group-containing charge transport material may be used concurrently with a compound having an unsaturated bond and charge transport material not showing reactivity (unreactive charge transport material).

If the uppermost surface layer is formed using the specific reactive group-containing charge transport material, a portion of the solvent may be caused to remain in the uppermost surface layer, and the residual solvent may be identified by thermal extraction gas chromatographic mass spectrometry using, for example, GCMS-QP2010 Ultra (manufactured by Shimadzu Corporation).

Hereinbelow, the electrophotographic photoreceptor according to the present exemplary embodiment in a case where the uppermost surface layer is a layer functioning as a protective layer will be described in detail with reference to drawings. In the drawings, the same or corresponding portions are marked with the same reference numerals, thereby omitting the repeated descriptions.

FIG. 1 is a schematic cross-sectional view showing an example of the electrophotographic photoreceptor according to the present exemplary embodiment. Each of FIGS. 2 and 3 is a schematic cross-sectional view showing another example of the electrophotographic photoreceptor according to the present exemplary embodiment.

An electrophotographic photoreceptor 7A shown in FIG. 1 is a so-called functional separation type photoreceptor (or a lamination type photoreceptor), and has a structure in which an undercoat layer 1 is disposed on a conductive supporter 4, and a charge generating layer 2, a charge transport layer 3, and a protective layer 5 are sequentially formed on the undercoat layer 1. In the electrophotographic photoreceptor 7A, a photosensitive layer is constituted with the charge generating layer 2 and the charge transport layer 3.

Figure 2:
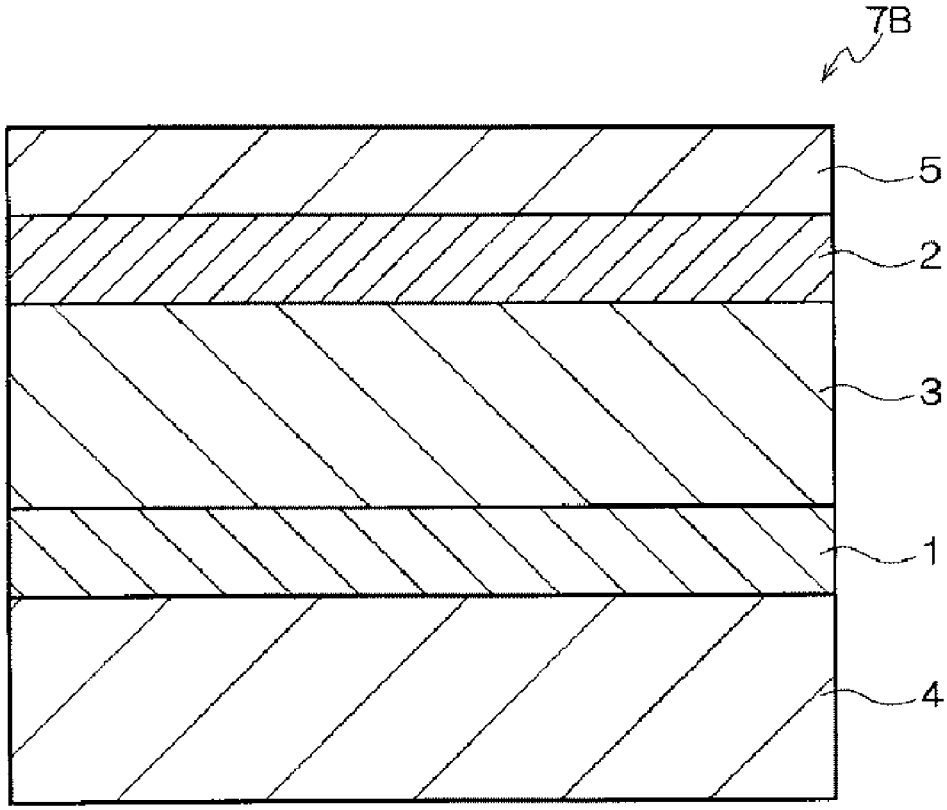
FIG. 2 is a schematic partial cross-sectional view showing another example of the layer constitution of the electrophotographic photoreceptor according to the present exemplary embodiment.
Figure 3:
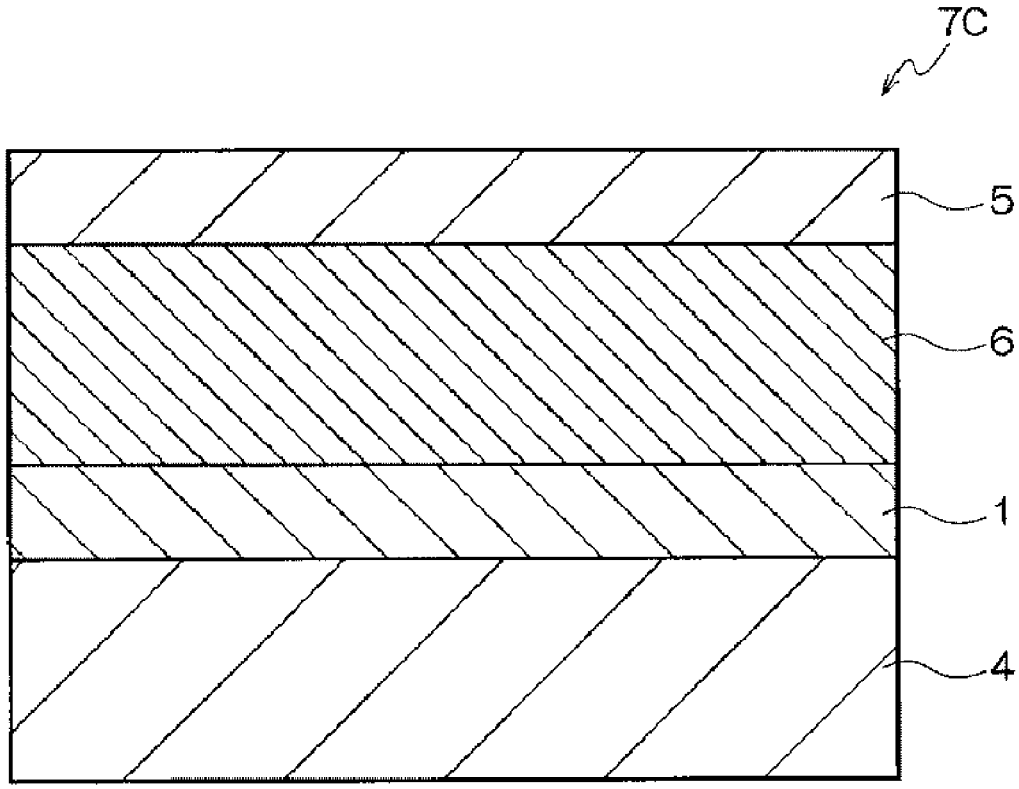
FIG. 3 is a schematic partial cross-sectional view showing another example of the layer constitution of the electrophotographic photoreceptor according to the present exemplary embodiment.

An electrophotographic photoreceptor 7B shown in FIG. 2 is a functional separation type photoreceptor in which the functions are divided into the charge generating layer and the charge transport layer 3, similarly to the electrophotographic photoreceptor 7A shown in FIG. 1.

The electrophotographic photoreceptor 7B shown in FIG. 2 has a structure in which the undercoat layer 1 is disposed on the conductive supporter 4, and the charge transport layer 3, the charge generating layer 2, and the protective layer 5 are sequentially formed on the undercoat layer 1. In the electrophotographic photoreceptor 7B, a photosensitive layer is constituted with the charge transport layer 3 and the charge generating layer 2.

An electrophotographic photoreceptor 7C shown in FIG. 3 contains a charge generating material and a charge transport material in the same layer (single layer type photosensitive layer 6). The electrophotographic photoreceptor 7C shown in FIG. 3 has a structure in which the undercoat layer 1 is disposed on the conductive supporter 4, and the single layer type photosensitive layer 6 and the protective layer 5 are sequentially formed on the undercoat layer 1.

In the electrophotographic photoreceptors 7A, 7B, and 7C shown in FIGS. 1, 2, and 3, the protective layer 5 becomes the uppermost surface layer disposed farthest away from the conductive supporter 4, and the uppermost surface layer is constituted as described above.

In addition, in the electrophotographic photoreceptors shown in FIGS. 1, 2, and 3, the undercoat layer 1 may or may not be provided.

Hereinbelow, the respective elements will be described based on the electrophotographic photoreceptor 7A shown in FIG. 1 as a representative example.

Protective Layer

First, the protective layer 5 as the uppermost surface layer in the electrophotographic photoreceptor 7A will be described.

The protective layer 5 is the uppermost surface layer in the electrophotographic photoreceptor 7A and formed containing a polymer of the specific reactive group-containing charge transport material. That is, the protective layer 5 is formed by curing a composition containing a specific reactive group-containing compound, a solvent having a dielectric constant of 5.0 or more, fluorine-containing resin particles, and a fluorine-containing dispersant.

As a curing method, radical polymerization caused by heat, light, radiation, or the like is performed. If the reaction conditions are adjusted so as not to cause the reaction to progress too fast, occurrence of unevenness or wrinkle in the film is inhibited. Consequently, it is preferable to perform polymerization under such conditions that radicals are caused relatively slowly. In this respect, thermal polymerization in which the polymerization rate is easily adjusted is suitable.

Specific Reactive Group-Containing Charge Transport Material

The composition for forming a charge transporting film (specific reactive group-containing charge transport material) of the present exemplary embodiment is constituted with a solvent having a dielectric constant of 5.0 or more, at least one kind of compound (specific reactive group-containing compound) selected from a group consisting of the following compounds (I-a), (I-b), (I-c), and (I-d) among compounds represented by Formula (I) and a compound represented by Formula (II), fluorine-containing resin particles, and a fluorine-containing dispersant.

Specific Reactive Group-Containing Compound

In Formulae (I) and (II), F represents a charge transporting skeleton, that is, a structure having a charge transporting property. Specific examples of the structure include structures having a charge transporting property, such as a phthalocyanine compound, a porphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In Formula (I), examples of the linking group represented by L include a divalent linking group in which —C(=O)—O— is inserted between alkylene groups, a divalent linking group in which —C(=O)—N(R)— is inserted between alkylene groups, a divalent linking group in which —C(=O)—S— is inserted between alkylene groups, a divalent linking group in which —O— is inserted between alkylene group, a divalent linking group in which —N(R)— is inserted between alkylene groups, and a divalent linking group in which —S— is inserted between alkylene groups.

Moreover, in the linking group represented by L, two of the groups such as —C(=O)—O—, —C(=O)—N(R)—, —C(=O)—S—, —O—, and —S— may be inserted between alkylene groups.

In Formula (I), specific examples of the linking group represented by L include $*—(CH_2)_p—C(=O)—O—(CH_2)_q—$, $*—(CH_2)_p—C(=O)—N(R)—(CH_2)_q—$, $*—(CH_2)_p—C(=O)—S—(CH_2)_q—$, $*—(CH_2)_p—O—(CH_2)_q—$, $*—(CH_2)_p—N(R)—(CH_2)_q—$, $*—(CH_2)_p—S—(CH_2)_q—$, $*—(CH_2)_p—O—(CH_2)_r—O—(CH_2)_q—$, and the like.

Herein, in the linking group represented by L, p represents 0 or an integer of 1 to 6 (preferably 1 to 5), q represents an integer of 1 to 6 (preferably 1 to 5), and r represents an integer of 1 to 6 (preferably 1 to 5).

In addition, in the linking group represented by L, "*" represents a site linked to F.

On the other hand, in Formula (II), examples of the linking group represented by L' include a linking group having a valency of (n+1) in which —C(=O)—O— is inserted between alkylene groups linked in a branch shape, a linking group having a valency of (n+1) in which —C(=O)—N(R)— is inserted between alkylene groups linked in a branch shape, a linking group having a valency of (n+1) in which —C(=O)—S— is inserted between alkylene groups linked in a branch shape, a linking group having a valency of (n+1) in which —O— is inserted between alkylene groups linked in a branch shape, a linking group having a valency of (n+1) in which —N(R)— is inserted between alkylene groups linked in a branch shape, and a linking group having a valency of (n+1) in which —S— is inserted between alkylene groups linked in a branch shape.

Moreover, in the linking group represented by L', two of the groups such as —C(=O)—O—, —C(=O)—N(R)—, —C(=O)—S—, —O—, and —S— may be inserted between the alkylene groups linked in a branch shape.

In Formula (II), specific examples of the linking group represented by L' include $*—(CH_2)_p—CH[C(=O)—O—(CH_2)_q—]_2$, $*—(CH_2)_p—CH[C(=O)—N(R)—(CH_2)_q—]_2$, $*—(CH_2)_p—CH[C(=O)—S—(CH_2)_q—]_2$, $*—(CH_2)_p—CH[(CH_2)_r—O—(CH_2)_q—]_2$, $*—(CH_2)_p—CH[(CH_2)_r—N(R)—(CH_2)_q—]_2$, $*—(CH_2)_p—CH[(CH_2)_r—S—(CH_2)_q—]_2$,

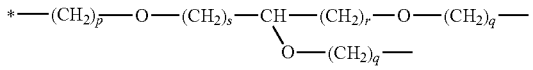

$*—(CH_2)_p—O—C[(CH_2)_r—O—(CH_2)_q—]_3$, $*—(CH_2)_p—C(=O)—O—C[(CH_2)_r—O—(CH_2)_q—]_3$, and the like.

Herein, in the linking group represented by L', p represents 0 or an integer of 1 to 6 (preferably 1 to 5), q represents an integer of 1 to 6 (preferably 1 to 5), r represents an integer of 1 to 6 (preferably 1 to 5), and s represents an integer of 1 to 6 (preferably 1 to 5).

In addition, in the liking group represented by L', "*" represents a site linked to F.

In the linking groups represented by L and L' in Formulae (I) and (II), examples of the alkyl group represented by R of "—N(R)—" include linear or branched alkyl groups having 1 to 5 (preferably 1 to 4) carbon atoms, and specific examples thereof include a methyl group, an ethyl group, a propyl group, a butyl group, and the like.

Examples of the aryl group represented by R of "—N(R)—" include aryl groups having 6 to 15 (preferably 6 to 12) carbon atoms, and specific examples thereof include a phenyl group, a toluoyl group, a xylidyl group, a naphthyl group, and the like.

Examples of the aralkyl group include aralkyl groups having 7 to 15 (preferably 7 to 14) carbon atoms, and specific examples thereof include a benzyl group, a phenethyl group, a biphenyl methylene group, and the like.

In Formulae (I) and (II), m preferably represents an integer of 1 to 6.

m' preferably represents an integer of 1 to 6.

n preferably represents an integer of 2 to 3.

Particularly preferable examples of the specific reactive group-containing compound include a compound having a charge transporting skeleton (structure having a charge transporting property) derived from a triarylamine compound, as F in Formulae (I) and (II).

Specifically, the reactive compound represented by Formula (I) is preferably reactive compounds which are represented by the following Formulae (III) and (V), and in which D in the following Formula (III) indicates a group represented by the following Formula (IV), and D in Formula (V) indicates a group represented by the following Formula (VI) or (VII).

In addition, the reactive compound represented by Formula (II) is particularly preferably a reactive compound which is represented by the following Formula (V) and in which D in the following Formula (V) indicates a group represented by the following Formula (VIII).

(III)

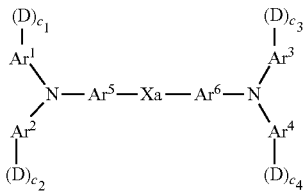

(V)

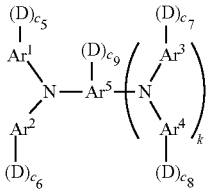

(IV)

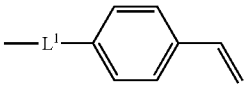

(VI)

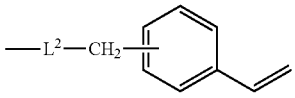

-continued (VII)

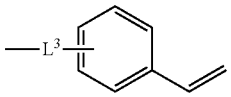

(VIII)

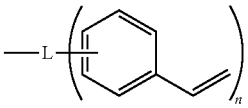

In Formula (III), each of $Ar^1$ to $Ar^4$ independently represents a substituted or unsubstituted aryl group, each of $Ar^5$ and $Ar^6$ independently represents a substituted or unsubstituted arylene group, Xa represents a divalent group that is a combination of groups selected from an alkylene group, —O—, —S—, and an ester, and D represents a group represented by Formula (IV). Each of $c_1$ to $c_4$ independently represents an integer of 0 to 2, and the total number of D is 1 or 2. $L^1$ represents a linking group that binds to an aromatic ring (aryl group) of the charge transporting skeleton represented by F, is represented by *—$(CH_2)_{n''}$—O—$CH_2$—(n" is 1 or 2), and binds to an aromatic ring of the charge transporting skeleton via *.

In Formula (V), each of $Ar^1$ to $Ar^4$ independently represents a substituted or unsubstituted aryl group, $Ar^5$ represents a substituted or unsubstituted aryl group or a substituted or unsubstituted arylene group, each of $c_5$ to $c_9$ represents an integer of 0 to 2, and k represents 0 or 1. Hereinbelow, description will be made for divided four cases.

Case 1: Compound of (I-b).

In Formula (V), the total number of D is 1 or 2, and D represents a group represented by the following Formula (VI). In Formula (VI), $L^2$ represents a divalent linking group having a group represented by —$(CH_2)_n$—O— directly linked to the aryl group represented by $Ar^1$ to $Ar^4$ or to the aryl group or arylene group represented by $Ar^5$, and n represents an integer of 3 to 6.

(VI)

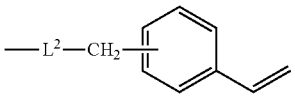

Case 2: Compound of (I-c)

In Formula (V), the total number of D is 3 to 8, and D represents the group represented by Formula (VI). In Formula (VI), $L^2$ represents a divalent linking group having a group represented by —$(CH_2)_n$—O— directly linked to the aryl group represented by $Ar^1$ to $Ar^4$ or to the aryl group or arylene group represented by $Ar^5$, and n represents an integer of 1 to 6.

Case 3: Compound of (I-d)

In Formula (V), the total number of D is 1 to 8, and D represents a group represented by the following Formula (VII). In Formula (VII), $L^3$ represents a divalent linking group having one or more groups selected from a group consisting of —C(=O)—, —N(R)—, —S—, and a group as a combination of —C(=O)— with —O—, —N(R)—, or —S—. R represents a hydrogen atom, an alkyl group, an aryl group, or an aralkyl group.

(VII)

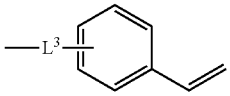

Among the groups represented by Formula (VII), a group represented by the following Formula (VII-1) is more preferable.

(VII-1)

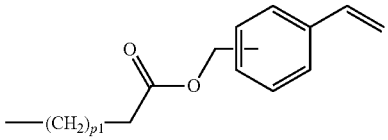

In Formula (VII-1), p1 represents an integer of 0 to 4.

Case 4: Compound Represented by Formula (II)

The total number of n is 1 to 8, and a group linked to the charge transporting skeleton represented by F of the compound represented by Formula (II) is a group represented by the following Formula (VIII). In Formula (VIII), L represents a linking group having a valency of (n+1) that is a combination of two or more kinds selected from a group consisting of tri- or tetravalent groups derived from an alkylene group, an alkenylene group, —C(=O)—, —N(R)—, —O—, —S—, and alkane, and R represents a hydrogen atom, an alkyl group, an aryl group, or an aralkyl group. n represents an integer of 2 to 3.

(VIII)

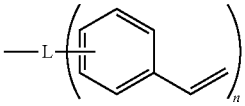

Among the groups represented by Formula (VIII), the groups represented by the following Formulae (VIII-1), (VIII-2), (VIII-3), and (VIII-4) are more preferable.

(VIII-1)

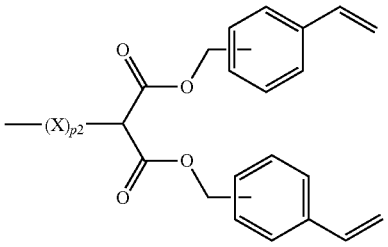

(VIII-2)

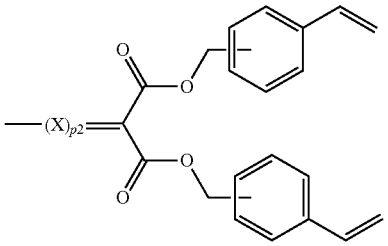

In Formula (VIII-1) or (VIII-2), X represents a divalent group, and p2 represents an integer 0 or 1.

(VIII-3)

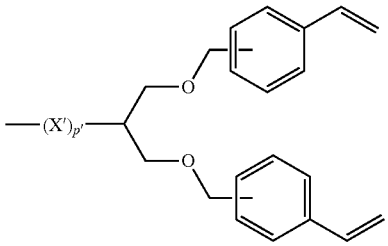

(VIII-4)

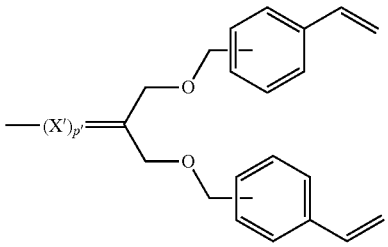

In Formula (VIII-3) or (VIII-4), X' represents a divalent group, and p' represents an integer 0 or 1.

Hereinbelow, the specific reactive group-containing compounds represented by Formulae (III) and (V) will be described in detail.

In Formula (III), each of $Ar^1$, $Ar^2$, $Ar^3$, and $Ar^4$ independently represents a substituted or unsubstituted aryl group, and may be the same as or different from each other. Each of $Ar^5$ and $Ar^6$ independently represents a substituted or unsubstituted arylene group, and may be the same as or different from each other.

In Formula (V), each of $Ar^1$, $Ar^2$, $Ar^3$, and $Ar^4$ independently represents a substituted or unsubstituted aryl group, and may be the same as or different from each other.

Herein, examples of substituents of the substituted aryl group include an alkyl group having 1 to 4 carbon atoms, an alkoxy group having 1 to 4 carbon atoms, an aryl group having 6 to 10 carbon atoms, and the like other than D. These alkyl group, alkoxy group, and aryl group may be substituted or unsubstituted.

$Ar^1$, $Ar^2$, $Ar^3$, and $Ar^4$ are preferably one of the following Formulae (1) to (7). In addition, the following Formulae (1) to (7) show in common "$-(D)_c$" that collectively indicates "$-(D)_{c1}$" to "$-(D)_{c9}$" being able to be linked to each of $Ar^1$, $Ar^2$, $Ar^3$, and $Ar^4$.

(1)

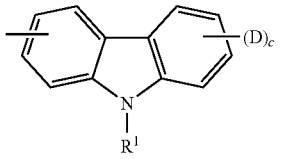

(2)

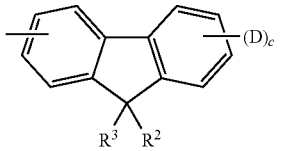

-continued (3)

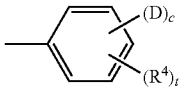

(4)

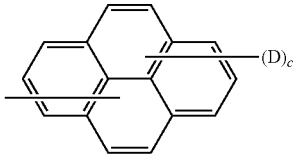

(5)

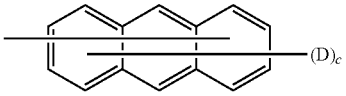

(6)

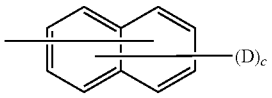

(7)

$$-Ar-(Z')_s-Ar-(D)_c$$

In Formulae (1) to (7), $R^1$ represents one kind selected from a group consisting of a hydrogen atom, an alkyl group having 1 to 4 carbon atoms, a phenyl group substituted with an alkyl group having 1 to 4 carbon atoms or with an alkoxy group having 1 to 4 carbon atoms, an unsubstituted phenyl group, and an aralkyl group having 7 to 10 carbon atoms, each of $R^2$, $R^3$, and $R^4$ independently represents one kind selected from a group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, Ar represents a substituted or unsubstituted arylene group, c represents 0, 1, or 2, s represents 0 or 1, t represents an integer of 0 to 3, and Z' represents a divalent organic linking group.

Herein, as Ar in Formula (7), the group represented by the following structural formula (8) or (9) is preferable.

(8)

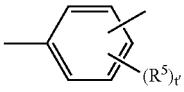

(9)

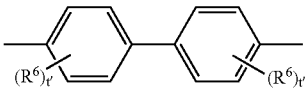

In Formulae (8) and (9), each of $R^5$ and $R^6$ independently represents one kind selected from a group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and each t' represents an integer of 0 to 3.

In Formula (7), Z' is preferably a group represented by one of the following Formulae (10) to (17), and each s represents 0 or 1.

(10)

$$-(CH_2)_q-$$

(11)

$$-(CH_2CH_2O)_r-$$

(12)

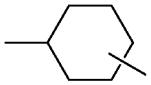

(13)

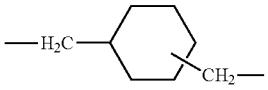

(14)

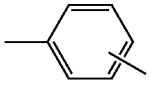

(15)

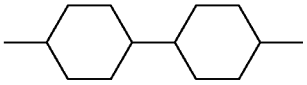

(16)

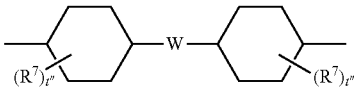

(17)

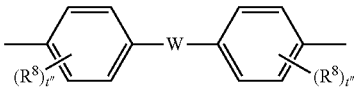

In Formulae (10) to (17), each of $R^7$ and $R^8$ independently represents one kind selected from a group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, W represents a divalent group, each of q and r independently represents an integer of 1 to 10, and each t" represents an integer of 0 to 3.

As W in Formulae (16) and (17), one of divalent groups represented by the following Formulae (18) to (26) is preferable. Here, in Formula (25), u represents an integer of 0 to 3.

(18)

$$-CH_2-$$

(19)

$$-C(CH_3)_2-$$

(20)

$$-O-$$

(21)

$$-S-$$

(22)

$$-C(CF_3)_2-$$

(23)

$$-Si(CH_3)_2-$$

(24)

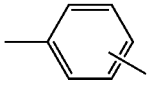

(25)

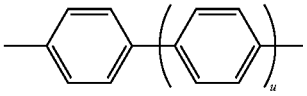

-continued (26)

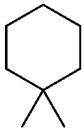

In Formula (V), when k is 0, $Ar^5$ is a substituted or unsubstituted aryl group, and examples of this aryl group include the aryl group exemplified in the description for $Ar^1$ to $Ar^4$. In addition, when k is 1, $Ar^5$ is a substituted or unsubstituted arylene group, and examples of this arylene group include an arylene group that is obtained by removing one hydrogen atom from the aryl group exemplified in the description for $Ar^1$ to $Ar^4$.

Hereinbelow, the specific reactive group-containing compound will be described in detail.

Specifically, the specific examples of the charge transporting skeleton F (skeleton excluding D in Formulae (III) and (V)) of Formulae (I) and (II), the specific examples of the groups represented by $(D)_{c1}$ to $(D)_{c9}$ in Formulae (III) and (V), and the specific examples of the specific reactive group-containing compounds represented by Formulae (I) and (II) will be shown below, but the invention is not limited thereto.

Moreover, the site "*" in the specific examples of the charge transporting skeleton F (skeleton excluding D in Formula (III)) of Formulae (I) and (II) means that the portion "*" in the specific examples of the groups represented by $(D)_{c1}$ to $(D)_{c9}$ is linked to the site.

For example, when a specific example of the charge transporting skeleton F is represented by (1)-1 and a specific example of the groups represented by $(D)_{c1}$ to $(D)_{c9}$ is represented by (IV)-1, an example compound (I)-1 is represented by the following structures.

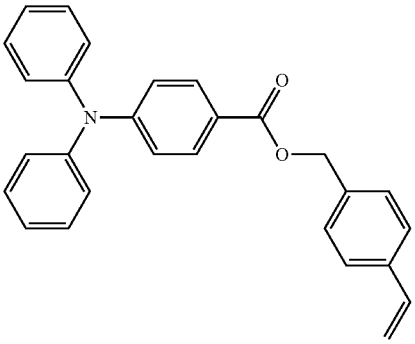

(1)-1

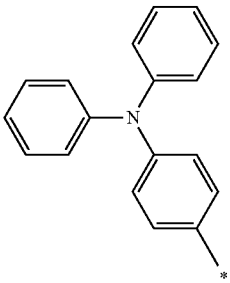

-continued (1)-2

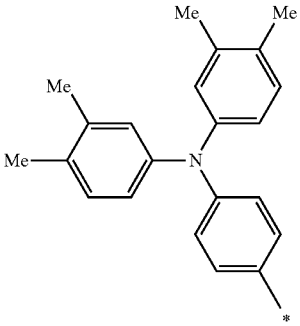

(1)-3

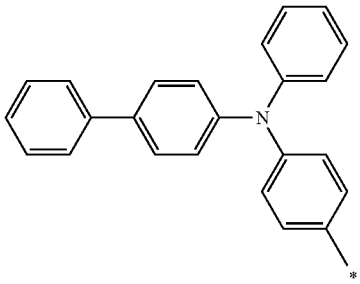

(1)-4

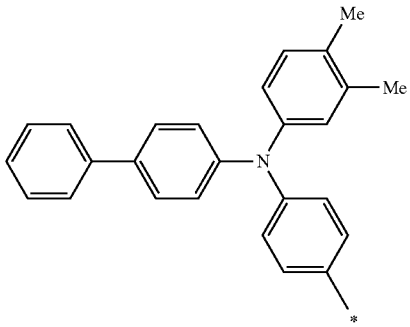

(1)-5

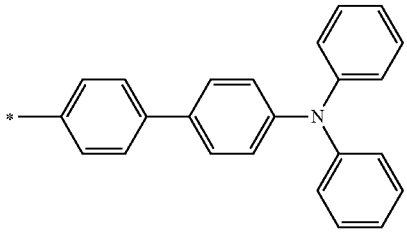

(1)-6

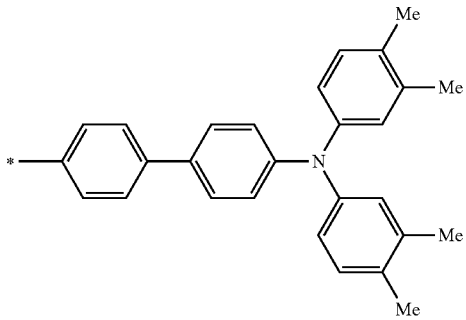

-continued
(1)-7
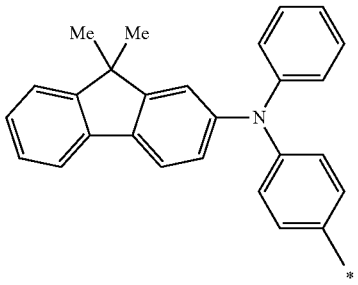
(1)-8
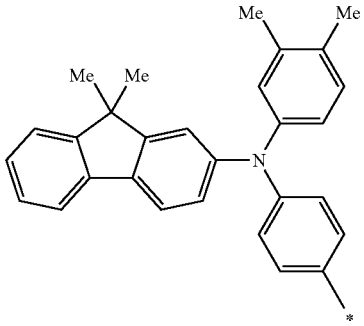
(1)-9
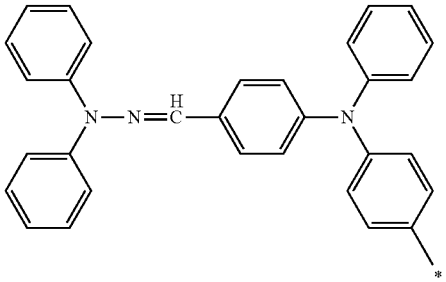
(1)-10
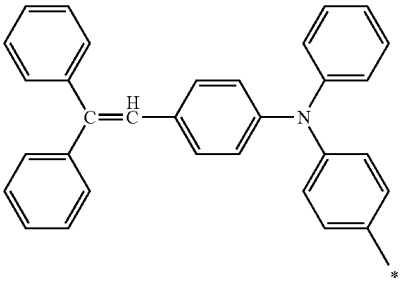
(1)-11
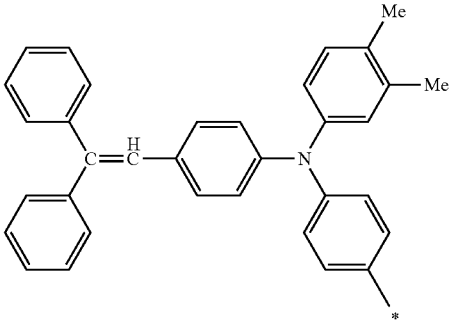
-continued
(1)-12
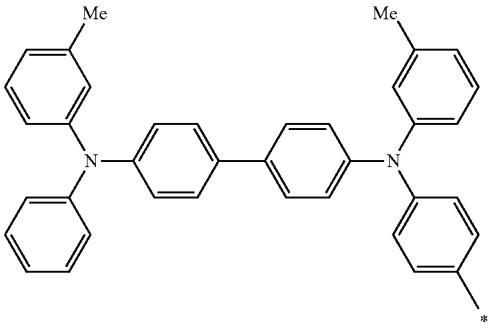
(1)-13
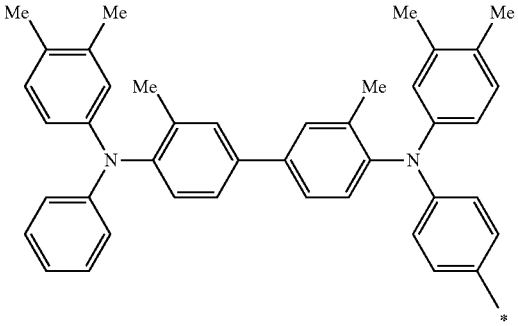
(1)-14
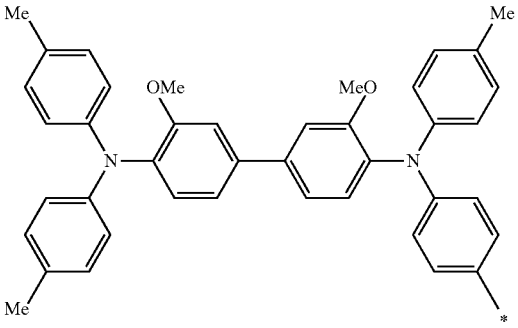
(1)-15
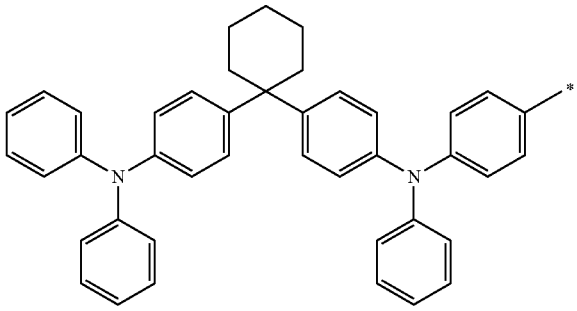

-continued
(1)-16
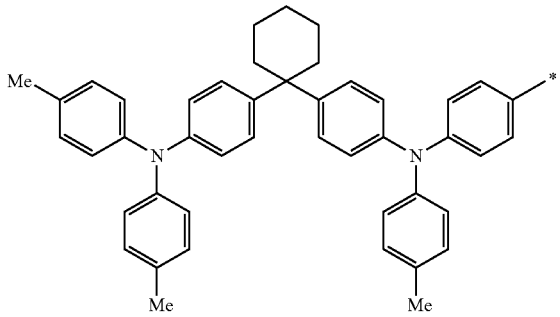
(1)-17
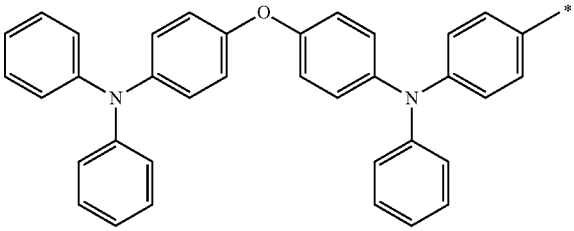
(1)-18
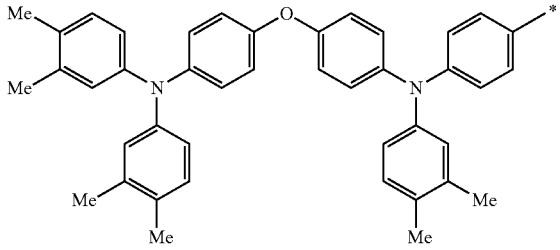
(1)-19
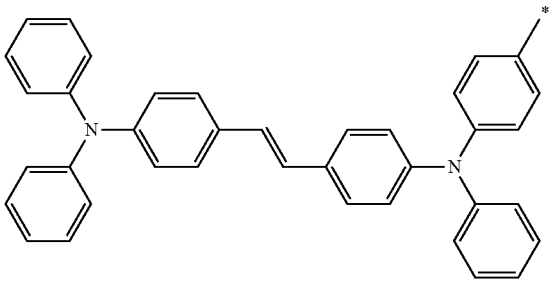
(1)-20
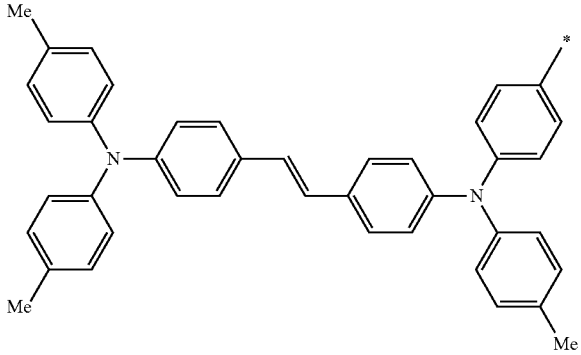
-continued
(1)-21
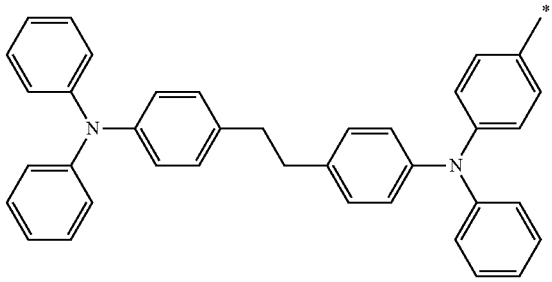
(1)-22
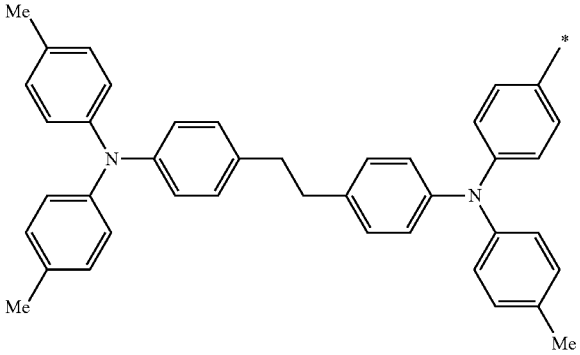
(2)-1
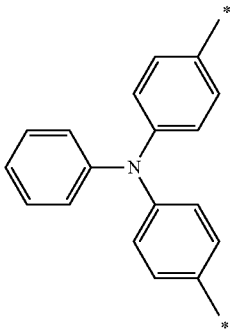
(2)-2
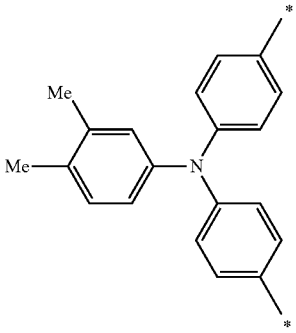

-continued
(2)-3
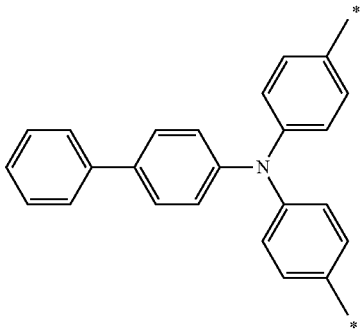
(2)-4
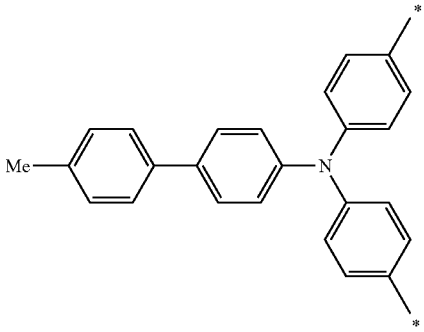
(2)-5
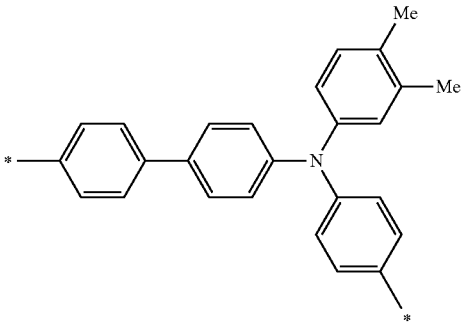
(2)-6
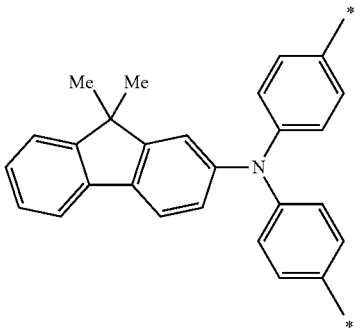
-continued
(2)-7
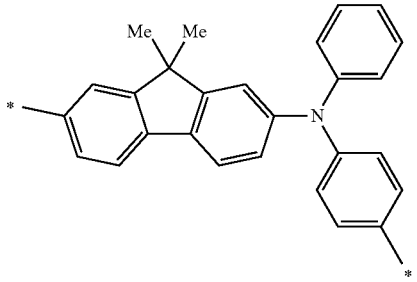
(2)-8
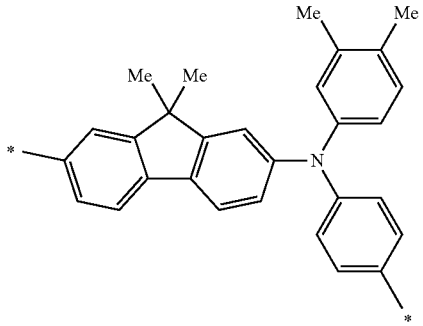
(2)-9
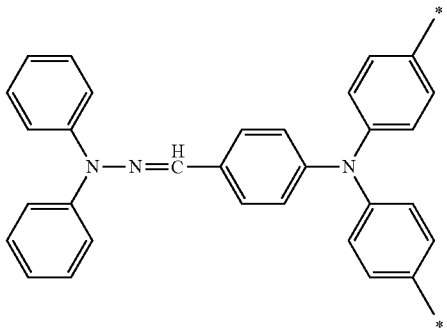
(2)-10
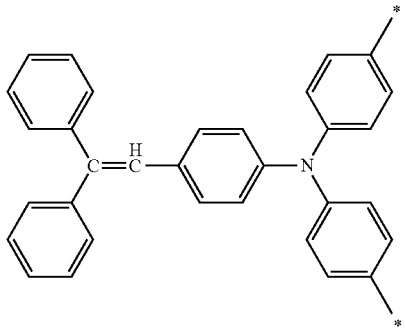

-continued
(2)-11
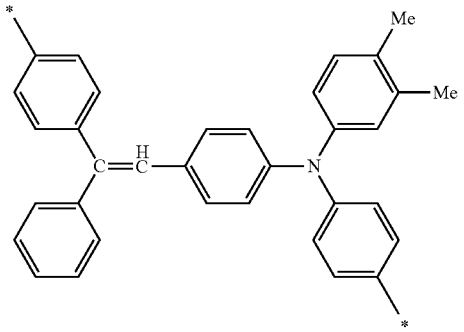
(2)-12
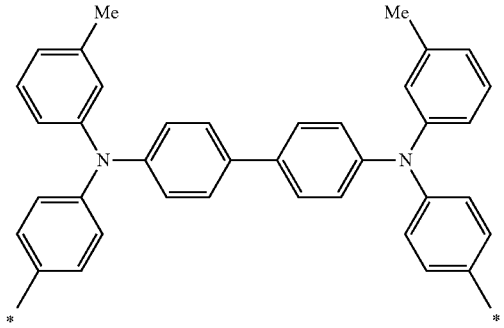
(2)-13
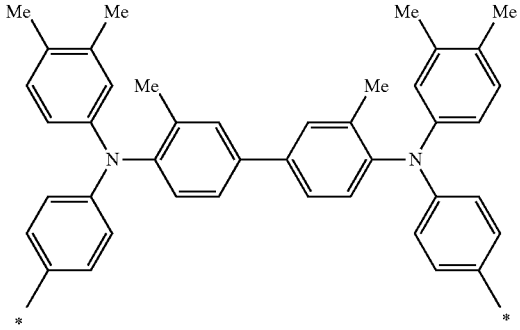
(2)-14
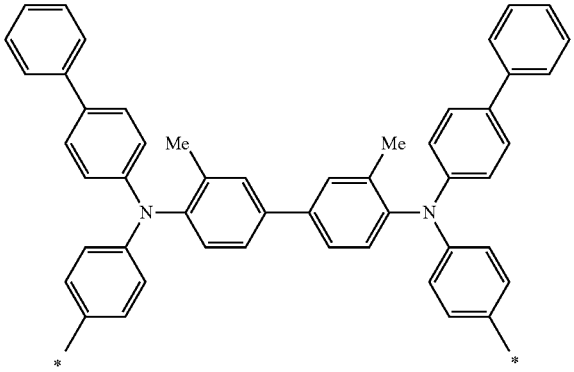
-continued
(2)-15
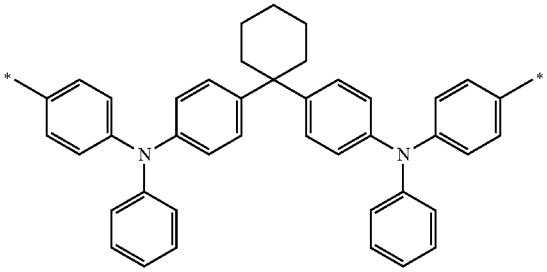
(2)-16
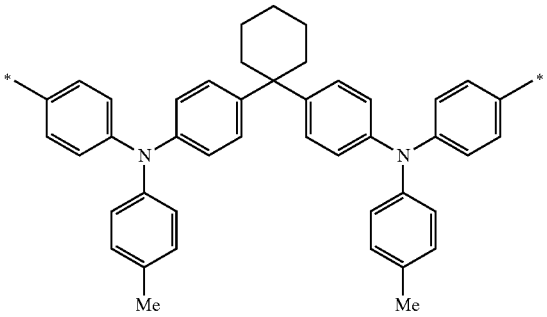
(2)-17
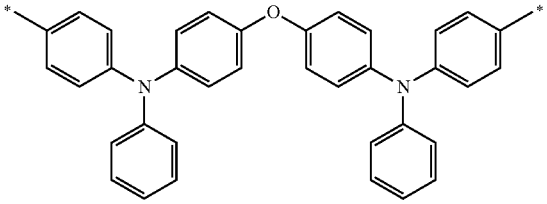
(2)-18
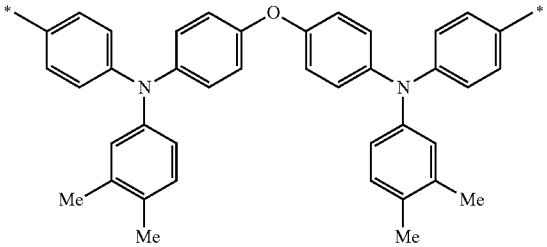
(2)-19
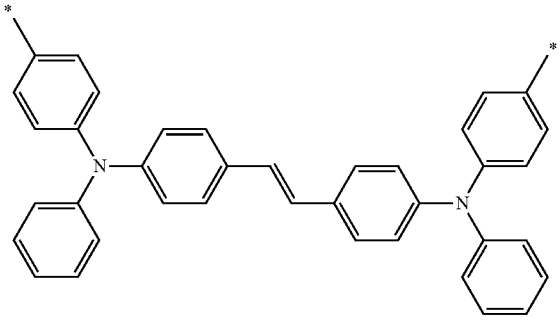

-continued
(2)-20
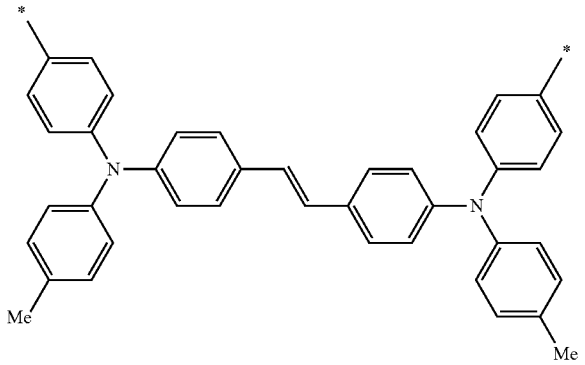
(2)-21
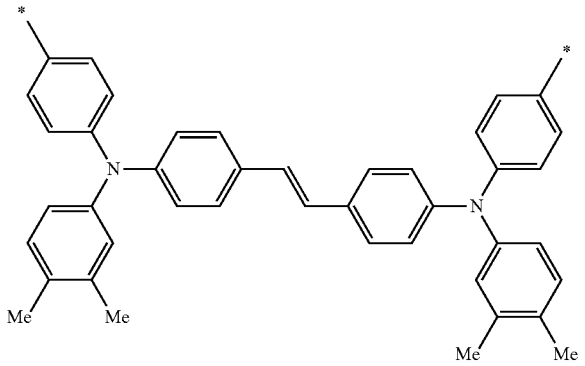
(2)-22
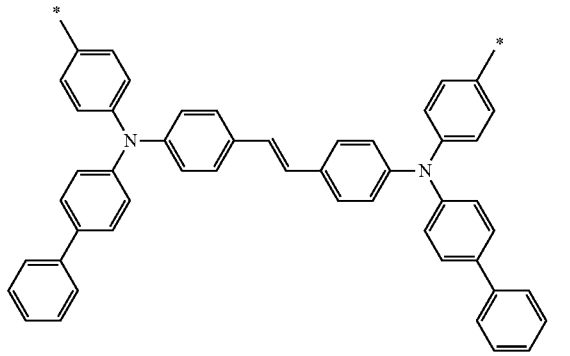
(2)-23
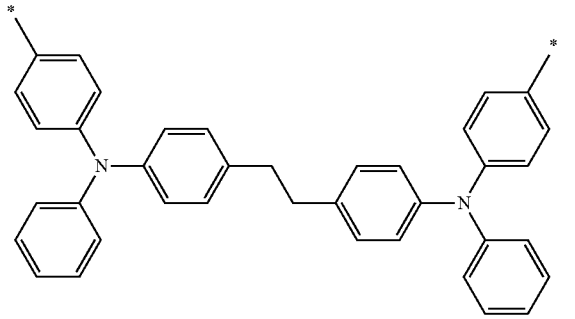
-continued
(2)-24
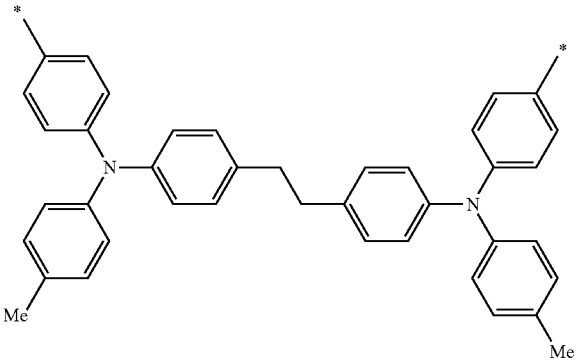
(2)-25
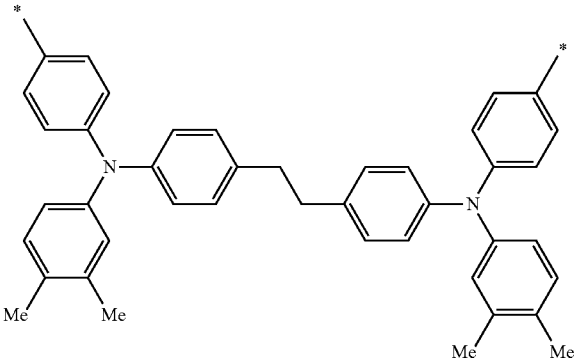
(2)-26
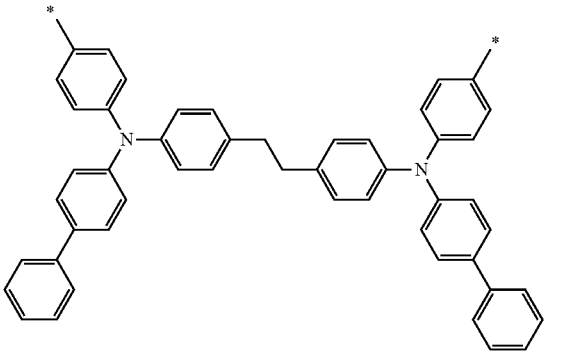
(3)-1
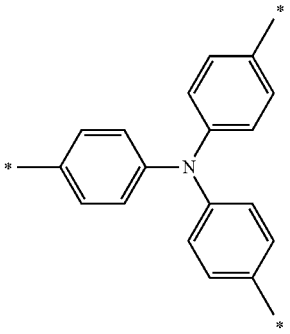

-continued
(3)-2
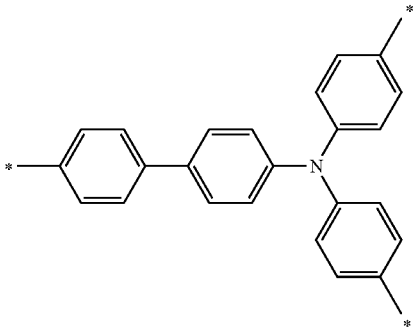
(3)-3
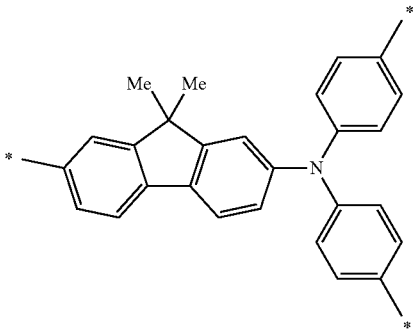
(3)-4
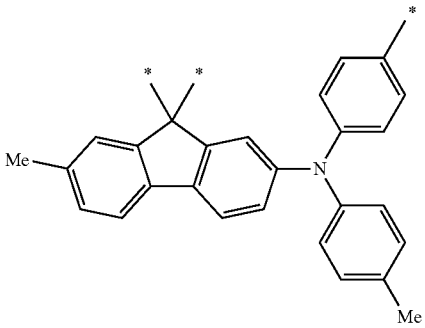
(3)-5
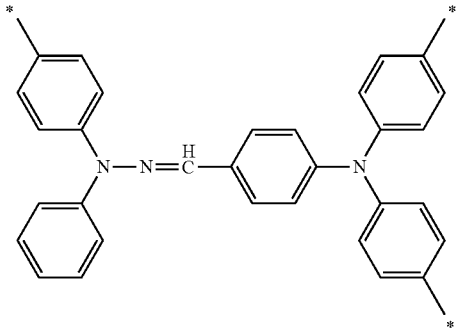
-continued
(3)-6
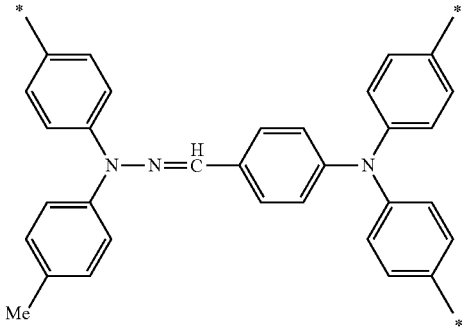
(3)-7
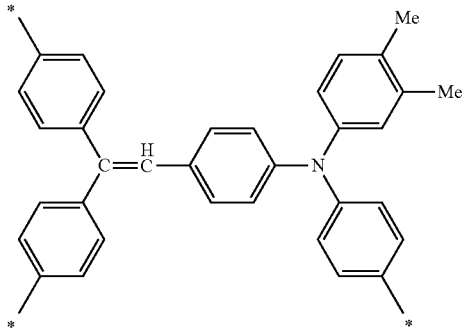
(3)-8
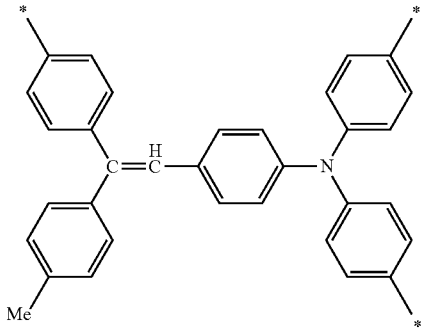
(3)-9
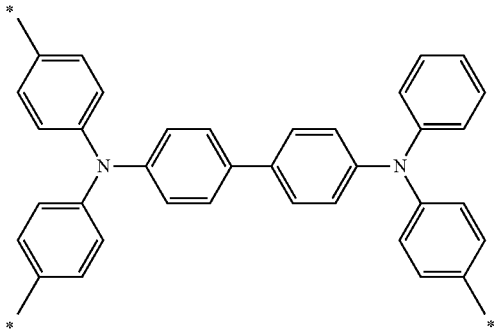

-continued
(3)-10
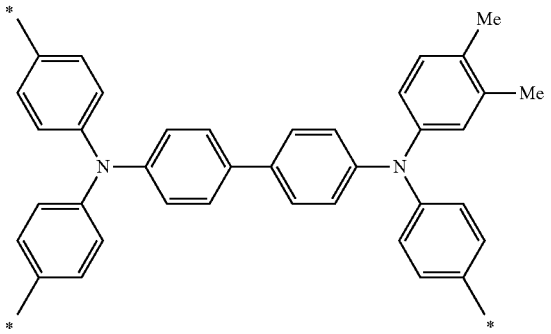
(3)-11
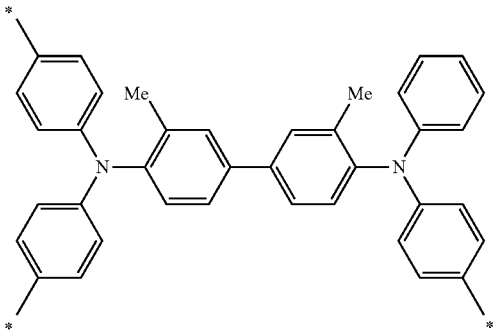
(3)-12
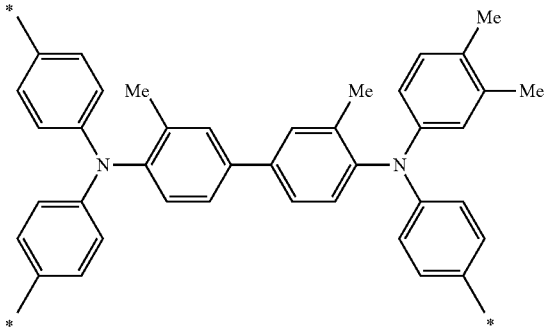
(3)-13
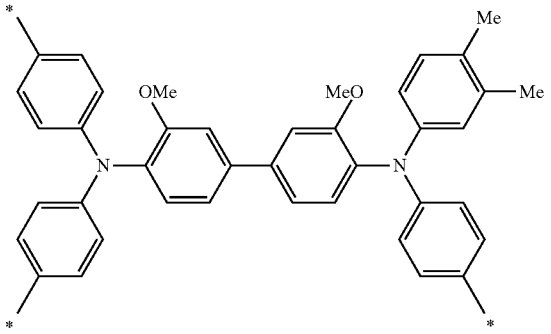
-continued
(3)-14
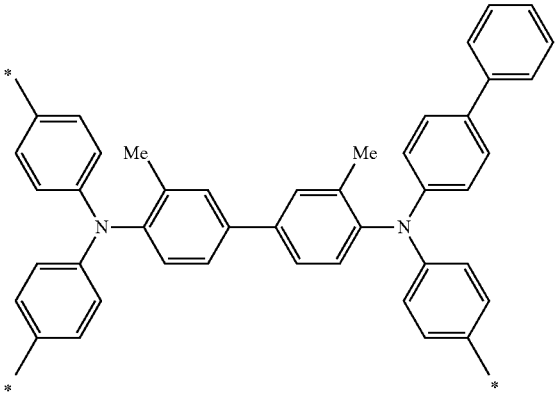
(3)-15
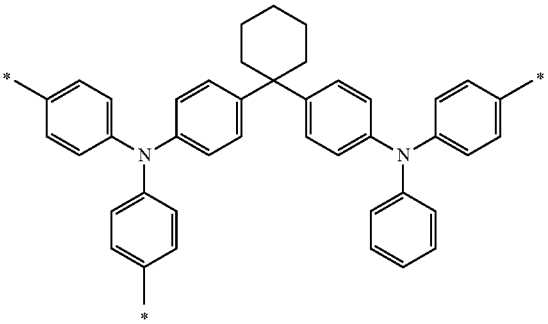
(3)-16
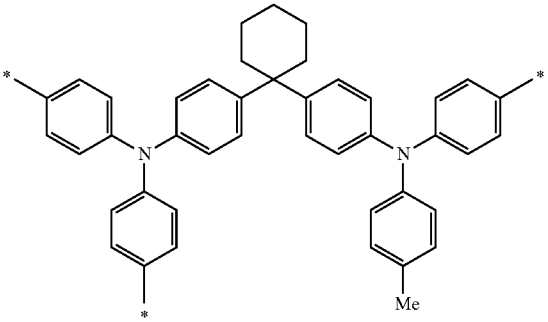
(3)-17
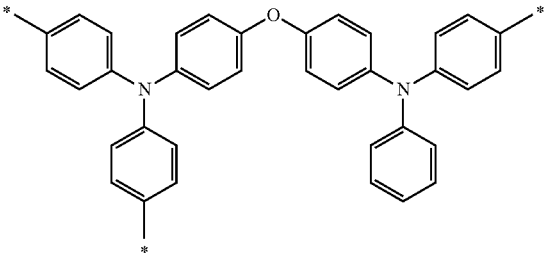

-continued
(3)-18
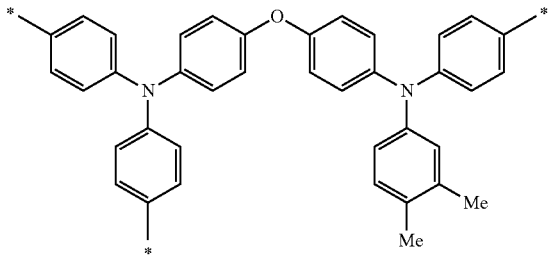
(3)-19
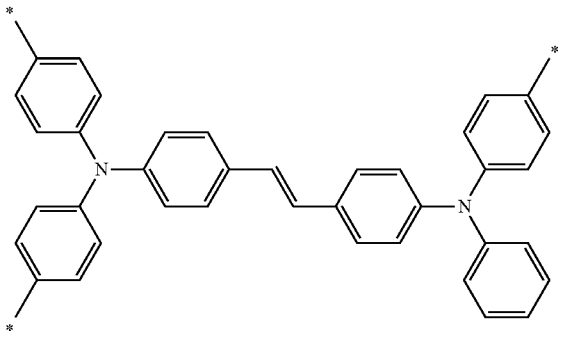
(3)-20
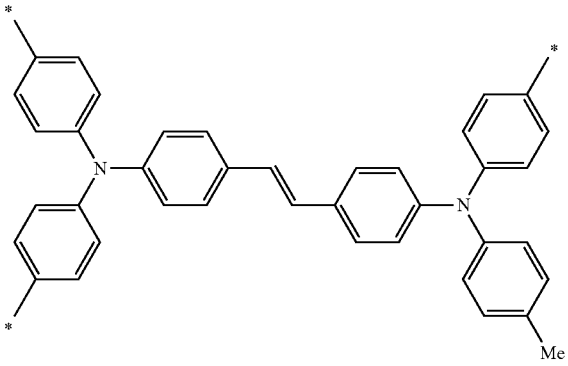
(3)-21
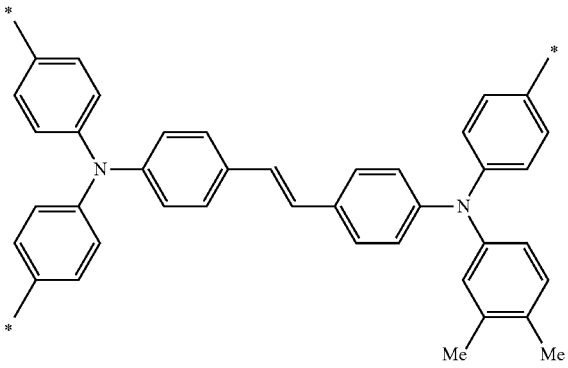
-continued
(3)-22
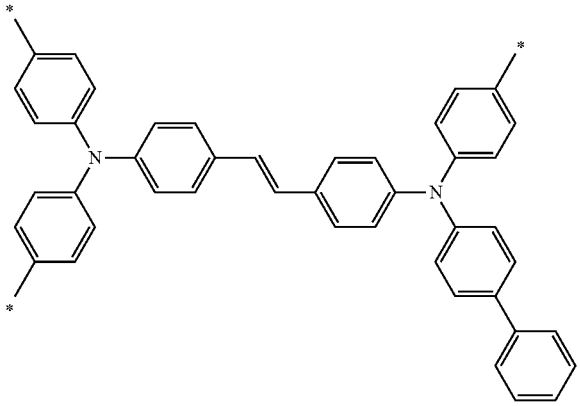
(3)-23
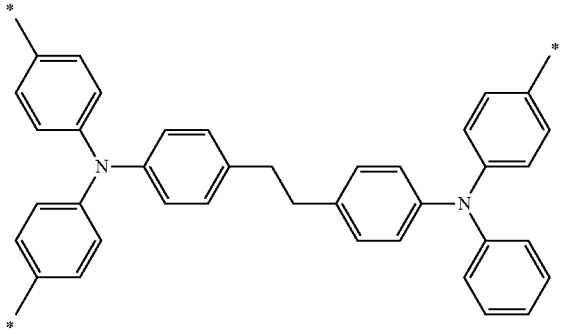
(3)-24
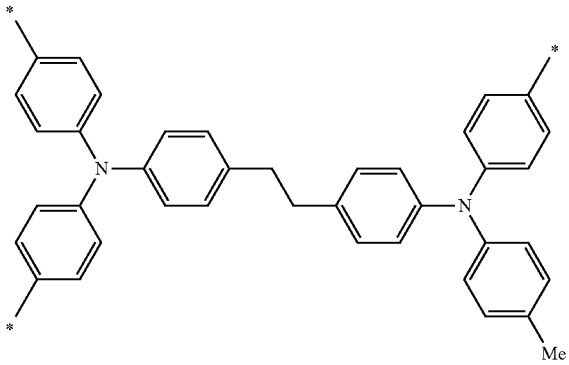
(3)-25
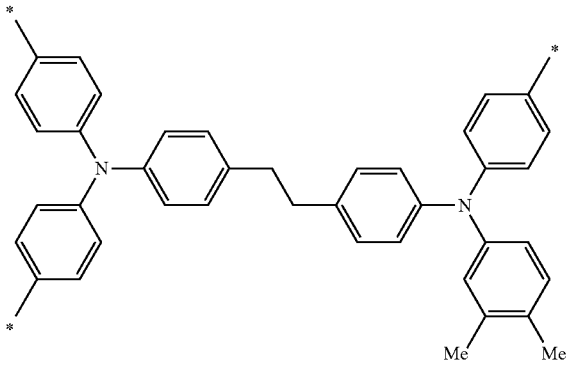

-continued
(3)-26
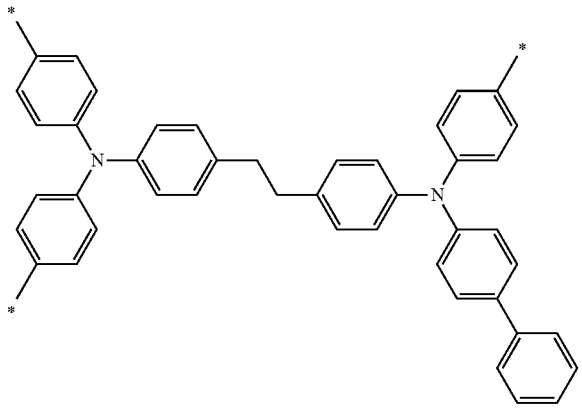
(4)-1
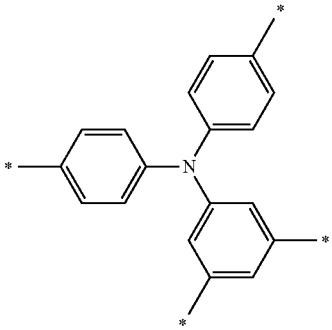
(4)-2
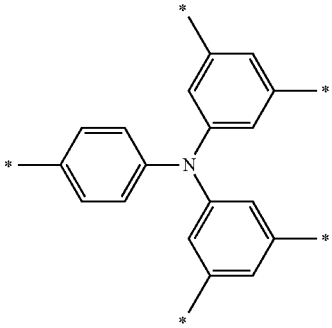
(4)-3
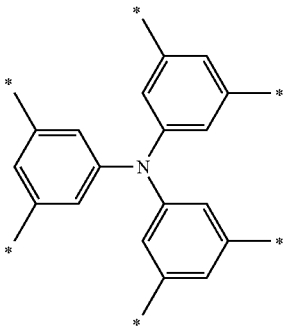
-continued
(4)-4
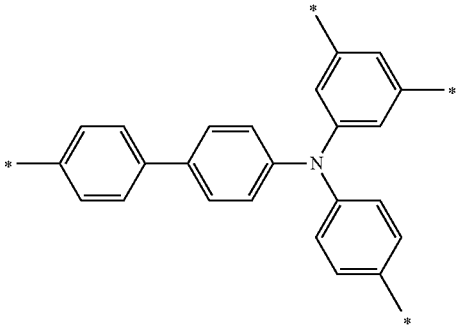
(4)-5
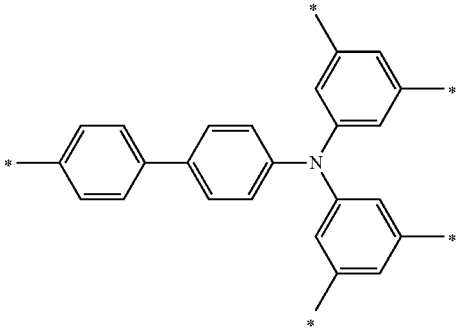
(4)-6
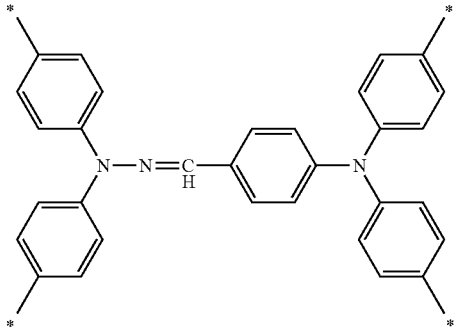
(4)-7
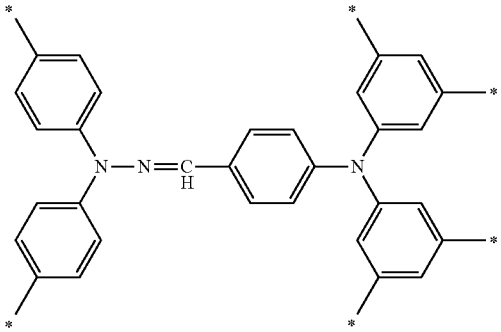

-continued
(4)-8
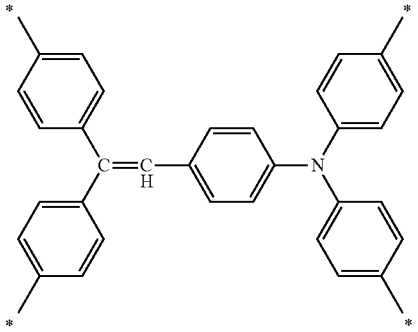
(4)-9
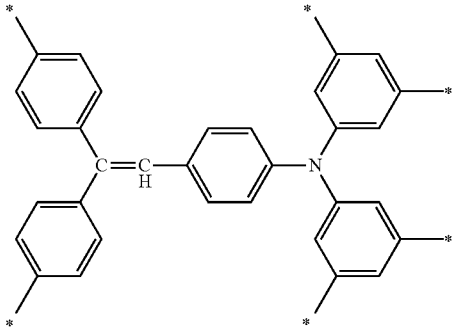
(4)-10
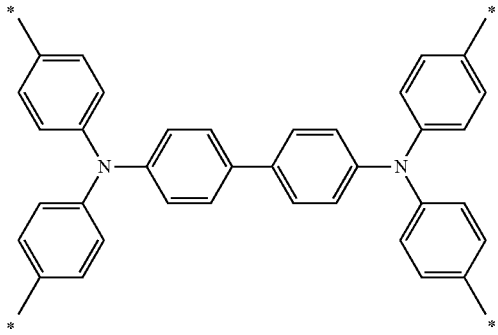
(4)-11
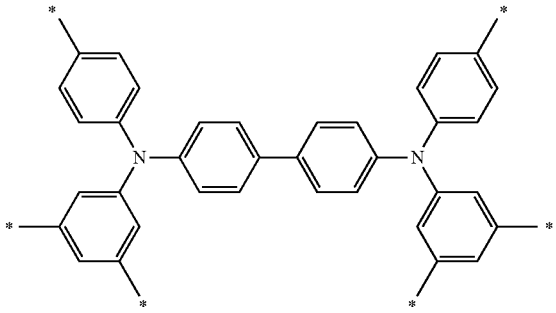
-continued
(4)-12
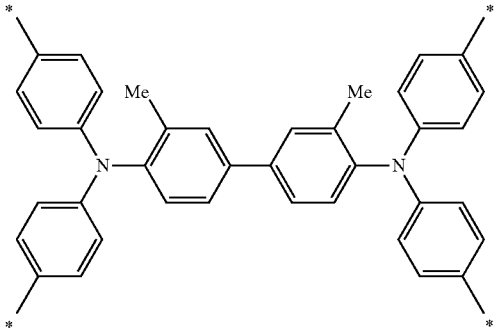
(4)-13
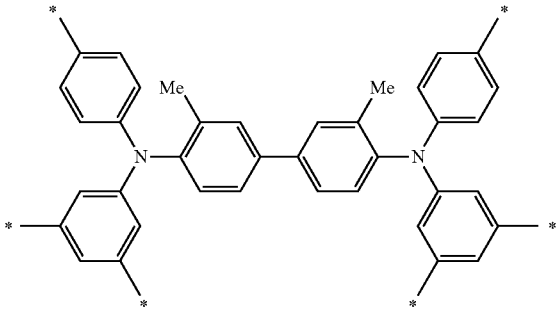
(4)-14
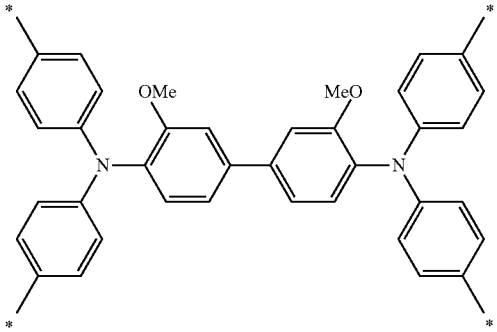
(4)-15
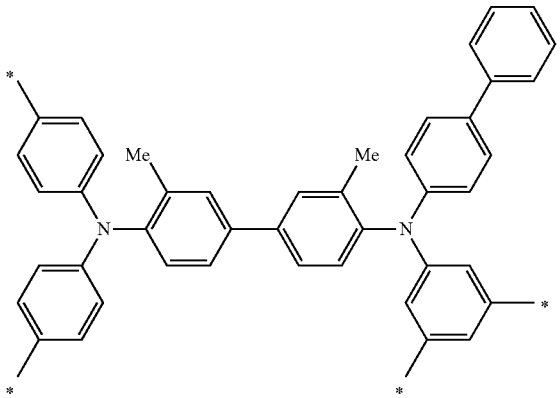

-continued
(4)-16
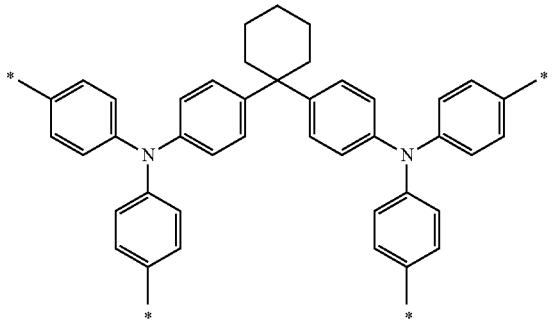
(4)-17
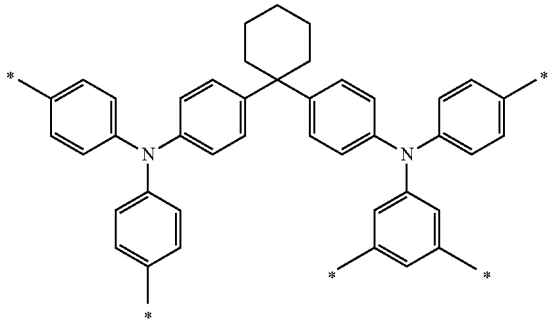
(4)-18
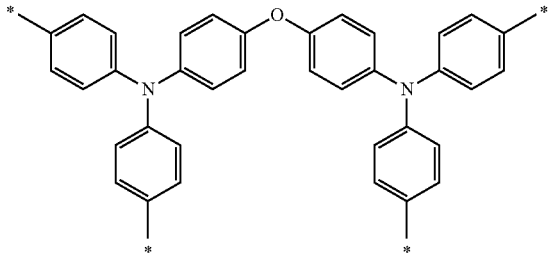
(4)-19
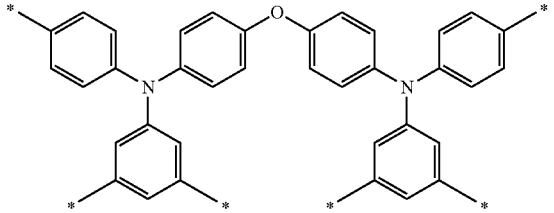
-continued
(4)-20
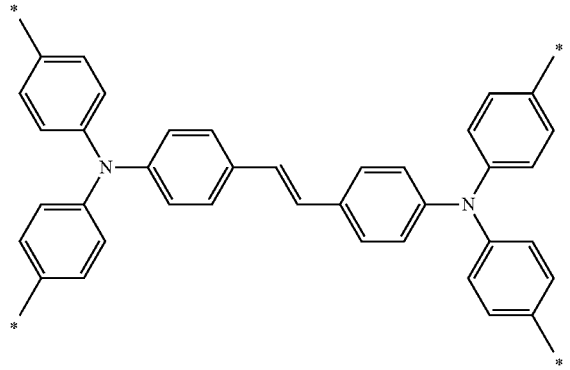
(4)-21
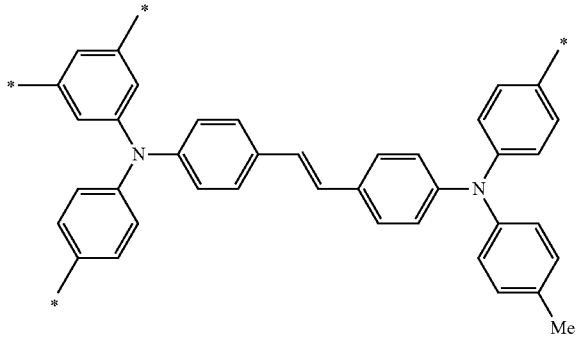
(4)-22
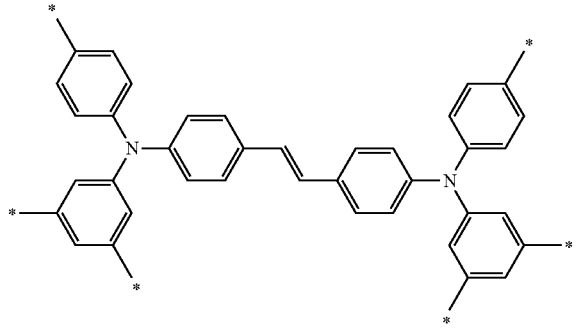
(4)-23
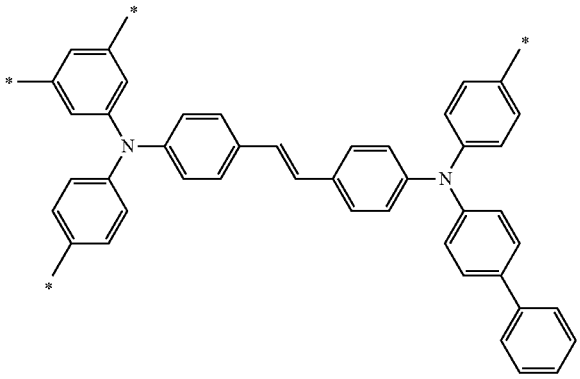

-continued
(4)-24
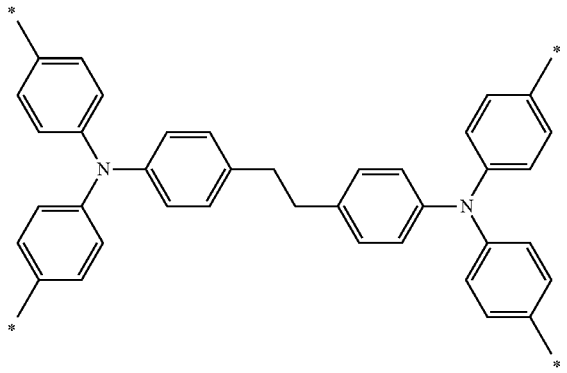
(4)-25
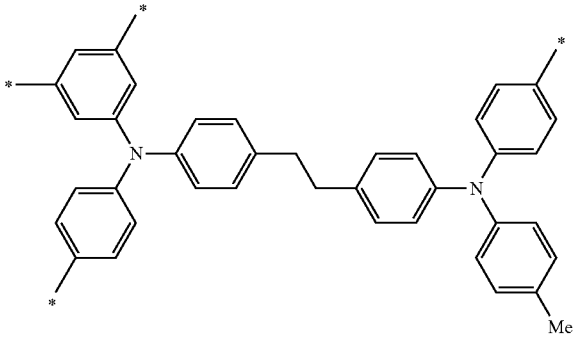
(4)-26
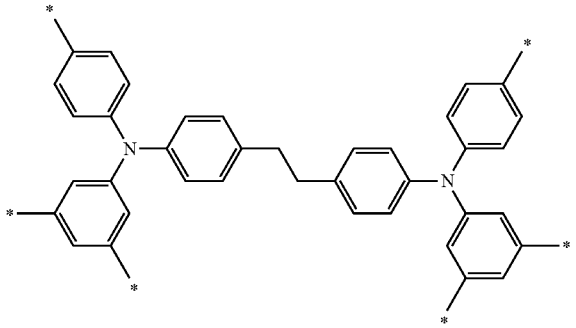
(4)-27
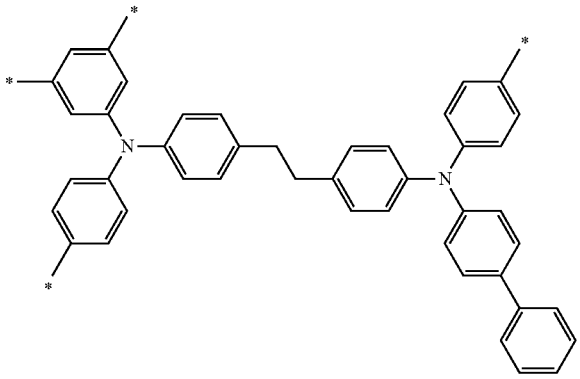
-continued
(4)-28
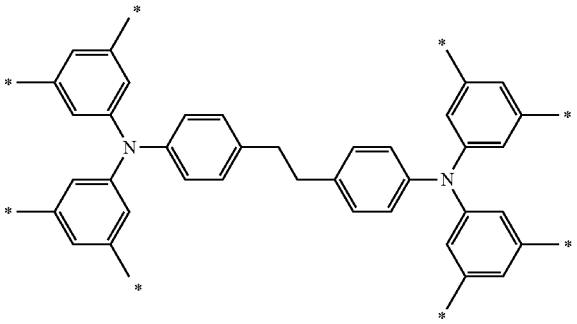
(IV)-1
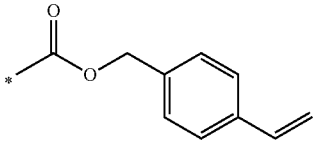
(IV)-2
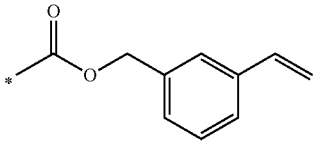
(IV)-3
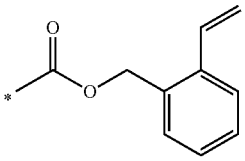
(IV)-4
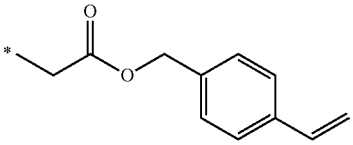
(IV)-5
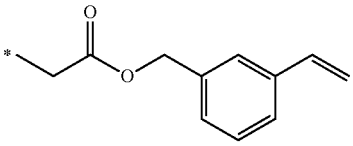
(IV)-6
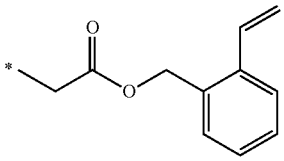
(IV)-7
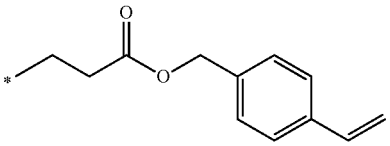

-continued
(IV)-8
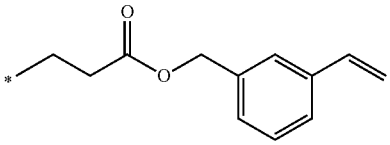
(IV)-9
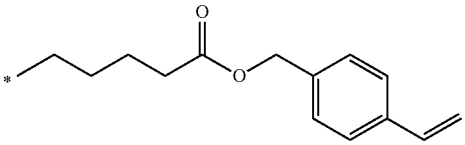
(IV)-10
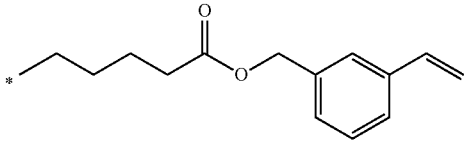
(IV)-11
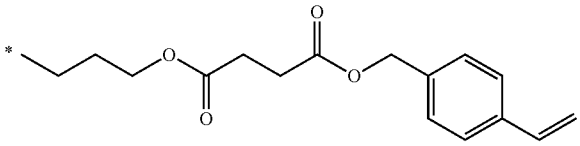
(IV)-12
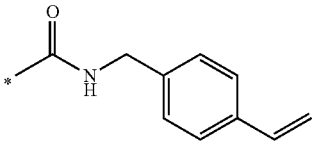
(IV)-13
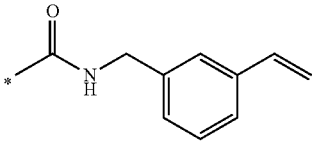
(IV)-14
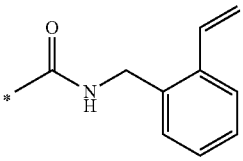
(IV)-15
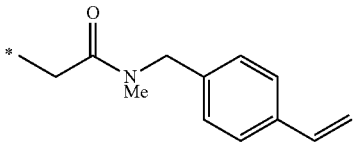
(IV)-16
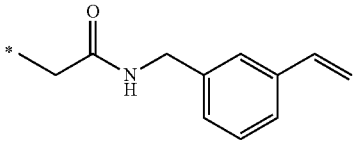
(IV)-17
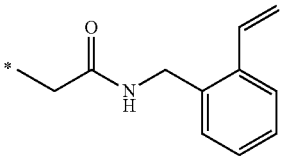
-continued
(IV)-18
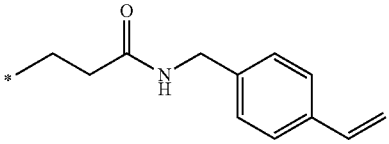
(IV)-19
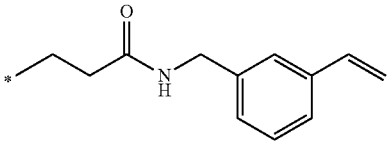
(IV)-20
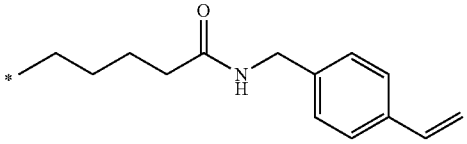
(IV)-21
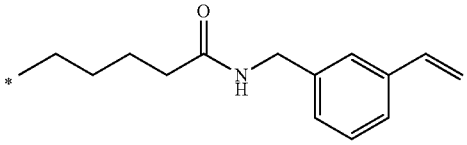
(IV)-22
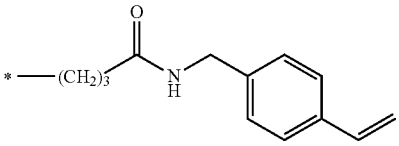
(IV)-23
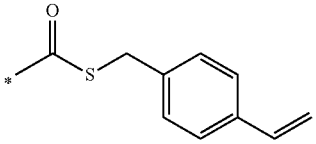
(IV)-24
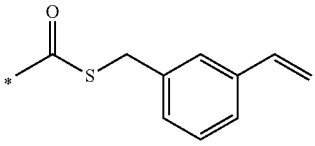
(IV)-25
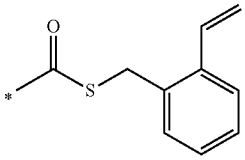
(IV)-26
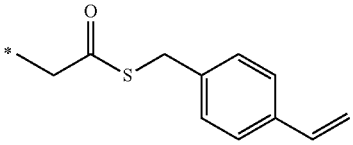
(IV)-27
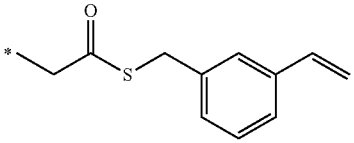

-continued
(IV)-28
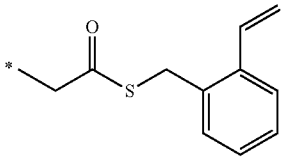
(IV)-29
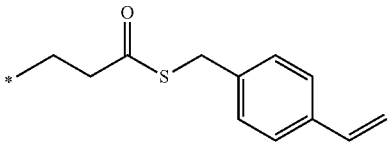
(IV)-30
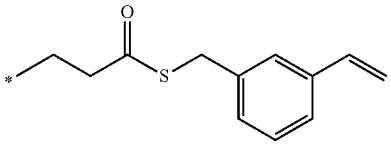
(IV)-31
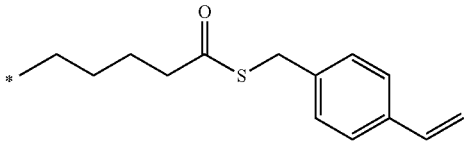
(IV)-32
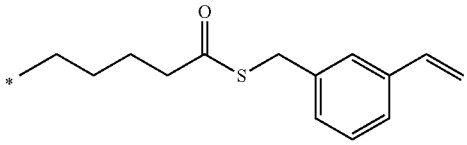
(IV)-33
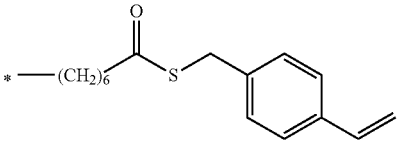
(IV)-34
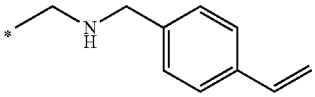
(IV)-35
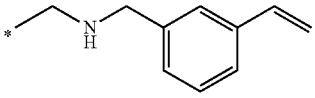
(IV)-36
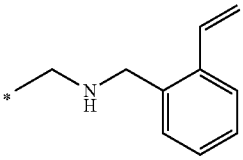
(IV)-37
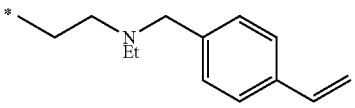
(IV)-38
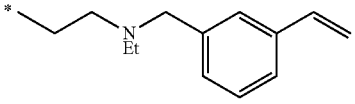
-continued
(IV)-39
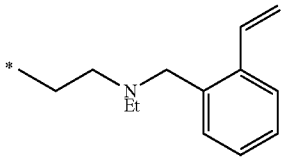
(IV)-40
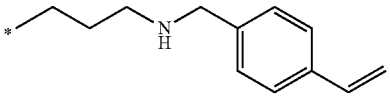
(IV)-41
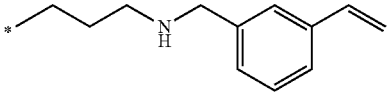
(IV)-42
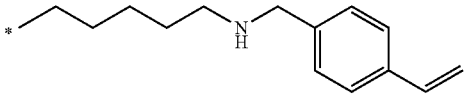
(IV)-43
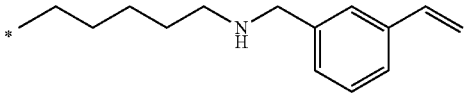
(IV)-44
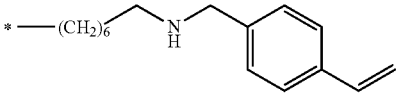
(IV)-45
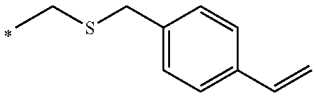
(IV)-46
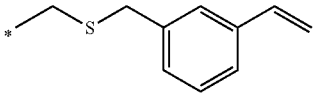
(IV)-47
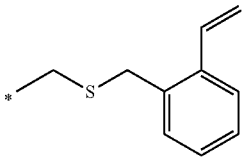
(IV)-48
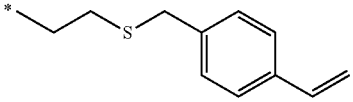
(IV)-49
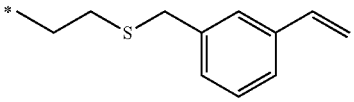
(IV)-50
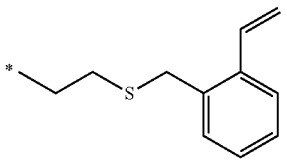
(IV)-51
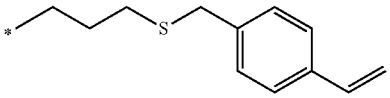

-continued
(IV)-52
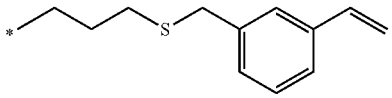
(IV)-53
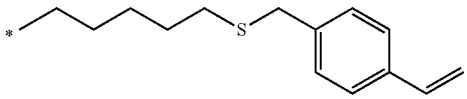
(IV)-54
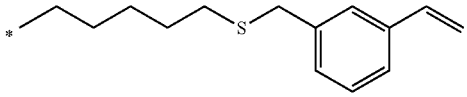
(IV)-55
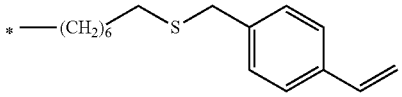
(IV)-56
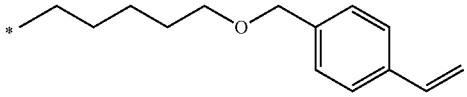
(IV)-57
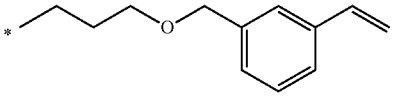
(IV)-58
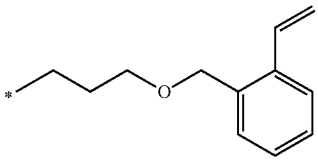
(IV)-59
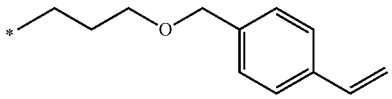
(IV)-60
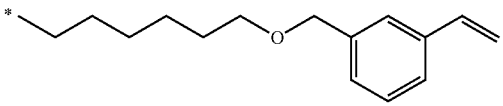
(IV)-61
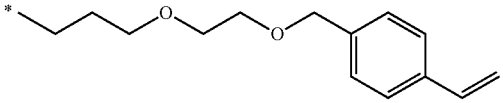
(IV)-62
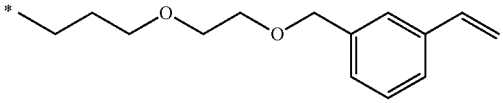
(IV)-63
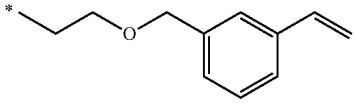
-continued
(IV)-64
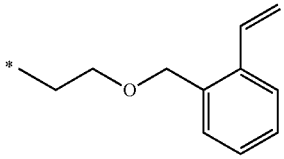
(IV)-65
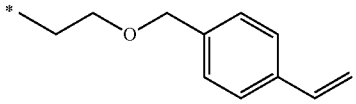
Specific examples of the group represented by Formula (V) will be shown below.
(V)-1
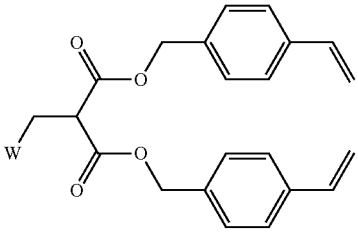
(V)-2
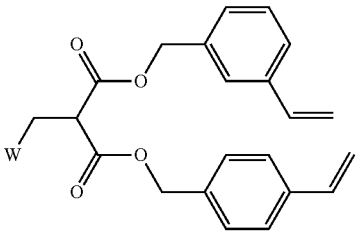
(V)-3
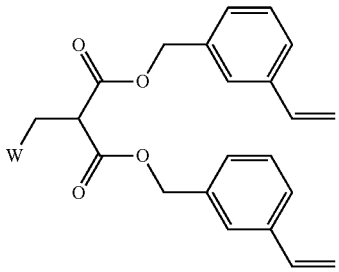
(V)-4
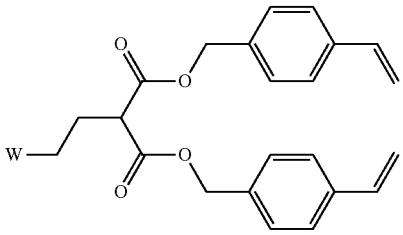

-continued
(V-5)
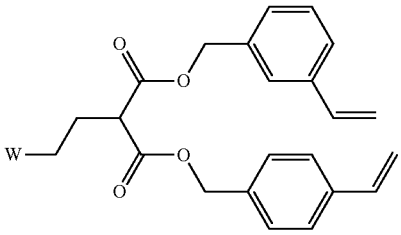
(V-6)
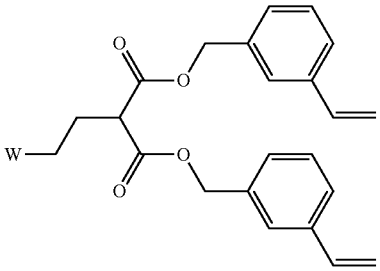
(V-7)
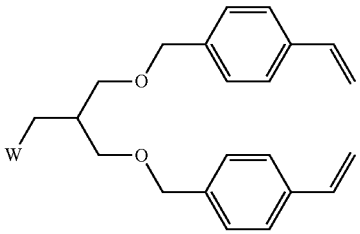
(V-8)
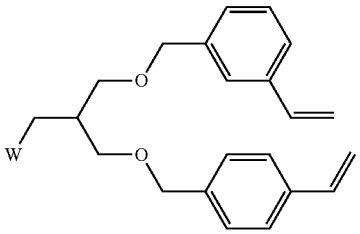
(V-9)
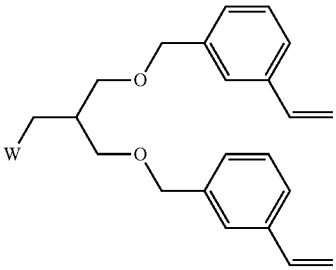
(V-10)
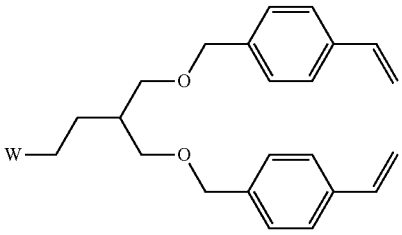
-continued
(V)-11
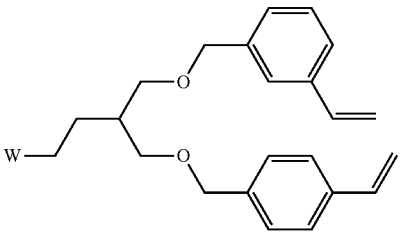
(V)-12
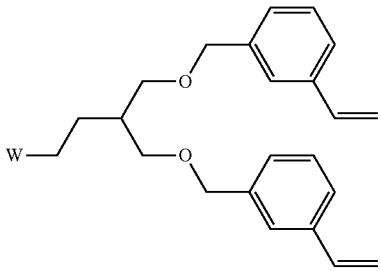
(V)-13
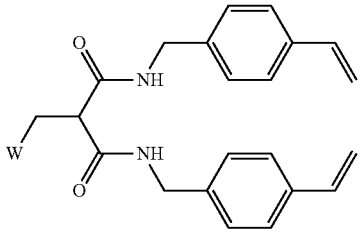
(V)-14
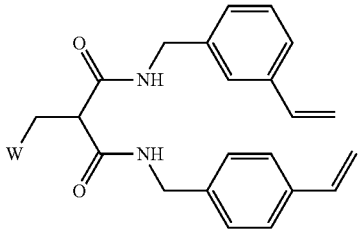
(V)-15
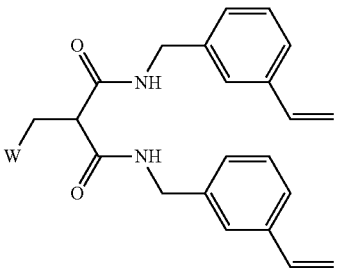
(V)-16
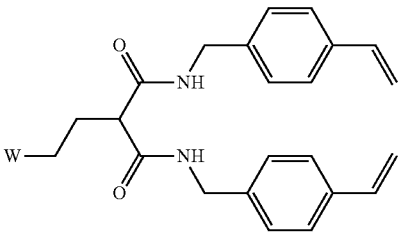

-continued
(V)-17
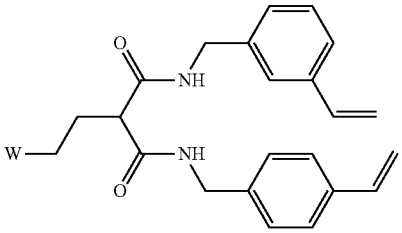
(V)-18
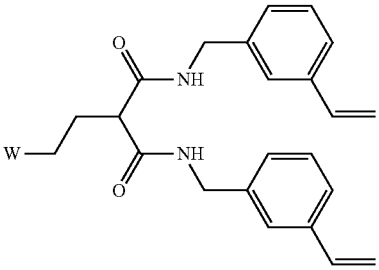
(V)-19
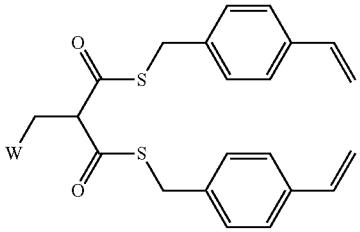
(V)-20
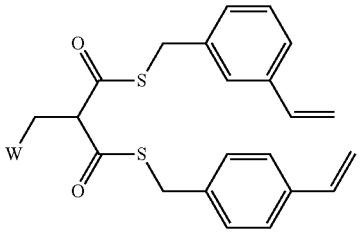
(V)-21
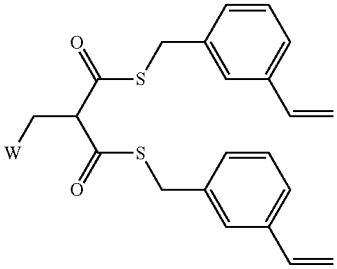
(V)-22
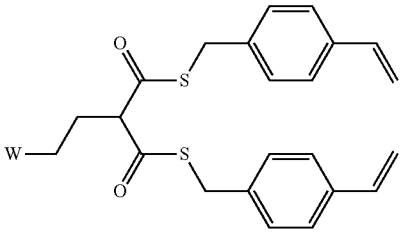
-continued
(V)-23
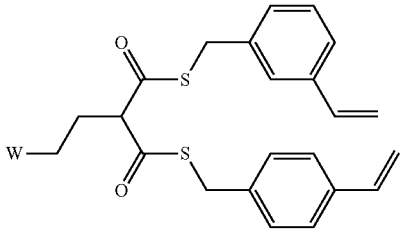
(V)-24
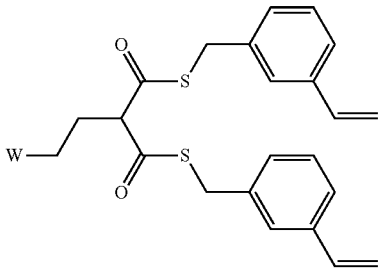
(V)-25
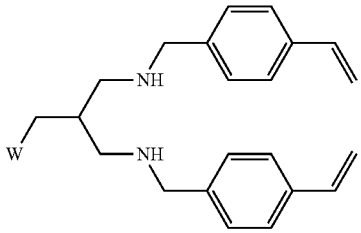
(V)-26
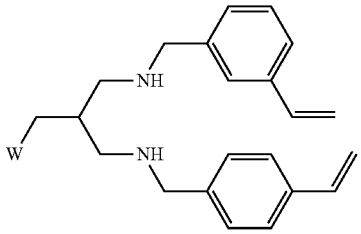
(V)-27
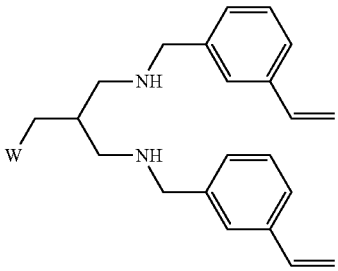
(V)-28
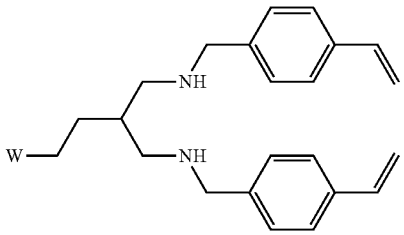

-continued
(V)-29
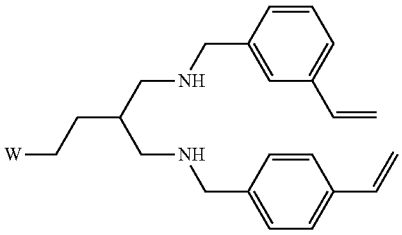
(V)-30
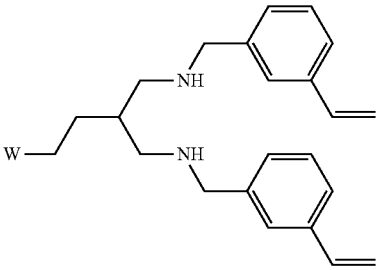
(V)-31
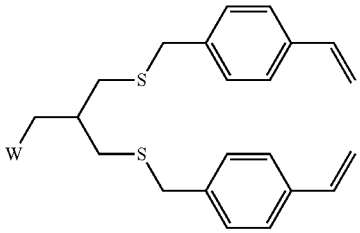
(V)-32
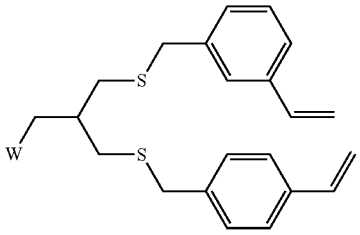
(V)-33
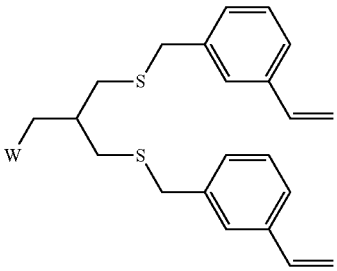
(V)-34
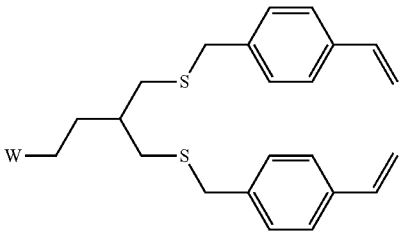
-continued
(V)-35
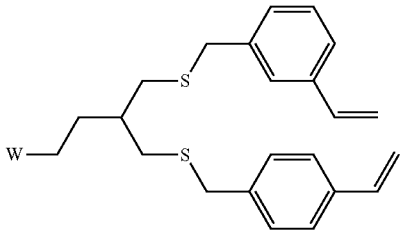
(V)-36
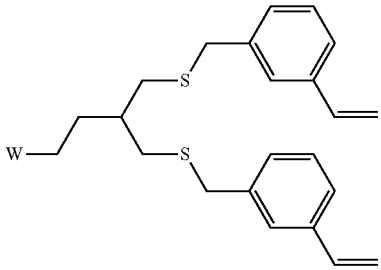
(V)-37
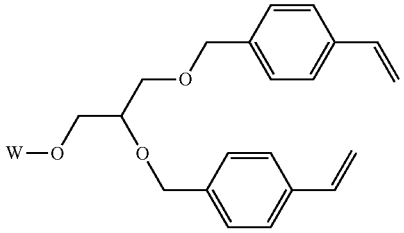
(V)-38
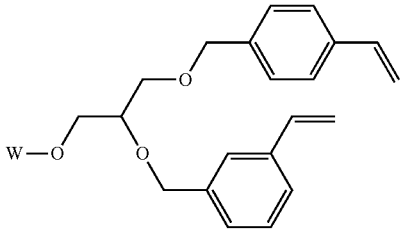
(V)-39
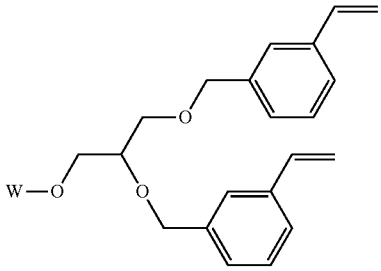
(V)-40
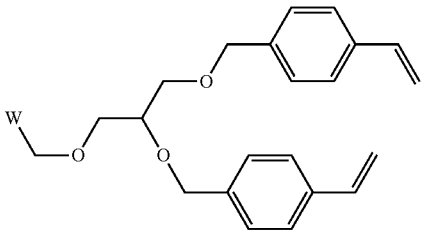

-continued (V)-41

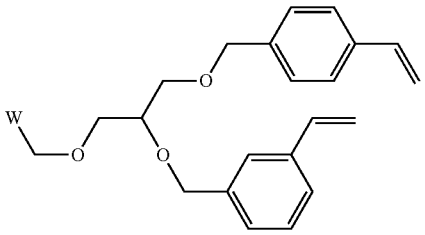

(V)-42

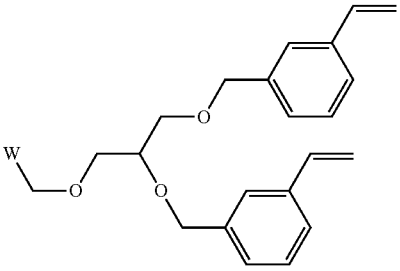

(V)-43

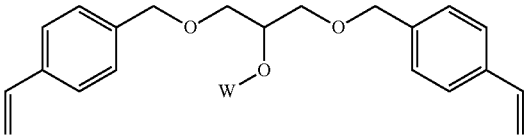

(V)-44

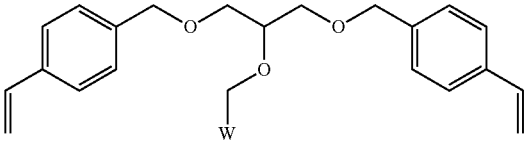

(V)-45

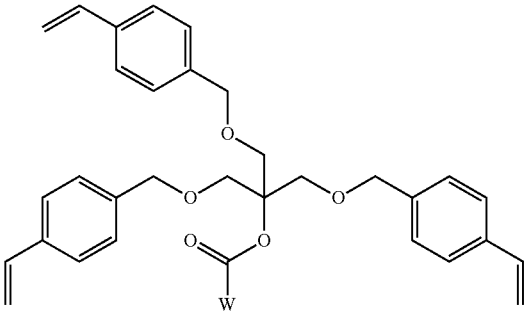

(V)-46

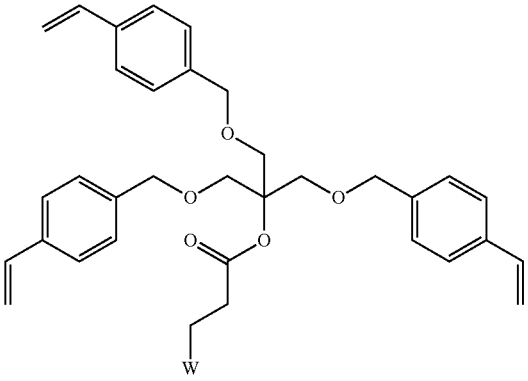

-continued (V)-47

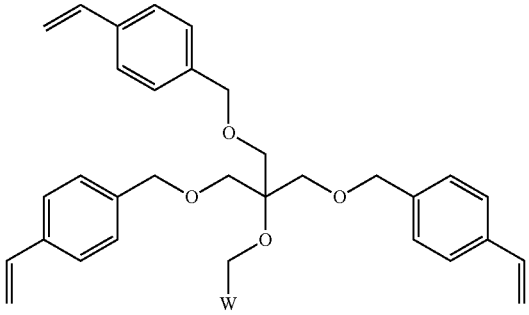

(V)-48

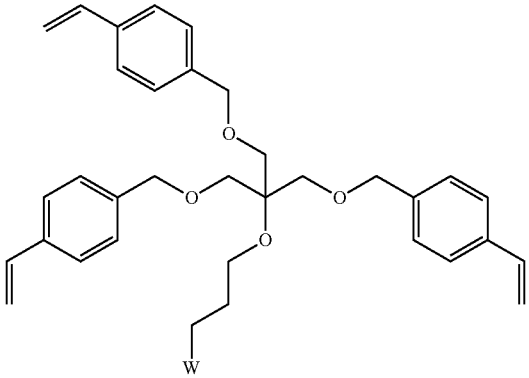

Specific examples of the reactive compounds represented by Formulae (I) and (II) will be shown below.

| Example compounds | Specific examples of charge transporting skeleton F | Specific examples of groups represented by (D) c1 to (D) c9 |
|---|---|---|
| (I)-1 | (1)-1 | (IV)-1 |
| (I)-2 | (1)-1 | (IV)-2 |
| (I)-3 | (1)-1 | (IV)-4 |
| (I)-4 | (1)-2 | (IV)-5 |
| (I)-5 | (1)-2 | (IV)-7 |
| (I)-6 | (1)-4 | (IV)-3 |
| (I)-7 | (1)-4 | (IV)-7 |
| (I)-8 | (1)-7 | (IV)-6 |
| (I)-9 | (1)-11 | (IV)-4 |
| (I)-10 | (1)-15 | (IV)-5 |
| (I)-11 | (1)-25 | (IV)-1 |
| (I)-12 | (1)-22 | (IV)-1 |
| (I)-13 | (1)-2 | (IV)-1 |
| (I)-14 | (2)-2 | (IV)-3 |
| (I)-15 | (2)-2 | (IV)-7 |
| (I)-16 | (2)-3 | (IV)-4 |
| (I)-17 | (2)-3 | (IV)-7 |
| (I)-18 | (2)-5 | (IV)-6 |
| (I)-19 | (2)-10 | (IV)-4 |
| (I)-20 | (2)-10 | (IV)-5 |
| (I)-21 | (2)-13 | (IV)-1 |
| (I)-22 | (2)-13 | (IV)-3 |
| (I)-23 | (2)-13 | (IV)-7 |
| (I)-24 | (2)-16 | (IV)-5 |
| (I)-25 | (2)-23 | (IV)-7 |
| (I)-26 | (2)-23 | (IV)-4 |
| (I)-27 | (2)-25 | (IV)-7 |
| (I)-28 | (2)-25 | (IV)-4 |
| (I)-29 | (2)-26 | (IV)-5 |
| (I)-30 | (2)-26 | (IV)-7 |
| (I)-31 | (3)-1 | (IV)-2 |
| (I)-32 | (3)-1 | (IV)-7 |
| (I)-33 | (3)-5 | (IV)-2 |

-continued

| Example compounds | Specific examples of charge transporting skeleton F | Specific examples of groups represented by (D) c1 to (D) c9 |
|---|---|---|
| (I)-34 | (3)-7 | (IV)-4 |
| (I)-35 | (3)-7 | (IV)-2 |
| (I)-36 | (3)-19 | (IV)-4 |
| (I)-37 | (3)-26 | (IV)-1 |
| (I)-38 | (3)-26 | (IV)-3 |
| (I)-39 | (4)-3 | (IV)-3 |
| (I)-40 | (4)-3 | (IV)-4 |
| (I)-41 | (4)-8 | (IV)-5 |
| (I)-42 | (4)-8 | (IV)-6 |
| (I)-43 | (4)-12 | (IV)-7 |
| (I)-44 | (4)-12 | (IV)-4 |
| (I)-45 | (4)-12 | (IV)-2 |
| (I)-46 | (4)-12 | (IV)-11 |
| (I)-47 | (4)-16 | (IV)-3 |
| (I)-48 | (4)-16 | (IV)-4 |
| (I)-49 | (4)-20 | (IV)-1 |
| (I)-50 | (4)-20 | (IV)-4 |
| (I)-51 | (4)-20 | (IV)-7 |
| (I)-52 | (4)-24 | (IV)-4 |
| (I)-53 | (4)-24 | (IV)-7 |
| (I)-54 | (4)-24 | (IV)-3 |
| (I)-55 | (4)-24 | (IV)-4 |
| (I)-56 | (4)-25 | (IV)-1 |
| (I)-57 | (4)-26 | (IV)-3 |
| (I)-58 | (4)-28 | (IV)-4 |
| (I)-59 | (4)-28 | (IV)-5 |
| (I)-60 | (4)-28 | (IV)-6 |
| (I)-61 | (1)-1 | (IV)-15 |
| (I)-62 | (1)-1 | (IV)-27 |
| (I)-63 | (1)-1 | (IV)-37 |
| (I)-64 | (1)-2 | (IV)-52 |
| (I)-65 | (1)-2 | (IV)-18 |
| (I)-66 | (1)-4 | (IV)-31 |
| (I)-67 | (1)-4 | (IV)-44 |
| (I)-68 | (1)-7 | (IV)-45 |
| (I)-69 | (1)-11 | (IV)-45 |
| (I)-70 | (1)-15 | (IV)-45 |
| (I)-71 | (1)-25 | (IV)-15 |
| (I)-72 | (1)-22 | (IV)-15 |
| (I)-73 | (2)-2 | (IV)-15 |
| (I)-74 | (2)-2 | (IV)-27 |
| (I)-75 | (2)-2 | (IV)-37 |
| (I)-76 | (2)-3 | (IV)-52 |
| (I)-77 | (2)-3 | (IV)-18 |
| (I)-78 | (2)-5 | (IV)-31 |
| (I)-79 | (2)-10 | (IV)-44 |
| (I)-80 | (2)-10 | (IV)-45 |
| (I)-81 | (2)-13 | (IV)-45 |
| (I)-82 | (2)-13 | (IV)-45 |
| (I)-83 | (2)-13 | (IV)-15 |
| (I)-84 | (2)-16 | (IV)-15 |
| (I)-85 | (2)-23 | (IV)-27 |
| (I)-86 | (2)-23 | (IV)-37 |
| (I)-87 | (2)-25 | (IV)-52 |
| (I)-88 | (2)-25 | (IV)-18 |
| (I)-89 | (2)-26 | (IV)-31 |
| (I)-90 | (2)-26 | (IV)-44 |
| (I)-91 | (3)-1 | (IV)-15 |
| (I)-92 | (3)-1 | (IV)-27 |
| (I)-93 | (3)-5 | (IV)-37 |
| (I)-94 | (3)-7 | (IV)-52 |
| (I)-95 | (3)-7 | (IV)-18 |
| (I)-96 | (3)-19 | (IV)-31 |
| (I)-97 | (3)-26 | (IV)-44 |
| (I)-98 | (3)-26 | (IV)-45 |
| (I)-99 | (4)-3 | (IV)-45 |
| (I)-100 | (4)-3 | (IV)-45 |
| (I)-101 | (4)-8 | (IV)-15 |
| (I)-102 | (4)-8 | (IV)-15 |
| (I)-103 | (4)-12 | (IV)-15 |
| (I)-104 | (4)-12 | (IV)-27 |
| (I)-105 | (4)-12 | (IV)-37 |
| (I)-106 | (4)-12 | (IV)-52 |
| (I)-107 | (4)-16 | (IV)-18 |

-continued

| Example compounds | Specific examples of charge transporting skeleton F | Specific examples of groups represented by (D) c1 to (D) c9 |
|---|---|---|
| (I)-108 | (4)-16 | (IV)-31 |
| (I)-109 | (4)-20 | (IV)-44 |
| (I)-110 | (4)-20 | (IV)-45 |
| (I)-111 | (4)-20 | (IV)-45 |
| (I)-112 | (4)-24 | (IV)-45 |
| (I)-113 | (4)-24 | (IV)-15 |
| (I)-114 | (4)-24 | (IV)-15 |
| (I)-115 | (4)-24 | (IV)-27 |
| (I)-116 | (4)-25 | (IV)-37 |
| (I)-117 | (4)-26 | (IV)-52 |
| (I)-118 | (4)-28 | (IV)-18 |
| (I)-119 | (4)-28 | (IV)-31 |
| (I)-120 | (4)-28 | (IV)-44 |
| (I)-121 | (1)-1 | (IV)-56 |
| (I)-122 | (1)-1 | (IV)-57 |
| (I)-123 | (1)-1 | (IV)-59 |
| (I)-124 | (1)-2 | (IV)-60 |
| (I)-125 | (1)-2 | (IV)-62 |
| (I)-126 | (1)-4 | (IV)-58 |
| (I)-127 | (1)-4 | (IV)-60 |
| (I)-128 | (1)-5 | (IV)-61 |
| (I)-129 | (1)-8 | (IV)-59 |
| (I)-130 | (1)-16 | (IV)-60 |
| (I)-131 | (1)-20 | (IV)-56 |
| (I)-132 | (1)-22 | (IV)-56 |
| (I)-133 | (2)-2 | (IV)-56 |
| (I)-134 | (2)-2 | (IV)-58 |
| (I)-135 | (2)-2 | (IV)-59 |
| (I)-136 | (2)-6 | (IV)-59 |
| (I)-137 | (2)-6 | (IV)-60 |
| (I)-138 | (2)-6 | (IV)-61 |
| (I)-139 | (2)-10 | (IV)-59 |
| (I)-140 | (2)-10 | (IV)-60 |
| (I)-141 | (2)-13 | (IV)-56 |
| (I)-142 | (2)-13 | (IV)-58 |
| (I)-143 | (2)-13 | (IV)-59 |
| (I)-144 | (2)-13 | (IV)-60 |
| (I)-145 | (2)-13 | (IV)-61 |
| (I)-146 | (2)-16 | (IV)-59 |
| (I)-147 | (2)-21 | (IV)-60 |
| (I)-148 | (2)-25 | (IV)-59 |
| (I)-149 | (2)-25 | (IV)-60 |
| (I)-150 | (2)-25 | (IV)-62 |
| (I)-151 | (3)-1 | (IV)-57 |
| (I)-152 | (3)-1 | (IV)-62 |
| (I)-153 | (3)-2 | (IV)-57 |
| (I)-154 | (3)-2 | (IV)-59 |
| (I)-155 | (3)-3 | (IV)-57 |
| (I)-156 | (3)-3 | (IV)-59 |
| (I)-157 | (3)-12 | (IV)-56 |
| (I)-158 | (3)-21 | (IV)-58 |
| (I)-159 | (3)-25 | (IV)-58 |
| (I)-160 | (3)-25 | (IV)-59 |
| (I)-161 | (3)-25 | (IV)-60 |
| (I)-162 | (3)-25 | (IV)-61 |
| (I)-163 | (4)-1 | (IV)-62 |
| (I)-164 | (4)-3 | (IV)-59 |
| (I)-165 | (4)-3 | (IV)-57 |
| (I)-166 | (4)-8 | (IV)-56 |
| (I)-167 | (4)-8 | (IV)-58 |
| (I)-168 | (4)-8 | (IV)-59 |
| (I)-169 | (4)-10 | (IV)-56 |
| (I)-170 | (4)-10 | (IV)-59 |
| (I)-171 | (4)-10 | (IV)-62 |
| (I)-172 | (4)-12 | (IV)-59 |
| (I)-173 | (4)-12 | (IV)-56 |
| (I)-174 | (4)-12 | (IV)-58 |
| (I)-175 | (4)-22 | (IV)-59 |
| (I)-176 | (4)-24 | (IV)-56 |
| (I)-177 | (4)-24 | (IV)-58 |
| (I)-178 | (4)-24 | (IV)-59 |
| (I)-179 | (4)-24 | (IV)-61 |
| (I)-180 | (4)-28 | (IV)-61 |
| (I)-181 | (1)-1 | (V)-1 |

-continued

| Example compounds | Specific examples of charge transporting skeleton F | Specific examples of groups represented by (D) c1 to (D) c9 |
|---|---|---|
| (I)-182 | (1)-1 | (V)-2 |
| (I)-183 | (1)-1 | (V)-7 |
| (I)-184 | (1)-2 | (V)-1 |
| (I)-185 | (1)-2 | (V)-2 |
| (I)-186 | (1)-2 | (V)-3 |
| (I)-187 | (1)-2 | (V)-5 |
| (I)-188 | (1)-2 | (V)-7 |
| (I)-189 | (1)-2 | (V)-8 |
| (I)-190 | (1)-2 | (V)-10 |
| (I)-191 | (1)-2 | (V)-11 |
| (I)-192 | (1)-4 | (V)-1 |
| (I)-193 | (1)-4 | (V)-2 |
| (I)-194 | (1)-4 | (V)-3 |
| (I)-195 | (1)-4 | (V)-5 |
| (I)-196 | (1)-4 | (V)-7 |
| (I)-197 | (1)-4 | (V)-8 |
| (I)-198 | (1)-8 | (V)-1 |
| (I)-199 | (1)-8 | (V)-2 |
| (I)-200 | (1)-8 | (V)-3 |
| (I)-201 | (1)-8 | (V)-5 |
| (I)-202 | (1)-8 | (V)-7 |
| (I)-203 | (1)-8 | (V)-8 |
| (I)-204 | (1)-11 | (V)-1 |
| (I)-205 | (1)-11 | (V)-3 |
| (I)-206 | (1)-11 | (V)-7 |
| (I)-207 | (1)-11 | (V)-9 |
| (I)-208 | (1)-16 | (V)-4 |
| (I)-209 | (1)-22 | (V)-6 |
| (I)-210 | (1)-22 | (V)-9 |
| (I)-211 | (2)-2 | (V)-1 |
| (I)-212 | (2)-2 | (V)-3 |
| (I)-213 | (2)-2 | (V)-7 |
| (I)-214 | (2)-2 | (V)-9 |
| (I)-215 | (2)-3 | (V)-1 |
| (I)-216 | (2)-3 | (V)-2 |
| (I)-217 | (2)-3 | (V)-3 |
| (I)-218 | (2)-3 | (V)-7 |
| (I)-219 | (2)-3 | (V)-8 |
| (I)-220 | (2)-5 | (V)-8 |
| (I)-221 | (2)-5 | (V)-10 |
| (I)-222 | (2)-10 | (V)-1 |
| (I)-223 | (2)-10 | (V)-3 |
| (I)-224 | (2)-10 | (V)-7 |
| (I)-225 | (2)-10 | (V)-9 |
| (I)-226 | (2)-13 | (V)-1 |
| (I)-227 | (2)-13 | (V)-2 |
| (I)-228 | (2)-13 | (V)-3 |
| (I)-229 | (2)-13 | (V)-5 |
| (I)-230 | (2)-13 | (V)-7 |
| (I)-231 | (2)-13 | (V)-8 |
| (I)-232 | (2)-16 | (V)-1 |
| (I)-233 | (2)-16 | (V)-7 |
| (I)-234 | (2)-21 | (V)-1 |
| (I)-235 | (2)-21 | (V)-7 |
| (I)-236 | (2)-25 | (V)-1 |
| (I)-237 | (2)-25 | (V)-3 |
| (I)-238 | (2)-25 | (V)-7 |
| (I)-239 | (2)-25 | (V)-8 |
| (I)-240 | (2)-25 | (V)-9 |
| (I)-241 | (3)-1 | (V)-1 |
| (I)-242 | (3)-1 | (V)-2 |
| (I)-243 | (3)-1 | (V)-7 |
| (I)-244 | (3)-1 | (V)-8 |
| (I)-245 | (3)-3 | (V)-1 |
| (I)-246 | (3)-3 | (V)-7 |
| (I)-247 | (3)-7 | (V)-1 |
| (I)-248 | (3)-7 | (V)-2 |
| (I)-249 | (3)-7 | (V)-7 |
| (I)-250 | (3)-7 | (V)-8 |
| (I)-251 | (3)-18 | (V)-5 |
| (I)-252 | (3)-18 | (V)-12 |
| (I)-253 | (3)-25 | (V)-7 |
| (I)-254 | (3)-25 | (V)-8 |
| (I)-255 | (3)-25 | (V)-5 |

-continued

| Example compounds | Specific examples of charge transporting skeleton F | Specific examples of groups represented by (D) c1 to (D) c9 |
|---|---|---|
| (I)-256 | (3)-25 | (V)-12 |
| (I)-257 | (4)-2 | (V)-1 |
| (I)-258 | (4)-2 | (V)-7 |
| (I)-259 | (4)-4 | (V)-7 |
| (I)-260 | (4)-4 | (V)-8 |
| (I)-261 | (4)-4 | (V)-5 |
| (I)-262 | (4)-4 | (V)-12 |
| (I)-263 | (4)-7 | (V)-1 |
| (I)-264 | (4)-7 | (V)-2 |
| (I)-265 | (4)-7 | (V)-7 |
| (I)-266 | (4)-7 | (V)-8 |
| (I)-267 | (4)-9 | (V)-7 |
| (I)-268 | (4)-9 | (V)-8 |
| (I)-269 | (4)-9 | (V)-5 |
| (I)-270 | (4)-9 | (V)-12 |
| (I)-271 | (1)-1 | (V)-13 |
| (I)-272 | (1)-1 | (V)-15 |
| (I)-273 | (1)-1 | (V)-47 |
| (I)-274 | (1)-2 | (V)-13 |
| (I)-275 | (1)-2 | (V)-15 |
| (I)-276 | (1)-2 | (V)-19 |
| (I)-277 | (1)-2 | (V)-21 |
| (I)-278 | (1)-2 | (V)-28 |
| (I)-279 | (1)-2 | (V)-31 |
| (I)-280 | (1)-2 | (V)-33 |
| (I)-281 | (1)-2 | (V)-37 |
| (I)-282 | (1)-2 | (V)-38 |
| (I)-283 | (1)-2 | (V)-43 |
| (I)-284 | (1)-4 | (V)-13 |
| (I)-285 | (1)-4 | (V)-15 |
| (I)-286 | (1)-4 | (V)-43 |
| (I)-287 | (1)-4 | (V)-48 |
| (I)-288 | (1)-8 | (V)-13 |
| (I)-289 | (1)-8 | (V)-15 |
| (I)-290 | (1)-8 | (V)-19 |
| (I)-291 | (1)-8 | (V)-28 |
| (I)-292 | (1)-8 | (V)-31 |
| (I)-293 | (1)-8 | (V)-33 |
| (I)-294 | (1)-11 | (V)-33 |
| (I)-295 | (1)-11 | (V)-33 |
| (I)-296 | (1)-11 | (V)-33 |
| (I)-297 | (1)-11 | (V)-33 |
| (I)-298 | (1)-16 | (V)-13 |
| (I)-299 | (1)-22 | (V)-15 |
| (I)-300 | (1)-22 | (V)-47 |
| (I)-301 | (2)-2 | (V)-13 |
| (I)-302 | (2)-2 | (V)-15 |
| (I)-303 | (2)-2 | (V)-14 |
| (I)-304 | (2)-2 | (V)-17 |
| (I)-305 | (2)-3 | (V)-15 |
| (I)-306 | (2)-3 | (V)-19 |
| (I)-307 | (2)-3 | (V)-21 |
| (I)-308 | (2)-3 | (V)-28 |
| (I)-309 | (2)-3 | (V)-31 |
| (I)-310 | (2)-5 | (V)-33 |
| (I)-311 | (2)-5 | (V)-37 |
| (I)-312 | (2)-10 | (V)-38 |
| (I)-313 | (2)-10 | (V)-43 |
| (I)-314 | (2)-10 | (V)-13 |
| (I)-315 | (2)-10 | (V)-15 |
| (I)-316 | (2)-13 | (V)-16 |
| (I)-317 | (2)-13 | (V)-48 |
| (I)-318 | (2)-13 | (V)-13 |
| (I)-319 | (2)-13 | (V)-26 |
| (I)-320 | (2)-13 | (V)-19 |
| (I)-321 | (2)-13 | (V)-28 |
| (I)-322 | (2)-16 | (V)-31 |
| (I)-323 | (2)-16 | (V)-33 |
| (I)-324 | (2)-21 | (V)-33 |
| (I)-325 | (2)-21 | (V)-34 |
| (I)-326 | (2)-25 | (V)-35 |
| (I)-327 | (2)-25 | (V)-36 |
| (I)-328 | (2)-25 | (V)-37 |
| (I)-329 | (2)-25 | (V)-15 |

-continued

| Example compounds | Specific examples of charge transporting skeleton F | Specific examples of groups represented by (D) c1 to (D) c9 |
|---|---|---|
| (I)-330 | (2)-25 | (V)-47 |
| (I)-331 | (3)-1 | (V)-13 |
| (I)-332 | (3)-1 | (V)-15 |
| (I)-333 | (3)-1 | (V)-14 |
| (I)-334 | (3)-1 | (V)-17 |
| (I)-335 | (3)-3 | (V)-15 |
| (I)-336 | (3)-3 | (V)-19 |
| (I)-337 | (3)-7 | (V)-21 |
| (I)-338 | (3)-7 | (V)-28 |
| (I)-339 | (3)-7 | (V)-31 |
| (I)-340 | (3)-7 | (V)-33 |
| (I)-341 | (3)-18 | (V)-37 |
| (I)-342 | (3)-18 | (V)-38 |
| (I)-343 | (3)-25 | (V)-43 |
| (I)-344 | (3)-25 | (V)-13 |
| (I)-345 | (3)-25 | (V)-15 |
| (I)-346 | (3)-25 | (V)-16 |
| (I)-347 | (4)-2 | (V)-48 |
| (I)-348 | (4)-2 | (V)-13 |
| (I)-349 | (4)-4 | (V)-26 |
| (I)-350 | (4)-4 | (V)-19 |
| (I)-351 | (4)-4 | (V)-28 |
| (I)-352 | (4)-4 | (V)-31 |

-continued

| Example compounds | Specific examples of charge transporting skeleton F | Specific examples of groups represented by (D) c1 to (D) c9 |
|---|---|---|
| (I)-353 | (4)-7 | (V)-32 |
| (I)-354 | (4)-7 | (V)-33 |
| (I)-355 | (4)-7 | (V)-34 |
| (I)-356 | (4)-7 | (V)-35 |
| (I)-357 | (4)-9 | (V)-36 |
| (I)-358 | (4)-9 | (V)-37 |
| (I)-359 | (4)-9 | (V)-15 |
| (I)-360 | (4)-9 | (V)-47 |
| (I)-361 | (2)-25 | (V)-62 |
| (I)-362 | (2)-25 | (V)-63 |
| (I)-363 | (2)-25 | (V)-65 |

The specific reactive group-containing compound is synthesized in the following manner, for example.

That is, the specific reactive group-containing compound is synthesized by etherification of carboxylic acid as a precursor or alcohol with corresponding chloromethyl styrene or the like.

A synthesis pathway of an example compound (I)-178 of the specific reactive group-containing compound will be shown below as an example.

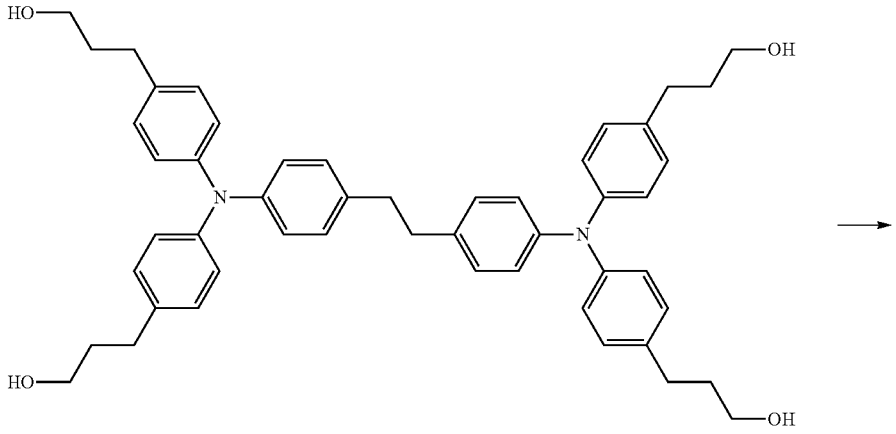

(2)

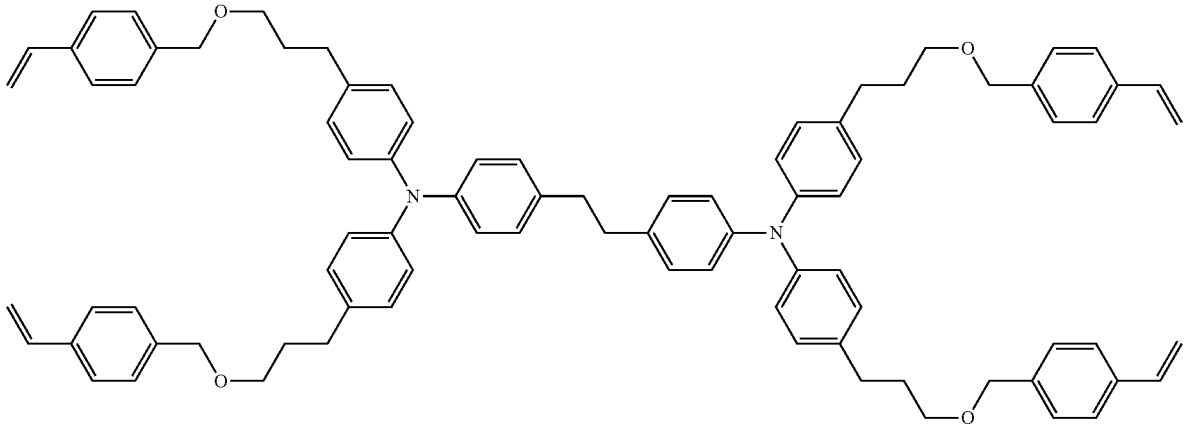

Figure 11:
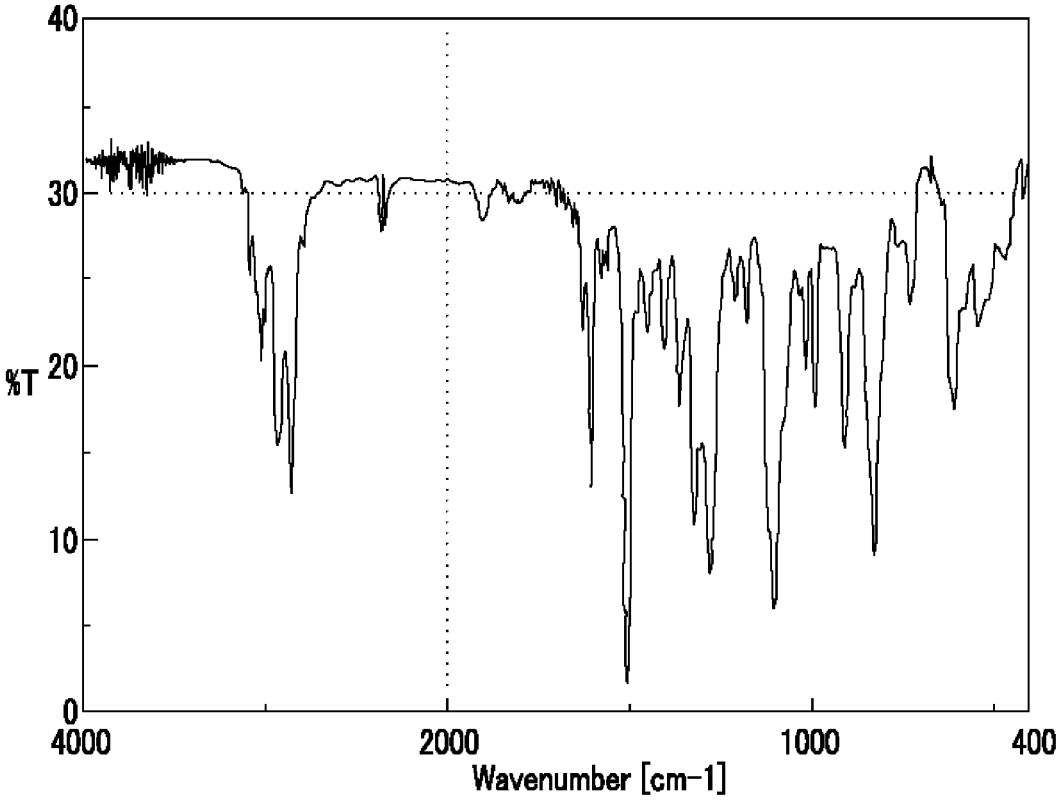
FIG. 11 is an IR spectrum of a compound (I)-178.

22 g of the above compound (2), 33 g of t-butoxypotassium, 300 ml of tetrahydrofuran, and 0.2 g of nitrobenzene are added to a 500 ml flask. While the mixture is being stirred under a nitrogen gas stream, a solution obtained by dissolving 25 g of 4-chloromethylstyrene in 150 ml of tetrahydrofuran is slowly added dropwise thereto. After the dropwise addition ends, the resultant was heated and refluxed for 4 hours, followed by cooling, and poured into water and extracted using toluene. The toluene layer is sufficiently washed with water and concentrated, and the obtained oil-like substance is purified by silica gel column chromatography, thereby obtaining 29 g of oil-like compound (I)-178. The IR spectrum of the obtained compound (I)-178 is shown in FIG. 11.

In addition, an example of the synthesis pathway for synthesizing an example compound (I)-172 will be shown below.

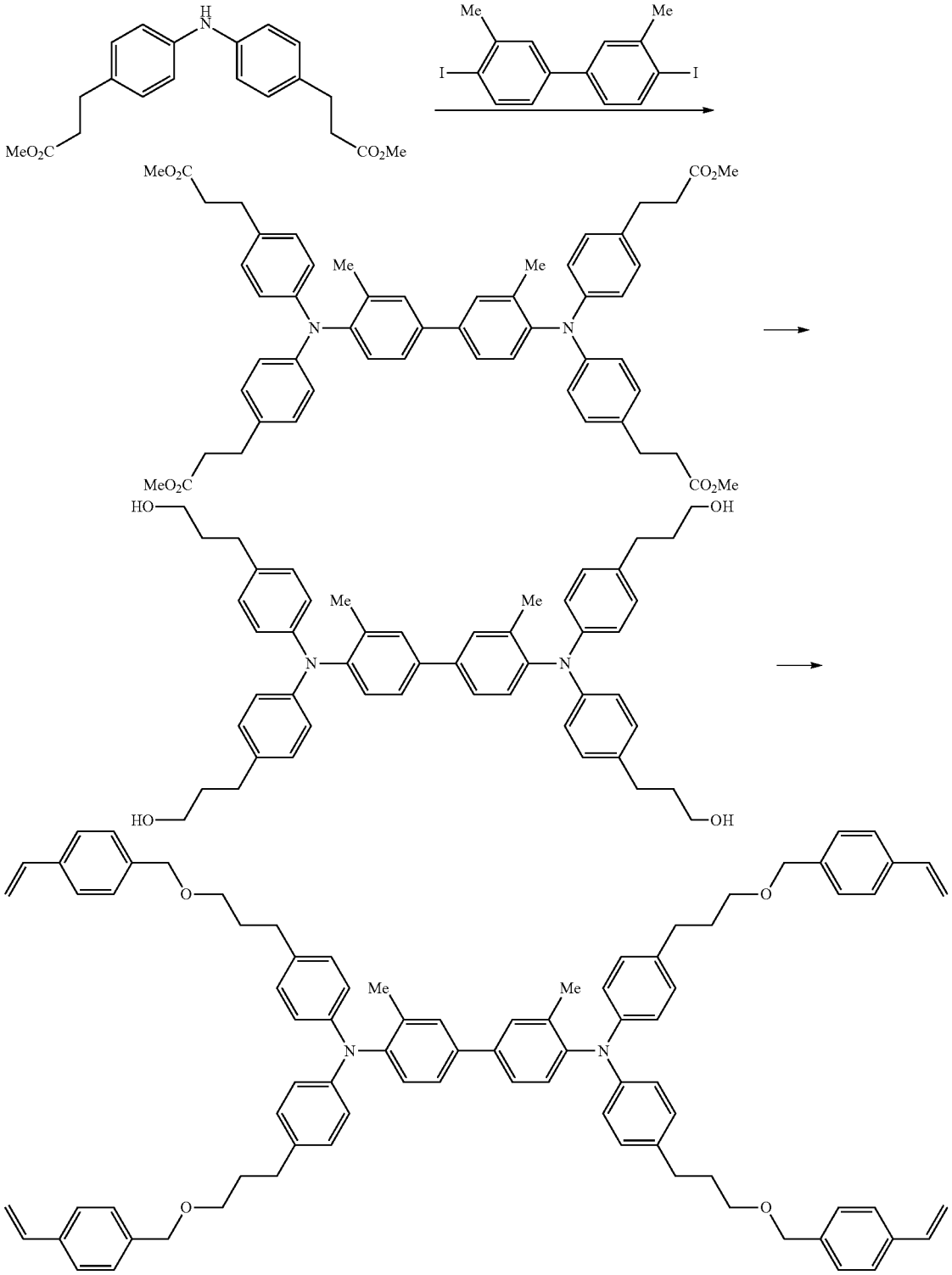

An arylamine compound carboxylic acid is obtained by performing hydrolysis of an ester group of an arylamine compound by using a basic catalyst (NaOH, $K_2CO_3$, or the like) or an acidic catalyst (for example, phosphoric acid or sulfuric acid), as described in, for example, Experimental Chemistry Course, $4^{th}$ edition, Vol. 20, p. 51 or the like.

At this time, examples of solvents include various solvents, but it is preferable to use an alcohol solvent such as methanol, ethanol, ethylene glycol or use a mixture of this solvent and water.

When solubility of the arylamine compound is low, methylene chloride, chloroform, toluene, dimethyl sulfoxide, ether, tetrahydrofuran, or the like may be added.

The amount of the solvent is not particularly limited. However, for example, the solvent is used preferably in an amount of from 1 part by weight to 100 parts by weight, more preferably in an amount of from 2 parts by weight to 50 parts by weight, based on 1 part by weight of the arylamine compound containing an ester group.

The reaction temperature is set within a range of from room temperature (25° C. for example) to a temperature equal to or lower than a boiling point of the solvent, and the reaction temperature is preferably 50° C. or higher in view of a reaction rate.

The amount of the catalyst is not particularly limited. However, the catalyst is used preferably in an amount of from 0.001 part by weight to 1 part by weight, and more preferably in an amount of from 0.01 part by weight to 0.5 part by weight, based on 1 part by weight of the arylamine compound containing an ester group.

When hydrolysis is performed using a basic catalyst after a hydrolysis reaction, the generated salt is neutralized with an acid (hydrochloric acid, for example) so as to be liberated. Moreover, after being sufficiently washed with water, the compound may be dried for use. Alternatively, the compound may optionally be purified by recrystallization by using an appropriate solvent such as methanol, ethanol, toluene, ethyl acetate, or acetone and then dried for use.

An alcohol substance of the arylamine compound is synthesized by reducing an ester group of the arylamine compound to a corresponding alcohol by using lithium aluminum hydride, sodium borohydride, or the like, as described in, for example, Experimental Chemistry Course, $4^{th}$ edition, Vol. 20, p. 10 or the like.

For example, when a reactive group is introduced via an ester bond, general esterification in which dehydration condensation is caused between an arylamine compound carboxylic acid and hydroxymethylstyrene by using an acid catalyst, or a method of condensing an arylamine compound carboxylic acid and hydrogenated methylstyrene by using a base such as pyridine, piperidine, triethylamine, dimethylaminopyridine, trimethylamine, DBU, sodium hydride, sodium hydroxide, or potassium hydroxide may be used. However, a method of using halogenated methylstyrene is suitable since generation of byproducts is inhibited in this method.

The halogenated methylstyrene is in an amount of 1 equivalent or more, preferably 1.2 equivalents or more, and more preferably 1.5 equivalents or more, based on the acid of the arylamine compound carboxylic acid. In addition, the base is used in an amount of from 0.8 equivalent to 2.0 equivalents and preferably from 1.0 equivalent to 1.5 equivalents, based on the halogenated methylstyrene.

As the solvent, aprotic polar solvents such as N-methylpyrrolidone, dimethylsulfoxide, and N,N-dimethylformamide, ketone solvents such as acetone and methyl ethyl ketone, ether solvents such as diethyl ether and tetrahydrofuran, aromatic solvents such as toluene, chlorobenzene, and 1-chloronaphthalene, and the like are effective. These solvents are used in an amount ranging from 1 part by weight to 100 parts by weight and preferably ranging from 2 parts by weight to 50 parts by weight, based on 1 part by weight of the arylamine compound carboxylic acid.

The reaction temperature is not particularly limited. After the reaction ends, the reaction solution is poured into water, and extraction is performed using a solvent such as toluene, hexane, or ethyl acetate, followed by washing with water. Optionally, the resultant may be further purified using adsorbent such as activated charcoal, silica gel, porous alumina, or activated white earth.

When a reactive group is introduced via an ether bond, it is preferable to use a method of condensing the arylamine compound alcohol and the halogenated methylstyrene by using a base such as pyridine, piperidine, triethylamine, dimethylaminopyridine, trimethylamine, DBU, sodium hydride, sodium hydroxide, or a potassium hydroxide.

The halogenated methylstyrene is added in an amount of 1 equivalent or more, preferably 1.2 equivalents or more, and more preferably 1.5 equivalents or more, based on the alcohol of the arylamine compound alcohol. In addition, the base is used in an amount of from 0.8 equivalent to 2.0 equivalent and preferably in an amount of from 1.0 equivalent to 1.5 equivalents, based on the halogenated methylstyrene.

As the solvent, aprotic polar solvents such as N-methylpyrrolidone, and dimethylsulfoxide, N,N-dimethylformamide, ketone solvents such as acetone and methyl ethyl ketone, ether solvents such as diethylether and tetrahydrofuran, aromatic solvents such as toluene, chlorobenzene, and 1-chloronaphthalene, and the like are effective. These solvents are used in an amount ranging from 1 part by weight to 100 parts by weight and preferably ranging from 2 parts by weight to 50 parts by weight, based on 1 part by weight of the arylamine compound alcohol.

The reaction temperature is not particularly limited. After the reaction ends, the reaction solution is poured into water, and extraction is performed using a solvent such as toluene, hexane, or ethyl acetate, followed by washing with water. Optionally, the resultant may be further purified using an adsorbent such as activated charcoal, silica gel, porous alumina, or activated white earth.

The content of the specific reactive group-containing compound in the composition for forming a charge transporting film of the present exemplary embodiment is preferably from 40% by weight to 95% by weight and more preferably from 50% by weight to 95% by weight.

Fluorine-Containing Resin Particles

The fluorine-containing resin particles are a homopolymer of fluoroolefin or two or more kinds of copolymers, and a copolymer of one or two or more kinds of fluoroolefin and a non-fluorine monomer is used as the particles.

Examples of the fluoroolefin include perfluoroolefins such as tetrafluoroethylene (TFE), perfluorovinylether, hexafluoropropylene (HFP), and chlorotrifluoroethylene (CTFE), non-perfluoroolefins such as vinylidene fluoride (VdF), trifluoroethylene, and vinyl fluoride, and the like, and among these, VdF, TFE, CTFE, HFP, and the like are preferable.

Examples of the non-fluorine monomer include hydrocarbon olefins such as ethylene, propylene, and butene, alkyl vinyl ethers such as cyclohexyl vinyl ether (CHVE), ethyl vinyl ether (EVE), butyl vinyl ether, and methyl vinyl ether, alkenyl vinyl ethers such as polyoxyethylene allyl ether (POEAE) and ethyl allyl ether, organic silicon compounds having a reactive α,β-unsaturated group, such as vinyl trimethoxysilane (VSi), vinyl triethoxysilane, and vinyl tris (methoxyethoxy)silane, acrylic acid esters such as methyl acrylate and ethyl acrylate, methacrylic acid esters such as methyl methacrylate and ethyl methacrylate, vinyl esters such as vinyl acetate, vinyl benzoate, and "Veova" (product name, vinyl ester manufactured by Shell Chemicals), and the like. Among these, alkyl vinyl ether, allyl vinyl ether, vinyl ester, organic silicon compounds having a reactive α,β-unsaturated group are preferable.

Among these, those having a high fluorination rate, such as polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), and an ethylene-chlorotrifluoroethylene copolymer (ECTFE), are preferable. Among these, PTFE, FEP, and PFA are particularly preferable.

As the fluorine-containing resin particles, for example, particles (aqueous fluororesin dispersion) obtained by preparing a fluorine monomer by a method such as emulsion polymerization may be used as is, or particles dried after being sufficiently washed with water may be used.

The average particle diameter of the fluorine-containing resin particles is preferably from 0.01 μm to 100 μm and particularly preferably from 0.03 μm to 5 μm.

The average particle diameter of the fluorine-containing resin particles refers to a value measured using a laser diffraction type particle size distribution analyzer LA-700 (manufactured by HORIBA, Ltd.).

As the fluorine-containing resin particles, a commercially available product may be used, and examples of the product as PTFE particles include Fluon L173JE (manufactured by ASAHI GLASS CO., LTD.), Dyneon THV-221AZ and Dyneon 9205 (manufactured by Sumitomo 3M), Lubron L-2 and Lubron L-5 (manufactured by DAIKIN INDUSTRIES, Ltd.), and the like.

The fluorine-containing resin particles may be irradiated with laser beams having an oscillation wavelength of an ultraviolet region. The laser beam emitted to the fluorine-containing resin particles is not particularly limited, and examples thereof include an excimer laser. As the excimer laser beam, an ultraviolet laser beam having a wavelength of 400 nm or less, particularly having a wavelength of from 193 nm to 308 nm is suitable. Particularly, a KrF excimer laser beam (wavelength: 248 nm), an ArF excimer laser beam (wavelength: 193 nm), and the like are preferable. Excimer laser beam irradiation is generally performed at room temperature (25° C.) in the atmosphere, but it may be performed in an oxygen atmosphere.

The condition of the excimer laser beam irradiation are dependent on the types of fluororesins and the required degree of surface modification, but the general irradiation conditions are as follows.

Fluence: 50 mJ/cm$^2$/pulse or more

Incident energy: 0.1 J/cm$^2$ or more

Shot number: 100 or less

Particularly suitable irradiation conditions of the KrF excimer laser beam and the ArF excimer laser beam generally used are as follows.

KrF

Fluence: from 100 mJ/cm$^2$/pulse to 500 mJ/cm$^2$/pulse

Incident energy: from 0.2 J/cm$^2$ to 2.0 J/cm$^2$

Shot number: from 1 to 20

ArF

Fluence: from 50 mJ/cm$^2$/pulse to 150 mJ/cm$^2$/pulse

Incident energy: from 0.1 J/cm$^2$ to 1.0 J/cm$^2$

Shot number: from 1 to 20

The content of the fluorine-containing resin particles is preferably from 1% by weight to 20% by weight and more preferably from 1% by weight to 12% by weight, based on the total amount of the solid contents of the surface protective layer.

Fluorine-Containing Dispersant

The fluorine-containing dispersant is used for dispersing the fluorine-containing resin particles in the surface layer. Accordingly, it is preferable that the dispersant have a surface-activating action, that is, the dispersant is preferably a substance having hydrophilic and hydrophobic groups in a molecule.

Examples of the fluorine-containing dispersant include resins (hereinbelow, referred to as "specific resins" in some cases) obtained by polymerizing the following reactive monomers. Specific examples thereof include a random or block copolymer of acrylate having a perfluoroalkyl group and a monomer not having fluorine, a random or block copolymer of a methacrylate homopolymer, the acrylate having a perfluoroalkyl group, and the monomer not having fluorine, and a random or block copolymer of methacrylate and the monomer not having fluorine. Examples of the acrylate having a perfluoroalkyl group include 2,2,2-trifluoroethyl methacrylate and 2,2,3,3,3-heptafluoropropyl methacrylate.

Examples of the monomer not having fluorine include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethyl carbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenyl phenol acrylate, and o-phenyl phenol glycidyl ether acrylate. The examples also include block or branch polymers and the like disclosed in the specification of U.S. Pat. No. 5,637,142, Japanese Patent No. 4251662, and the like. In addition, fluorosurfactants are also included in the examples. Specific examples of the fluorosurfactants include Surflon S-611 and Surflon S-385 (manufactured by AGC SEIMI CHEMICAL CO., LTD.), Ftergent 730FL and Ftergent 750FL (manufactured by NEOS COMPANY LIMITED), PF-636 and PF-6520 (manufactured by Kitamura Chemicals Co., Ltd.), Megaface EKE), TF-1507, and TF-1535 (manufactured by DIC Corporation), FC-4430 and FC-4432 (manufactured by 3M), and the like.

The weight average molecular weight of the above specific resins is preferably from 100 to 50000.

The content of the fluorine-containing dispersant is preferably from 0.1% by weight to 1% by weight and more preferably from 0.2% by weight to 0.5% by weight, based on the total amount of the solid contents of the surface protective layer.

As a method of attaching the specific resins to the surface of the fluorine-containing resin particles, the specific resins may be directly attached to the surface of the fluorine-containing resin particles. Alternatively, first, the above monomer is adsorbed onto the surface of the fluorine-containing resin particles, followed by polymerization, whereby the specific resin may be formed on the surface of the fluorine-containing resin particles.

Other Surfactants

Other surfactants may be added to the surface protective layer. Here, the amount of other surfactants is preferably small as far as possible, and the amount is preferably from 0 part by weight to 0.1 part by weight, more preferably from 0 part by weight to 0.05 part by weight, and particularly preferably from 0 part by weight to 0.03 part by weight, based on 1 part by weight of the fluorine-containing resin particles.

The surfactant is preferably a nonionic surfactant, and examples thereof include polyoxyethylene alkyl ethers, polyoxyethylene alkyl phenyl ethers, polyoxyethylene alkyl esters, sorbitan alkyl esters, polyoxyethylene sorbitan alkyl esters, glycerin esters, fluorosurfactants and derivatives thereof, and the like.

Specific examples of the polyoxyethylenes include Emulgen 707 (manufactured by KAO Corporation), Naroacty CL-70 and Naroacty CL-85 (manufactured by Sanyo Chemical Industries, Ltd.), Leocol TD-120 (manufactured by LION CORPORATION), and the like.

Solvent Having Dielectric Constant of 5.0 or More

In forming the surface protective layer using the composition for forming a charge transporting film according to the present exemplary embodiment, a solvent (hereinbelow, referred to as a "specific solvent" in some cases) having a dielectric constant of 5.0 or more is used. A dielectric constant of a solvent is a value identified by, for example, a dielectric constant meter for liquid, Model 871, manufactured by Nihon Rufuto Co., Ltd.

As the solvent having a dielectric constant of 5.0 or more, one or more kinds of solvents selected from a group consisting of aqueous media such as water (dielectric constant 80; 25.0° C.), unbranched, branched, and cyclic aliphatic alcohols such as methanol (dielectric constant 33; 25.0° C.), ethanol (dielectric constant 24; 25.0° C.), 1-propanol (dielectric constant 20; 25.0° C.), 2-propanol (dielectric constant 18; 25.0° C.), n-butanol (dielectric constant 17.4; 25.0° C.), t-butanol, 1-pentanol (dielectric constant 14.8; 25.0° C.), 2-pentanol, 3-pentanol, cyclopentanol (dielectric constant 16.5; 25.0° C.), 2-methyl-2-butanol (dielectric constant 5.7; 25.0° C.), 3-methyl-1-butanol, 2-methyl-1-propanol (dielectric constant 17.4; 25.0° C.), 2-ethyl-1-butanol, 3,5-dimethyl-1-hexyn-3-ol, 2-butanol (dielectric constant 16.1; 25.0° C.), 2-methyl-2-propanol (dielectric constant 11.5; 25.0° C.), 2-propyn-1-ol, 2-methyl-1-butanol, 3-methyl-2-butanol, 3-methyl-1-butyn-3-ol, 4-methyl-2-pentanol, and 3-methyl-1-pentyn-3-ol, glycols such as ethylene glycol (dielectric constant 38.7; 25.0° C.) and propylene glycol (dielectric constant 32; 25.0° C.), ketones such as acetone (dielectric constant 19.5; 25.0° C.), acetyl acetone, ethyl-n-butyl ketone, diethyl ketone, methyl-n-amyl ketone, methyl-n-butyl ketone, methyl-n-propyl ketone, methyl isobutyl ketone (dielectric constant 13.5; 25.0° C.), methyl ethyl ketone (dielectric constant 15.5; 25.0° C.), cyclopentanone (dielectric constant 13.5; 25.0° C.), di-n-propyl ketone (dielectric constant 12.3; 25.0° C.), and diisopropyl ketone (dielectric constant 12.9; 25.0° C.), esters such as ethyl isovalerate, isoamyl formate, isobutyl formate, butyl formate, propyl formate, amyl acetate, allyl acetate, isobutyl acetate (dielectric constant 5.0; 25.0° C.), isopropyl acetate (dielectric constant 6.0; 25.0° C.), ethyl acetate (dielectric constant 6.4; 25.0° C.), n-butyl acetate, s-butyl acetate, propyl acetate, isopropyl acetate, diethyl carbonate, dimethyl carbonate, amyl lactate, ethyl lactate, methyl lactate (dielectric constant 16.7; 25.0° C.), isoamyl propionate, ethyl propionate, butyl propionate, methyl propionate, isopropyl butyrate, ethyl butyrate, and methyl butyrate, ethers such as tetrahydrofuran (dielectric constant 7.6; 25.0° C.) and tetrahydropyran (dielectric constant 7.3; 25.0° C.), polyol ethers such as propylene glycol monomethyl ether (dielectric constant 11.9; 25.0° C.), propylene glycol monoethyl ether (dielectric constant 10.1; 25.0° C.), ethylene glycol monoisopropyl ether (dielectric constant 10.7; 25.0° C.), and propylene glycol monomethyl ether acetate (dielectric constant 7.8; 25.0° C.) and esters of these may be used alone or used as an organic solvent by being mixed.

In addition, in view of drying time, the boiling point of the solvent is preferably 150° C. or lower.

Among the above solvents having a dielectric constant of 5.0 or more, ketones and esters are particularly preferable in view of the solubility of the specific reactive group-containing charge transport material.

Compound Having Unsaturated Bond

For the film constituting the protective layer (uppermost surface layer) 5, a compound having an unsaturated bond may be used concurrently.

The compound having an unsaturated bond may be one of a monomer, an oligomer, and a polymer, and may have a charge transporting skeleton.

Examples of the compound having an unsaturated bond but not having a charge transporting skeleton include the following.

Examples of monofunctional monomers include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethyl carbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenyl phenol acrylate, o-phenyl phenol glycidyl ether acrylate, styrene, and the like.

Examples of bifunctional monomers include diethylene glycol di(meth)acrylate, polyethylene glycol di(meth)acrylate, polypropylene glycol di(meth)acrylate, neopentyl glycol di(meth)acrylate, 1,6-hexanediol di(meth)acrylate, divinyl benzene, diallyl terephthalate, and the like.

Examples of trifunctional monomers include trimethylolpropane tri(meth)acrylate, pentaerythritol tri(meth)acrylate, aliphatic tri(meth)acrylate, trivinyl cyclohexane, and the like.

Examples of tetrafunctional monomers include pentaerythritol tetra(meth)acrylate, di-trimethylolpropane tetra (meth)acrylate, aliphatic tetra(meth)acrylate, and the like.

Examples of penta- or higher functional monomers include dipentaerythritol penta(meth)acrylate, dipentaerythritol hexa (meth)acrylate, and (meth)acrylate having a polyester skeleton, a urethane skeleton, or a phosphazene skeleton, and the like.

Examples of reactive polymers include those disclosed in JP-A—S—216249, JP-A—S—323630, JP-A-11-52603, JP-A-2000-264961, JP-A-2005-2291, and the like.

When the compound not having a charge transport component but having an unsaturated bond is used, this compound is used alone or used as a mixture of two or more kinds thereof. When the compound not having a charge transport component but having an unsaturated bond is used for forming the uppermost surface layer of the electrophotographic photoreceptor, the amount of the compound used is preferably 60% by weight or less, more preferably 55% by weight or less, and even more preferably 50% by weight or less, based on the total solid contents of the composition used for forming the uppermost surface layer.

On the other hand, examples of the compound having an unsaturated bond and a charge transporting skeleton include compounds that has a chain-polymerizable functional group (chain-polymerizable functional group excluding a styryl group) and a charge transporting skeleton in the same molecule.

The chain-polymerizable functional group in the compound having a chain-polymerizable functional group and a charge transporting skeleton in the same molecule is not particularly limited as long as the functional group is radically polymerizable. For example, the chain-polymerizable functional group is a functional group having a group that contains at least a carbon double bond. Specific examples thereof include groups and the like that contain at least one kind selected from a vinyl group, a vinyl ether group, a vinyl thioether group, a styryl group, an acryloyl group, a methacryloyl group, and derivatives of these. Among these, the chain-polymerizable functional group is preferably a group that contains at least one kind selected from a vinyl group, a styryl group, an acryloyl group, a methacryloyl group, and derivatives of these, since the reactivity of the group is excellent.

In addition, the charge transporting skeleton in the compound having a chain-polymerizable functional group and a charge transporting skeleton in the same molecule is not particularly limited as long as the skeleton is a known structure in an electrophotographic photoreceptor. For example, the charge transporting skeleton is a skeleton derived from nitrogen-containing hole transporting compounds such as a triarylamine compound, a benzidine compound, and a hydrazone compound, and examples thereof include structures conjugated with nitrogen atoms. Among these, a triarylamine skeleton is preferable.

The compound having a chain-polymerizable functional group and a charge transporting skeleton in the same molecule may be a polymer having a partial structure that is represented by each of the following Formulae (B) and (C).

(B)

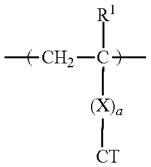

(C)

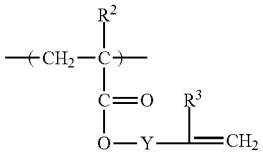

In Formulae (B) and (C), each of $R^1$, $R^2$, and $R^3$ independently represents a hydrogen atom or an alkyl group having 1 to 4 carbon atoms, each of X and Y independently represents a divalent organic group having 1 to 20 carbon atoms, a represents 0 or 1, and CT represents an organic group having a charge transporting skeleton.

Herein, a terminal group of the polymer having the partial structure that is represented by each of Formulae (B) and (C) is a structure formed by a termination reaction caused by a radical polymerization reaction.

In Formula (B), examples of the organic group having a charge transporting skeleton and represented by CT include the charge transporting skeletons described above. Suitable examples thereof include organic groups and the like having a triarylamine skeleton, a benzidine skeleton, an arylalkane skeleton, an aryl-substituted ethylene skeleton, a stilbene skeleton, an anthracene skeleton, or a hydrazone skeleton. Among these, organic groups having a triarylamine skeleton, a benzidine skeleton, or a stilbene skeleton are preferable.

In Formulae (B) and (C), examples of the divalent organic group represented by X and Y include divalent organic groups having one kind selected from an alkylene group, —C(=O)—, —O—C(=O)—, an aromatic ring, and a linking group as a combination of these. The divalent organic group represented by X and Y preferably does not have a hydroxyl group.

Specific examples of the divalent organic group represented by X include —C(=O)—O—$(CH_2)_n$— (here, represents 0 or an integer of 1 to 10) and the like.

Specific examples of the divalent organic group represented by Y include —$(CH)_n$— (here, n represents an integer of 1 to 10), —$(CH_2)_n$—O—C(=O)—(here, n represents 0 or an integer of 1 to 10, and a portion of hydrogen atoms of "$(CH_2)_n$" may be substituted with a hydroxyl group), —$(CH_2)_n$—Ar— (here, Ar represents an arylene group having 1 to 3 aromatic rings, and n represents 0 or an integer of 1 to 10), —Ar—O—$(CH_2)_n$—O—C(=O)— (here, Ar represents an arylene group having 1 to 3 aromatic rings, and n represents 0 or an integer of 1 to 10), and the like.

Specific examples of the partial structure represented by Formula (B) include the following, but the invention is not limited thereto. In addition, when "-" is shown in the column of "$(X)_a$", this indicates a case where a=0, and when a group is shown in the column, this indicates a case where a=1 and a group that CT represents together with X.

| | $R^1$ | $(X)_a$ | CT |
|---|---|---|---|
| (B)-1 | H | — | 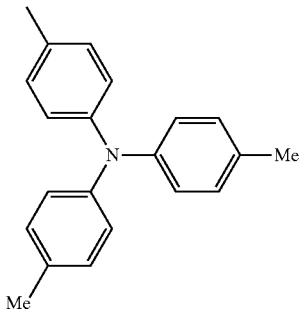 |

-continued
| | $R^1$ | $(X)_a$ | CT |
|---|---|---|---|
| (B)-2 | H | — | 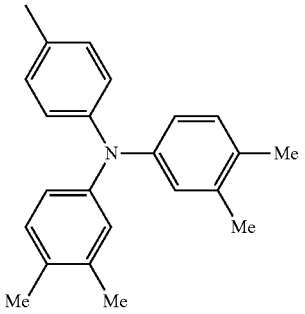 |
| (B)-3 | H | — | 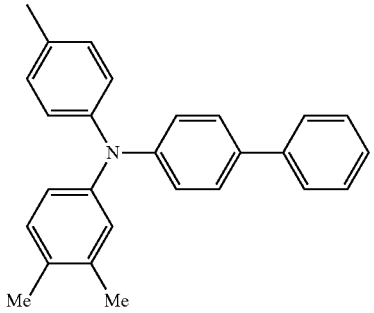 |
| (B)-4 | H | — | 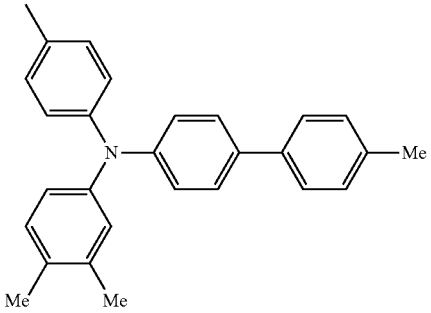 |
| (B)-5 | H | — | 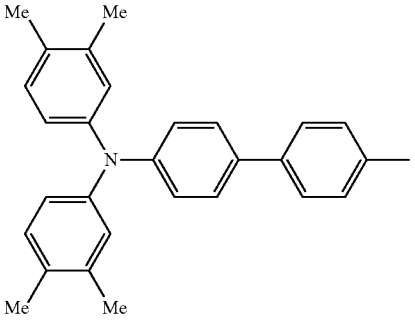 |
| (B)-6 | H | — | 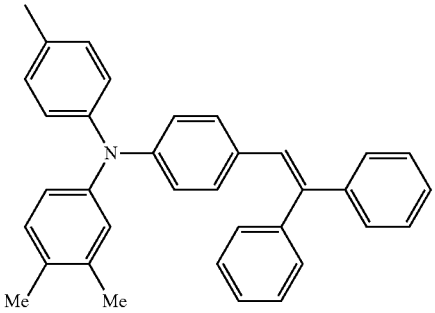 |

-continued
| | $R^1$ | $(X)_a$ | CT |
|---|---|---|---|
| (B)-7 | H | — | 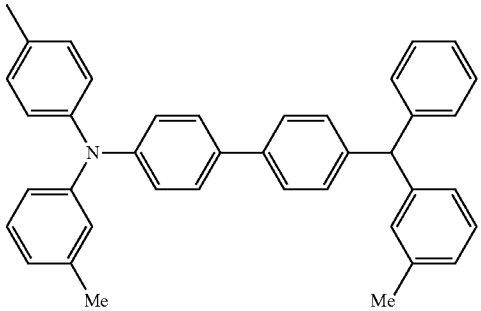 |
| (B)-8 | H | — | 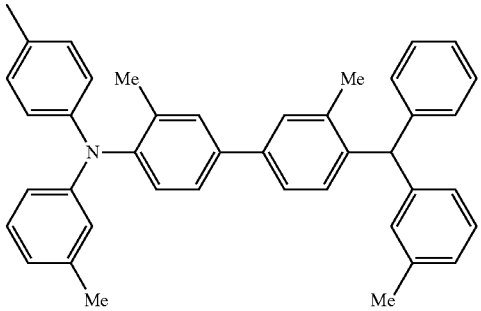 |
| (B)-9 | H | — | 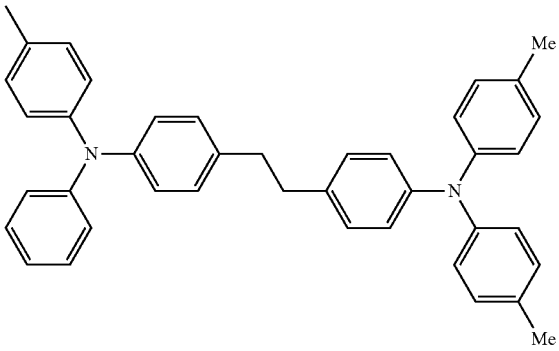 |
| (B)-10 | H | — | 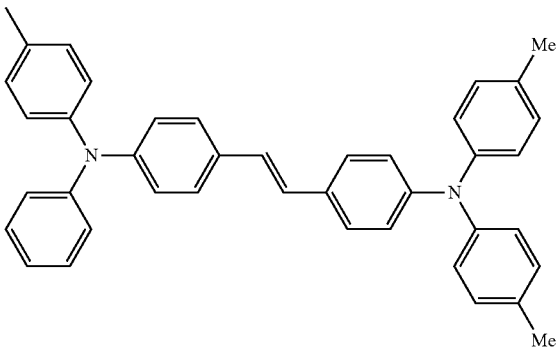 |

-continued
| | $R^1$ | $(X)_a$ | CT |
|---|---|---|---|
| (B)-11 | H | — | 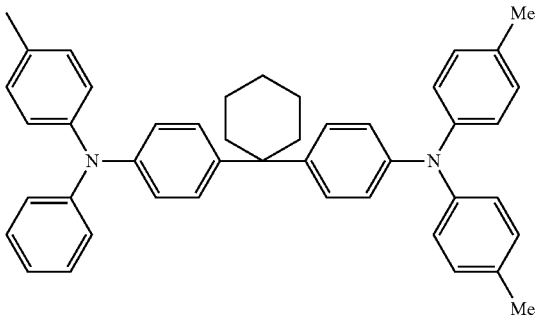 |
| (B)-12 | H | 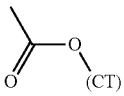 | 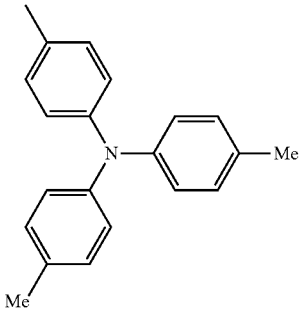 |
| (B)-13 | H | 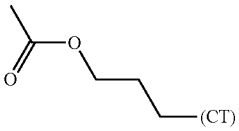 | 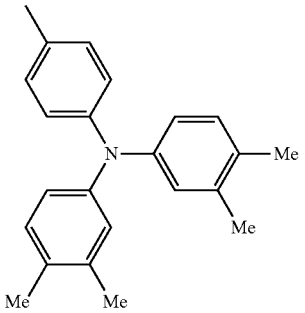 |
| (B)-14 | H | 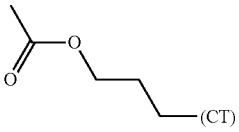 | 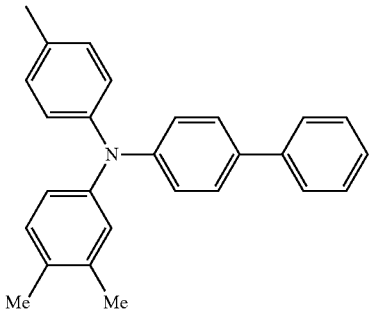 |
| (B)-15 | H | 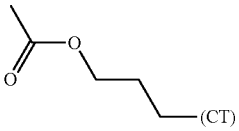 | 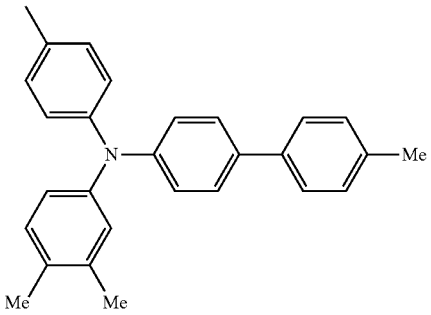 |

-continued
| | $R^1$ | $(X)_a$ | CT |
|---|---|---|---|
| (B)-16 | H | 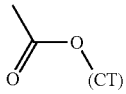 | 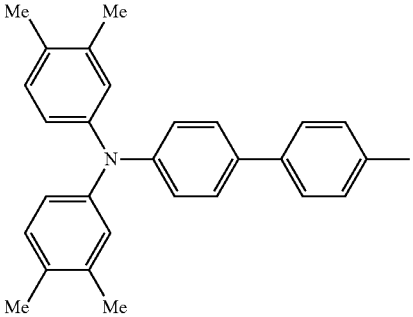 |
| (B)-17 | H | 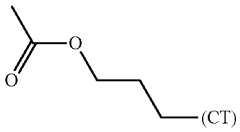 | 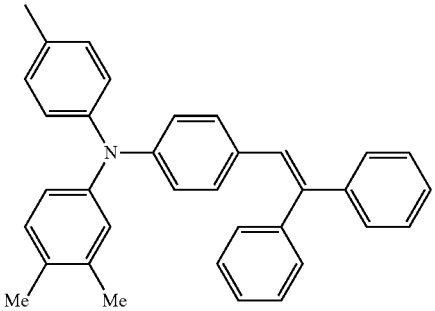 |
| (B)-18 | H | 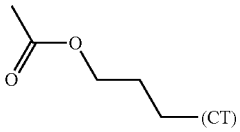 | 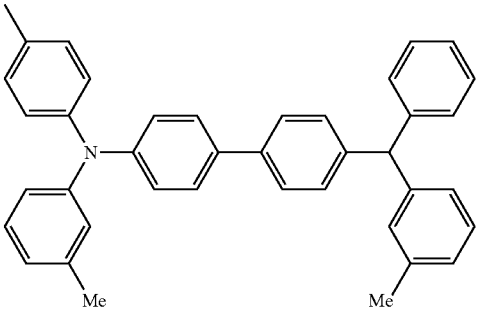 |
| (B)-19 | H | 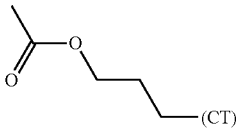 | 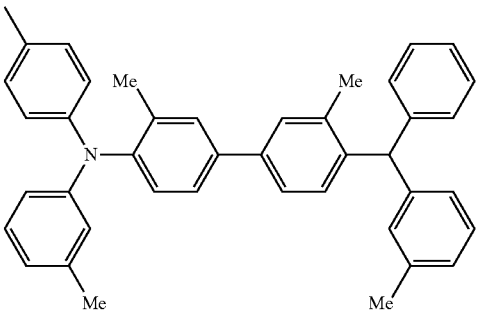 |

-continued
| | $R^1$ | $(X)_a$ | CT |
|---|---|---|---|
| (B)-20 | H | 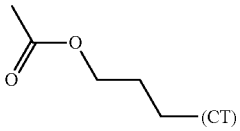 | 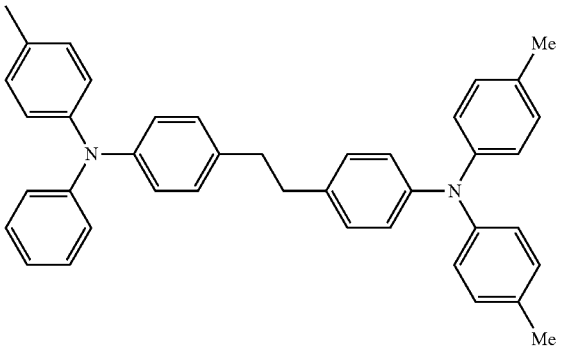 |
| (B)-21 | H | 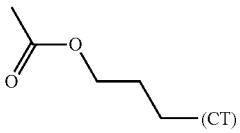 | 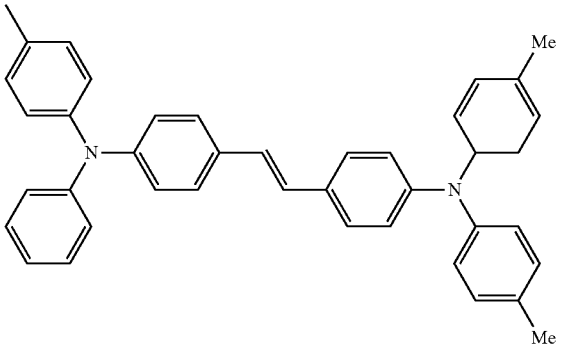 |
| (B)-22 | H | 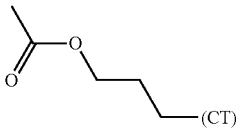 | 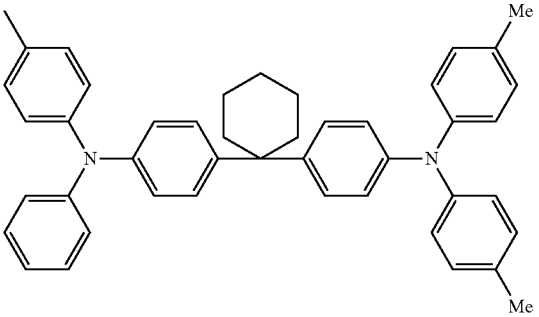 |
| (B)-23 | Me | 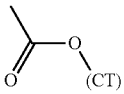 | 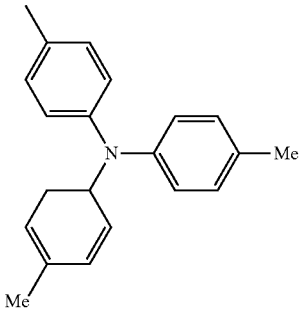 |

-continued
| | $R^1$ | $(X)_a$ | CT |
|---|---|---|---|
| (B)-24 | Me | 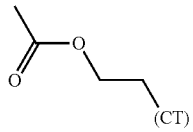 | 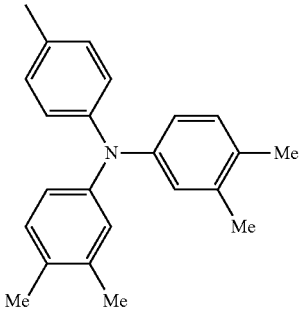 |
| (B)-25 | Me | 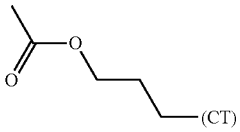 | 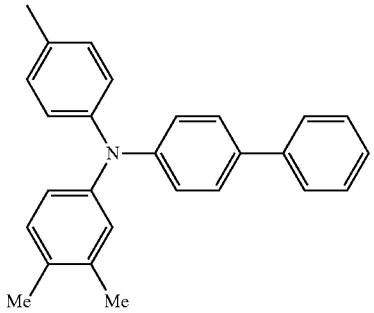 |
| (B)-26 | Me | 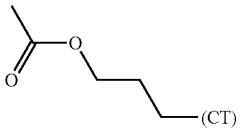 | 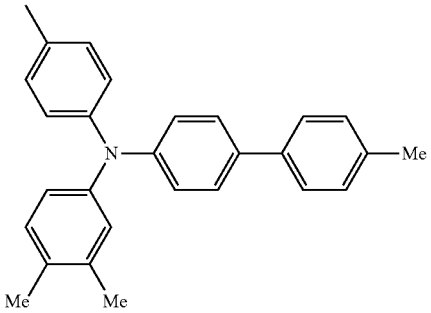 |
| (B)-27 | Me | 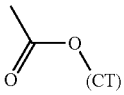 | 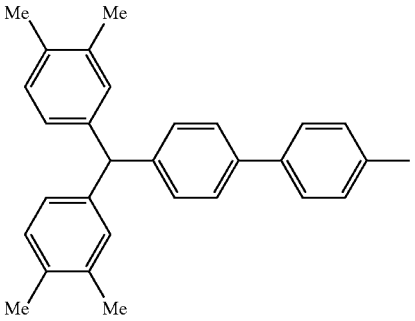 |
| (B)-28 | Me | 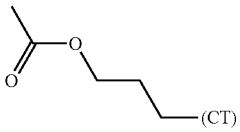 | 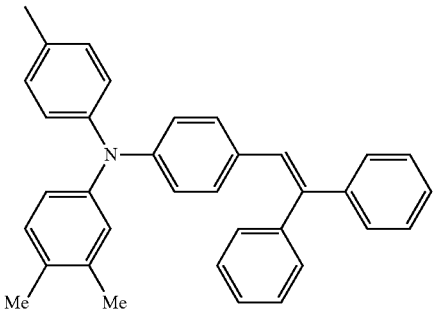 |

-continued
| | $R^1$ | $(X)_a$ | CT |
|---|---|---|---|
| (B)-29 | Me | 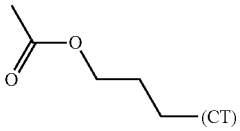 | 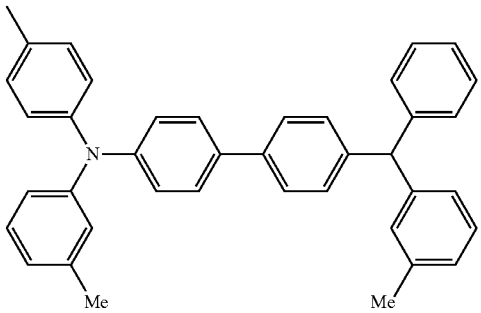 |
| (B)-30 | Me | 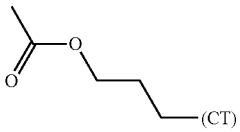 | 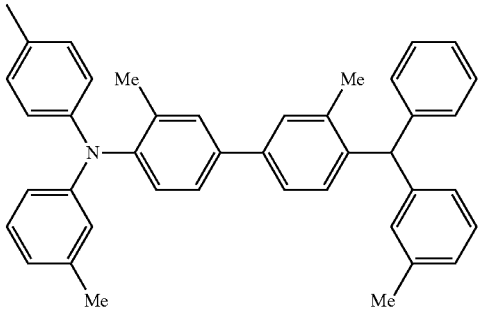 |
| (B)-31 | Me | 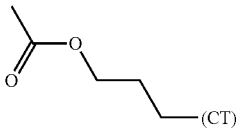 | 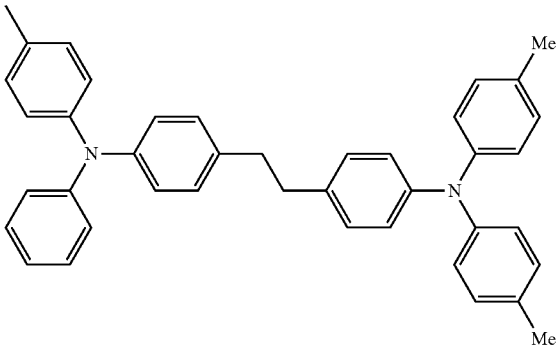 |
| (B)-32 | Me | 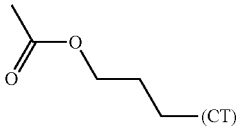 | 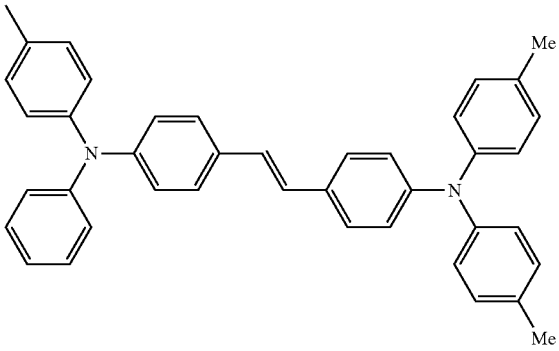 |

-continued
| | $R^1$ | $(X)_a$ | CT |
|---|---|---|---|
| (B)-33 | Me | 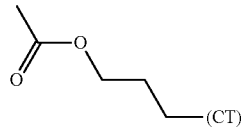 | 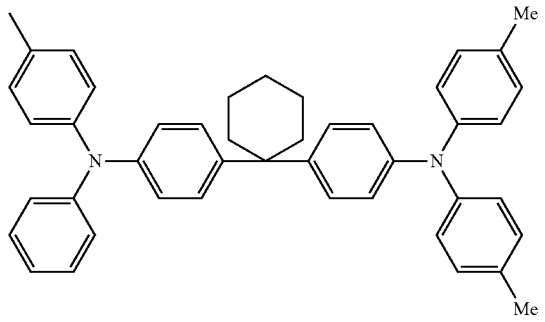 |
Next, specific examples of the partial structure represented by Formula (C) include the following, but the invention is not limited thereto.
| | $R^2$ | Y | $R^3$ |
|---|---|---|---|
| (C)-1 | H | $—CH_2—$ | H |
| (C)-2 | H | 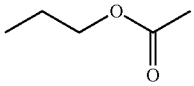 | H |
| (C)-3 | H | 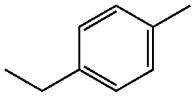 | H |
| (C)-4 | H | $—CH_2—$ | Me |
| (C)-5 | H | 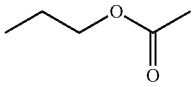 | Me |
| (C)-6 | H | 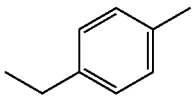 | Bu |
| (C)-7 | H | 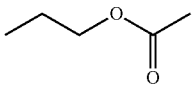 | Bu |
| (C)-8 | H | 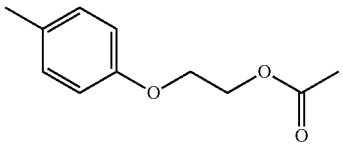 | Me |
| (C)-9 | H | 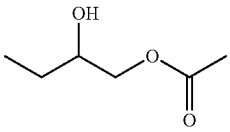 | H |
| (C)-10 | H | 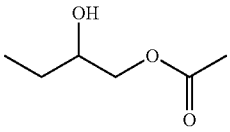 | Me |
-continued
| | $R^2$ | Y | $R^3$ |
|---|---|---|---|
| (C)-11 | H | 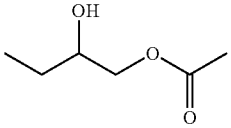 | Bu |
| (C)-12 | Me | $—CH_2—$ | H |
| (C)-13 | Me | 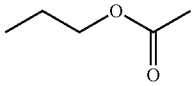 | H |
| (C)-14 | Me | 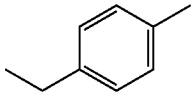 | H |
| (C)-15 | Me | $—CH_2—$ | Me |
| (C)-16 | Me | 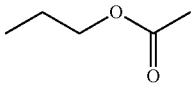 | Me |
| (C)-17 | Me | 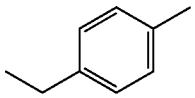 | Bu |
| (C)-18 | Me | 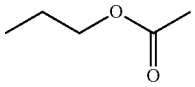 | Bu |
| (C)-19 | Me | 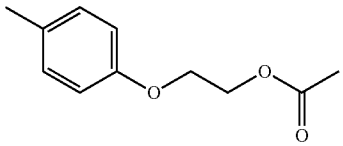 | Me |
| (C)-20 | Me | 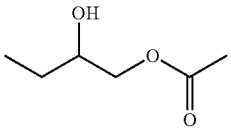 | H |

-continued

| | $R^2$ | Y | $R^3$ |
|---|---|---|---|
| (C)-21 | Me | 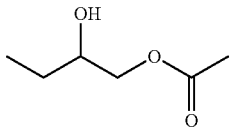 | Me |
| (C)-22 | Me | 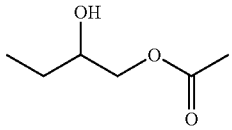 | Bu |

Among these, a structure represented by the following structural Formula (D) is more preferable since this structure has excellent solubility and film formability.

(D)

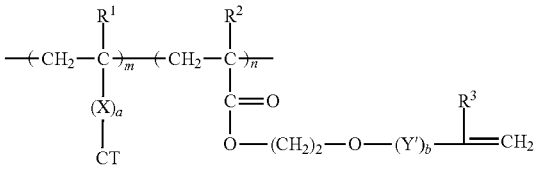

In Formula (D), each of $R^1$, $R^2$, and $R^3$ independently represents a hydrogen atom or an alkyl group having 1 to 4 carbon atoms, X represents a divalent organic group having 1 to 20 carbon atoms, Y' represents —C(=O)—, —$CH_2$—, or —$(CH_2)_2$—, each of a and b independently represents 0 or 1, and CT represents an organic group having a charge transporting skeleton.

Each of m and n represents an integer of 5 or greater, $10<m+n<2000$ and $0.2<m/(m+n)<0.95$. In view of strength, flexibility, and electrical characteristics, it is preferable that $15<m+n<2000$ and $0.3<m/(m+n)<0.95$, and it is more preferable that $20<m+n<2000$ and $0.4<m/(m+n)<0.95$.

In addition, in Formula (D), the divalent organic group represented by X and the organic group represented by CT and having a charge transporting skeleton have the same definition as that of X and CT in Formulae (B) and (C).

The polymer having the partial structure represented by each of Formulae (B) and (C) is prepared by a known method, for example, a method of using the compound represented by Formula (A) as a monomer and copolymerzing the monomer with methacrylic acid, acrylic acid, a glycidyl compound, and derivatives of these.

In addition, the polymer having the partial structure represented by each of Formula (B) and (C) may be prepared by further copolymerizing those represented by Formulae (B) and (C) with a monofunctional monomer so as to impart solubility and flexibility.

Examples of the monofunctional monomer include acrylates or methacrylates such as isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethyl carbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenyl phenol acrylate, and o-phenyl phenol glycidyl ether acrylate, styrene derivatives such as styrene, α-methylstyrene, and 4-methylstyrene, and the like.

An amount (I) of these used for copolymerizing these monomers is preferably $1<m<0.3$ and more preferably $1<m<0.2$, based on m in Formula (D).

Non-Reactive Charge Transport Material

For the film constituting the protective layer (uppermost surface layer) 5, a non-reactive charge transport material may be used concurrently. The non-reactive charge transport material does not have a reactive group that does not transport charge. Accordingly, when the non-reactive charge transport material is used for the protective layer (uppermost surface layer) 5, the concentration of the charge transport component is increased practically, and this is effective for further improving electrical characteristics. Moreover, by adding the non-reactive charge transport material, crosslink density may be reduced, whereby the strength may be adjusted.

As the non-reactive charge transport material, known charge transport materials may be used. Specifically, triarylamine compounds, benzidine compounds, arylalkane compounds, aryl-substituted ethylene compounds, stilbene compounds, anthracene compounds, hydrazone compounds, and the like are used.

Among these, in view of mobility, compatibility, and the like, compounds having a triphenylamine skeleton are preferable.

The non-reactive charge transport material is used preferably in an amount of from 0% by weight to 30% by weight, more preferably in an amount of from 1% by weight to 25% by weight, and even more preferably in an amount of from 5% by weight to 25% by weight, based on the total solid contents of a coating liquid for forming a layer.

Other Additives

For the purpose of adjusting film formability, flexibility, lubricity, and adhesiveness, the film constituting the protective layer (uppermost surface layer) 5 may be used by being mixed with other coupling agents, particularly, a fluorine-containing coupling agent. As such compounds, various silane coupling agents and commercially available silicone hard coating agents are used. In addition, silicon compounds having a radical-polymerizable group and fluorine compounds may be used.

Examples of the silane coupling agent include vinyl trichlorosilane, vinyl trimethoxysilane, vinyl triethoxysilane, γ-glycidoxypropylmethyl diethoxysilane, γ-glycidoxypropyl trimethoxysilane, γ-aminopropyl triethoxysilane, γ-aminopropyl trimethoxysilane, γ-aminopropylmethyl dimethoxysilane, N-β-(aminoethyl)-γ-aminopropyl triethoxysilane, tetramethoxysilane, methyl trimethoxysilane, dimethyl dimethoxysilane, and the like.

Examples of the commercially available hard coating agent include KP-85, K-40-9740, and K-8239 (all manufactured by Shin-Etsu Chemical Co., Ltd.), AY42-440, AY42-441, and AY49-208 (all manufactured by Dow Corning Toray), and the like.

In addition, in order to impart water repellency or the like, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyl triethoxysilane, 1H,1H,2H,2H-perfluoroalkyl triethoxysilane, 1H,1H,2H,2H-perfluorodecyl triethoxysilane, and 1H,1H,2H,2H-perfluorooctyl triethoxysilane may be added.

The silane coupling agent is used in any amount, but in view of film formability of a cross-linked film, the amount of the fluorine-containing compound is preferably 0.25 time or less a compound not containing fluorine in terms of weight. Moreover, reactive fluorine compounds and the like disclosed in JP-A-2001-166510 and the like may be mixed in.

Examples of the silicon compound having a radical-polymerizable group and the fluorine-containing compound include the compounds and the like disclosed in JP-A-2007-11005.

It is preferable to add a deterioration-preventing agent to the film constituting the protective layer (uppermost surface layer) 5. As the deterioration-preventing agent, hindered phenol- or hindered amine agents are preferable, and known antioxidants such as organic sulfur antioxidants, phosphite antioxidants, dithiocarbamic acid salt antioxidants, thiourea antioxidant, and benzimidazole antioxidants may also be used.

The amount of the deterioration-preventing agent added is preferably 20% by weight or less and more preferably 10% by weight or less.

Examples of the hindered phenol antioxidant include Irganox 1076, Irganox 1010, Irganox 1098, Irganox 245, Irganox 1330, Irganox 3114, and Irganox 1076 all of which are manufactured by Ciba Specialty Chemicals, Japan, "3,5-di-t-butyl-4-hydroxybiphenyl", and the like.

Examples of the hindered amine antioxidant include "Sanol LS2626", "Sanol LS765", "Sanol LS770", and "Sanol LS744" all of which are manufactured by Sankyo Lifetech Co., Ltd., "Tinuvin 144" and "Tinuvin 622LD" all of which are manufactured by Ciba Specialty Chemicals, Japan, "Mark LA57", "Mark LA67", "Mark LA62", "Mark LA68", and "Mark LA63" all of which are manufactured by ADEKA CORPORATION; examples of the thioether antioxidant include "Sumilizer TPS" and "Sumilizer TP-D" all of which are manufactured by Sumitomo Chemical Co., Ltd.; and examples of the phosphite antioxidant include "Mark 2112", "Mark PEP-8", "Mark PEP-24G", "Mark PEP-36", "Mark 329K", and "Mark HP-10" all of which are manufactured by ADEKA CORPORATION, and the like.

To the film constituting the protective layer (uppermost surface layer) 5, conductive particles or organic and inorganic particles other than fluorine-containing resin particles may be added.

An example of the particles includes silicon-containing particles. The silicon-containing particles are particles containing silicon as a constituent element, and specific examples thereof include colloidal silica and silicone particles. The colloidal silica used as the silicon-containing particles is selected from those obtained by dispersing silica having an average particle diameter of 1 nm to 100 nm and preferably of 10 nm to 30 nm in an acidic or alkaline aqueous dispersion or in an organic solvent such as, an alcohol, a ketone, or an ester. As the particles, commercially available general products may also be used.

The solid content of the colloidal silica in the protective layer is not particularly limited. However, the colloidal silica is used in an amount ranging from 0.1% by weight to 50% by weight, and preferably in an amount ranging from 0.1% by weight to 30% by weight, based on the total amount of solid contents of the protective layer 5.

The silicone particles used as the silicon-containing particles are selected from silicone resin particles, silicone rubber particles, and silica particles which are surface-treated with silicone, and commercially available general product may also used.

These silicone particles are spherical, and the average particle diameter thereof is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of solid contents of the protective layer 5.

In addition, examples of other particles include fluorine particles such as tetrafluoroethylene, trifluoroethylene, hexafluoropropylene, vinyl fluoride, and vinylidene fluoride, particles constituted with a resin that is obtained by copolymerizing a fluororesin with a monomer having a hydroxyl group, as disclosed in "Proceedings of the 8$^{th}$ Polymer Material Forum, p. 89", and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Moreover, various known dispersion materials may also be used to disperse the particles.

To the film constituting the protective layer (uppermost surface layer) 5, oil such as silicone oil may be added. Examples of the silicone oil include silicone oil such as dimethyl polysiloxane, diphenyl polysiloxane, or phenyl methyl siloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, or phenol-modified polysiloxane; cyclic dimethyl cyclosiloxanes such as hexamethyl cyclotrisiloxane, octamethyl cyclotetrasiloxane, decamethyl cyclopentasiloxane, and dodecamethyl cyclohexasiloxane; cyclic methylphenyl cyclosiloxanes such as 1,3,5-trimethyl-1,3,5-triphenyl cyclotrisiloxane, 1,3,5,7-tetramethyl-1,3,5,7-tetraphenyl cyclotetrasiloxane, and 1,3,5,7,9-pentamethyl-1,3,5,7,9-pentaphenyl cyclopentasiloxane; cyclic phenyl cyclosiloxanes such as hexaphenyl cyclotrisiloxane; fluorine-containing cyclosiloxanes such as 3-(3,3,3-trifluoropropyl)methyl cyclotrisiloxane; hydrosilyl group-containing cyclosiloxanes such as a methyl hydrosiloxane mixture, pentamethyl cyclopentasiloxane, and phenyl hydrocyclosiloxane; vinyl group-containing cyclosiloxanes such as pentavinyl pentamethyl cyclopentasiloxane; and the like.

To the film constituting the protective layer (uppermost surface layer) 5, a metal, metal oxide, carbon black, and the like may also be added. Examples of the metal include aluminum, zinc, copper, chromium, nickel, silver, stainless steel, and those obtained by vapor-depositing these metals onto the surface of plastic particles. Examples of the metal oxide include zinc oxide, titanium oxide, tin oxide, antimony oxide, indium oxide, bismuth oxide, indium oxide doped with tin, tin oxide doped with antimony or tantalum, zirconium oxide doped with antimony, and the like.

These may be used alone or used in combination of two or more kinds thereof. When used in combination of two or more kinds thereof, these may be simply mixed, or may be mixed in the form of a solid solution or mixed by fusion. The average particle diameter of the conductive particles is 0.3 μm or less, and particularly preferably 0.1 μm or less.

As a dispersion method for dispersing the fluorine-containing resin particles in the composition for forming a charge transporting film (coating liquid for forming a charge transporting film) used for forming the protective layer 5, media dispersion machines such as a ball mill, a vibration ball mill, an attritor, a sand mill, and a horizontal sand mill, or medialess dispersing machines such as a stirrer, an ultrasonic dispersing machine, a roll mill, and a high-pressure homogenizer may be used. In addition, examples of the high-pressure homogenizer include a homogenizer employing a collision method in which a dispersion is dispersed by liquid-liquid collision or liquid-wall collision in a high-pressure state, a homogenizer employing a penetration method in which a dispersion is dispersed by being caused to penetrate fine flow paths in a high-pressure state, and the like.

In the present exemplary embodiment, the method of preparing the composition for forming a charge transporting film is not particularly limited. The charge transport material including the specific reactive group-containing compound may be mixed with the fluorine-containing resin particle, the fluorine-containing dispersant, the specific solvent, and optionally other components, and the above dispersing machine may be used to prepare the composition. Alternatively, two kinds of liquid including a mixed solution A that includes the fluorine-containing resin particles, the fluorine-containing dispersant, and the specific solvent and a mixed solution B that includes at least the charge transport material and the specific solvent may be prepared separately, and then the mixed solution A may be mixed with the mixed solution B to prepare the composition. If the fluorine-containing resin particles are mixed with the fluorine-containing dispersant in the specific solvent, it is possible to sufficiently attach the fluorine-containing dispersant to the surface of the fluorine-containing resin particles.

Preparation of Protective Layer 5

The coating liquid for forming a protective layer (composition for forming a charge transporting film according to the present exemplary embodiment) is coated onto the surface to be coated (the charge transport layer 3 in the embodiment shown in FIG. 1), by general method such as blade coating, wire bar coating, spray coating, dip coating, bead coating, air knife coating, curtain coating, or ink jet coating.

Thereafter, light, electron beams or heat is applied to the obtained coating film so as to cause radical polymerization, thereby polymerizing and curing the coating film.

As the polymerizing and curing method, heat, light, radiation, and the like are used. When polymerization and curing are performed using heat and light, a polymerization initiator is not required, but a photocuring catalyst or a thermal polymerization initiator may be used. As the photocuring catalyst or the thermal polymerization initiator, known photocuring catalysts or thermal polymerization initiators are used. As the radiation, electron beams are preferable.

Electron Beam Curing

When electron beams are used, the accelerating voltage is preferably 300 KV or less and optimally 150 KV or less. In addition, a radiation dose preferably ranges from 1 Mrad to 100 Mrad and more preferably ranges from 3 Mrad to 50 Mrad. If the accelerating voltage is 300 KV or less, damage of characteristics of the photoreceptor caused by electron beam irradiation is inhibited. Moreover, if the radiation dose is 1 Mrad or more, crosslinking is sufficiently performed, and if it is 100 Mrad or less, deterioration of the photoreceptor is inhibited.

The irradiation is performed at an oxygen concentration 1000 ppm and preferably 500 ppm or less, in an atmosphere of inert gas such as nitrogen or argon. In addition, heating may be performed at 50° C. to 150° C. during or after the irradiation.

Photocuring

As a light source, a high-pressure mercury lamp, a low-pressure mercury lamp, a metal halide lamp, or the like is used, and a suitable wavelength may be selected using a filter such as a band pass filter. The irradiation time and light intensity are freely selected, and for example, illuminance (365 nm) is 300 mW/cm$^2$ or more and preferably 1000 mW/cm$^2$ or less. For example, when UV light of 600 mW/cm$^2$ is used for irradiation, irradiation may be performed 5 seconds to 360 seconds.

The irradiation is performed preferably at an oxygen concentration of 1000 ppm or less and more preferably 500 ppm or less, in an atmosphere of inert gas such as nitrogen or argon. In addition, heating may be performed at 50° C. to 150° C. during or after the irradiation.

Examples of intramolecular cleavage type photocuring catalysts include curing photocuring catalysts based on benzylketal, alkylphenone, aminoalkylphenone, phosphine oxide, titanocene, oxime, and the like.

More specifically, examples of the benzylketal photocuring catalyst include 2,2-dimethoxy-1,2-diphenylethan-1-one.

Examples of the alkylphenone photocuring catalyst include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone.

Examples of the aminoalkylphenone curing catalyst include p-dimethylaminoacetophenone, p-dimethylamino-propiophenone, 2-methyl-1-(4-methylthiophenyl)-2-morpholinopropan-1-one, 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone, and the like.

Examples of the phosphine oxide photocuring catalyst include 2,4,6-trimethylbenzoyl-diphenyl-phosphine oxide, bis(2,4,6-trimethylbenzoyl)-phenylphosphine oxide, and the like.

Examples of the titanocene photocuring catalyst include bis(η5-2,4-cyclopentadien-1-yl)-bis(2,6-difluoro-3-(1H-pyrrol-1-yl)-phenyl)titanium and the like.

Examples of the oxime photocuring catalyst include 1,2-octanedione, 1-[4-(phenylthio)-,2-(O-benzoyloxime)], ethanone, 1-[9-ethyl-6-(2-methylbenzoyl)-9H-carbazol-3-yl]-,1-(O-acetyloxime) and the like.

Examples of hydrogen abstraction type photocuring catalyst include photocuring catalysts based on benzophenone, thioxanthone, benzyl, Michler ketone, and the like.

More specifically, examples of the photocuring catalyst based on benzophenone include 2-benzoyl benzoate, 2-chlorobenzophenone, 4,4'-dichlorobenzophenone, 4-benzyol-4'-methyldiphenyl sulfide, p,p'-bisdiethylaminobenzophenone, and the like.

Examples of the thioxanthone photocuring catalyst include 2,4-diethylthioxanthen-9-one, 2-chlorothioxanthone, 2-isopropylthioxanthone, and the like.

Examples of the benzyl photocuring catalyst include benzyl, (±)-camphorquinone, p-anisil, and the like.

These photopolymerization initiators may be used alone or used in combination of two or more kinds thereof.

Thermal Curing

Examples of the thermal polymerization initiator include thermal radical generators and derivatives thereof. Specifically, the examples include azo initiators such as V-30, V-40, V-59, V601, V65, V-70, VF-096, VE-73, Vam-110, and Vam-111 (manufactured by Wako Pure Chemical Industries, Ltd.), $OT_{azo}$-15, $OT_{azo}$-30, AIBN, AMBN, ADVN, and ACVA (manufactured by Otsuka Chemical Co., Ltd.); Pertetra A, Perhexa HC, Perhexa C, Perhexa V, Perhexa 22, Perhexa MC, Perbutyl H, Percumyl H, Percumyl P, Permenta H, Perocta H, Perbutyl C, Perbutyl D, Perhexyl D, Peroyl IB, Peroyl 355, Peroyl L, Peroyl SA, Nyper BW, Nyper BMT-K40/M, Peroyl IPP, Peroyl NPP, Peroyl TCP, Peroyl OPP, Peroyl SBP, Percumyl ND, Perocta ND, Perhexyl ND, Perbutyl ND, Perbutyl NHP, Perhexyl PV, Perbutyl PV, Perhexa 250, Perocta O, Perhexyl O, Perbutyl O, Perbutyl L, Perbutyl 355, Perhexyl I, Perbutyl I, Perbutyl E, Perhexa 25Z, Perbutyl A, Perhexyl Z, Perbutyl ZT, and Perbutyl Z (manufactured by NOF CORPORATION), Kayaketal AM-055, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-KL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-050, Kayabutyl B, Kayacarbon EH-C70, Kayacarbon EH-W60, Kayacarbon I-20, Kayacarbon BIC-75, Trigonox 117, and Kayalene 6-70 (manufactured by KAYA AKZO CO., LTD.), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TRIC, Luperox TAEC, Luperox DC, Luperox 101, Luperox F, Luperox D1, Luperox 130, Luperox 220, Luperox 230, Luperox 233, and Luperox 531 and the like.

Among these, if an azo polymerization initiator having a molecular weight of 250 or more is used, the reaction proceeds at a low temperature without unevenness, and accordingly, a high-strength film in which unevenness is inhibited is formed. The molecular weight of the azo polymerization initiator is more suitably 250 or more and even more suitably 300 or more.

Heating is performed preferably at an oxygen concentration of 1000 ppm or less and more preferably at an oxygen concentration of 500 ppm or less in an atmosphere of inert gas such as nitrogen or argon. The heating temperature is preferably from 50° C. to 170° C. and more preferably from 70° C. to 150° C., and the heating is performed for preferably from 10 minutes to 120 minutes and more preferably from 15 minutes to 100 minutes.

The total content of the photocuring catalyst or the thermal polymerization initiator ranges preferably from 0.1% by weight to 10% by weight, more preferably from 0.1% by weight to 8% by weight, and even more preferably from 0.1% by weight to 5% by weight, based on the total solid contents of the solution for forming a layer.

In the present exemplary embodiment, if the reaction proceeds too fast, structural relaxation of the coating film is not easily caused due to cross-linking, and unevenness or wrinkles are easily caused in the film. For this reason, the thermal curing method in which radicals are relatively slowly generated is employed.

Particularly, if the specific reactive group-containing charge transport material is combined with the thermal curing, structural relaxation of the coating film is promoted, which makes it easy to obtain the protective layer 5 (uppermost surface layer) having excellent surface properties.

The film thickness of the protective layer 5 is preferably from about 3 μm to about 40 μm, and more preferably from 5 μm to 35 μm.

Next, constitutions other than the uppermost surface layer constituting the present exemplary embodiment will be described.

Conductive Supporter

Examples of the conductive supporter 4 include a metal plate, a metal drum, and a metal belt constituted with a metal such as aluminum, copper, zinc, stainless steel, chromium, nickel, molybdenum, vanadium, indium, gold, or platinum or an alloy.

Examples of the conductive supporter 4 also include paper, a plastic film, a belt and the like onto which a conductive compound such as a conductive polymer or indium oxide, a metal such as aluminum, palladium, or gold, or an alloy is coated, vapor-deposited, or laminated.

Herein, the word "conductive" means that volume resistivity is less than $10^{13}$ Ωcm.

When the electrophotographic photoreceptor 7A is used for a laser printer, in order to prevent interference fringes caused when laser beams are emitted, the surface of the conductive supporter 4 is preferably made into a rough surface having a center line average roughness Ra of from 0.04 μm to 0.5 μm. In addition, when incoherent light is used as a light source, it is not particularly necessary to roughen the surface to prevent the interference fringes.

As a method of roughening the surface, wet honing in which an abrading agent is suspended in water and sprayed onto a supporter, centerless grinding in which grinding is continuously performed while a supporter is being brought into contact with a spinning grindstone, anodization, or the like is preferable.

As another method of roughening the surface, a method is also preferably used in which conductive or semi-conductive powder is dispersed in a resin so as to form a layer on the surface of a supporter, and the surface is roughened using the particles dispersed in the layer, without roughening the surface of the conductive supporter 4.

Herein, in the surface roughening performed by anodization, anodization is conducted in an electrolyte solution by using aluminum as an anode, thereby forming an oxide film on the surface of aluminum. Examples of the electrolyte solution include a sulfuric acid solution, an oxalic acid solution, and the like. However, since the porous anodized oxide film formed by anodization is chemically active as is. Therefore, it is preferable to perform sealing in which the fine pores of the anodized oxide film are blocked by volume expansion caused by a hydration reaction in steam under pressure or in boiling water (a metal salt such as nickel may be added), thereby changing the film into a more stabilized hydrated oxide.

The film thickness of the anodized oxide film is preferably from 0.3 μm to 15 μm.

The conductive supporter 4 may also be treated with an aqueous acidic solution or boehmite. The treatment using an acidic treatment liquid containing phosphoric acid, chromic acid, and hydrofluoric acid is performed in the following manner.

First, the acidic treatment liquid is prepared. As a mixing ratio between the phosphoric acid, chromic acid, and hydrofluoric acid in the acidic treatment liquid, the phosphoric acid is in a range of from 10% by weight to 11% by weight, the chromic acid is in a range of from 3% by weight to 5% by weight, and the hydrofluoric acid is in a range of from 0.5% by weight to 2% by weight. The concentration of all these acids preferably ranges from 13.5% by weight to 18% by weight. The treatment temperature is preferably from 42° C. to 48° C., but if the treatment temperature is kept high, a thicker coat is formed more rapidly. The film thickness of the coat is preferably from 0.3 μm to 15 μm.

In the boehmite treatment, the conductive supporter 4 is preferably dipped in ultrapure water at 90° C. to 100° C. for 5 minutes to 60 minutes, or brought into contact with heated steam at 90° C. to 120° C. for 5 minutes to 60 minutes. The film thickness of the coat is preferably from 0.1 μm to 5 μm.

The obtained resultant may be anodized using an electrolyte solution having low coat solubility, such as adipic acid, boric acid, a boric acid salt, a phosphoric acid salt, a phthalic acid salt, a maleic acid salt, a benzoic acid salt, a tartaric acid salt, and a citric acid salt.

Undercoat Layer

The undercoat layer 1 is constituted with, for example, metal oxide particles and a binder resin, and has a thickness of 7 μm or more.

As the metal oxide particles, particles having powder resistance (volume resistivity) of from $10^2$ Ω·cm to $10^{11}$ Ω·cm are preferably used.

Among these, as the metal oxide particles having the resistance value described above, metal oxide particles such as tin oxide, titanium oxide, zinc oxide, and zirconium oxide are preferably used, and particularly, zinc oxide is preferably used.

The metal oxide particles may also be surface-treated, and two or more kinds of particles such as particles differing in types of the surface treatment or particles differing in the particle diameter may be used by being mixed.

The specific surface area of the metal oxide particles measured by a BET method is preferably 10 $m^2/g$ or more.

The volume average particle diameter of the metal oxide particles preferably ranges from 50 nm to 2000 nm (preferably from 60 nm to 1000 nm).

It is preferable that the undercoat layer further contains an acceptor compound together with the metal oxide particles.

The acceptor compound is not limited as long as the above characteristics are obtained, but charge transporting substances like a quinone compound such as chloranil or bromanil, a tetracyanoquinodimethane compound, a fluorenone compound such as 2,4,7-trinitrofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)1,3,4-oxadiazole, a xanthone compound, a thiophene compound; and a diphenoquinone compound such as 3,3',5,5'-tetra-t-butyl diphenoquinone are preferable. Particularly, compounds having an anthraquinone structure are preferable. In addition, acceptor compounds having an anthraquinone structure, such as a hydroxyanthraquinone compound, an aminoanthraquinone compound, and an aminohydroxyanthraquinone compound are preferably used, and specific examples thereof include anthraquinone, alizarin, quinizarin, anthrarufin, purpurin, and the like.

The content of these acceptor compounds is not limited as long as the content is in a range in which desired characteristics are obtained, but preferably, the acceptor compound is contained in a range of from 0.01% by weight to 20% by weight and more preferably in a range of from 0.05% by weight to 10% by weight, based on the metal oxide particles.

The acceptor compound may be simply added to a coating liquid for forming an undercoat layer, or may be attached onto the surface of the metal oxide particles in advance.

Examples of a method of attaching the acceptor compound onto the surface of the metal oxide particles include a dry method and a wet method.

When the surface treatment is performed by the dry method, while the metal oxide particles are being stirred with a mixer or the like having a strong shearing force, the acceptor compound is added dropwise thereto as it is or after dissolved in an organic solvent, and the resultant is sprayed together with dry air or nitrogen gas, whereby the surface is treated. The addition or spraying is performed preferably at a temperature equal to or lower than the boiling point of the solvent. After the addition or spraying, baking may be performed at 100° C. or a higher temperature. The baking is performed in an arbitrary range of temperature and time.

As the wet method, the metal oxide particles are dispersed in a solvent by stirring, ultrasonic waves, a sand mill, an attritor, a ball mill, or the like, and the acceptor compound is added thereto. Subsequently, the resultant is stirred or dispersed, and then the solvent is removed, whereby the surface is treated. As a method of removing the solvent, the solvent is removed by filtering or distillation. After the solvent is removed, baking may be further performed at 100° C. or a higher temperature. There is no particular limitation on the baking so long as the baking is performed at a temperature for a time by which desired electrophotographic characteristics are obtained. In the wet method, metal oxide particles-containing moisture may be removed before a surface treatment agent is added, and for example, a method of removing the moisture while stirring and heating the moisture in the solvent used for the surface treatment, or a method of removing the moisture by causing azeotropy of the solvent and moisture may be used.

The metal oxide particles may be surface-treated before the acceptor compound is imparted. As the surface treatment agent, any agent may be used as long as desired characteristics are obtained, and such agent is selected from known materials. Examples of the surface treatment agent include a silane coupling agent, a titanate coupling agent, an aluminum coupling agent, a surfactant, and the like. Particularly, a silane coupling agent is preferably used since excellent electrophotographic characteristics are obtained by this agent. Moreover, a silane coupling having an amino group is preferably used.

As the silane coupling agent having an amino group, any agent may be used so long as desired characteristics of an electrophotographic photoreceptor are obtained. Specific examples thereof include γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, and the like, but the invention is not limited thereto.

The silane coupling agent may be used as a mixture of two or more kinds thereof. Examples of the silane coupling agent that may be used concurrently with the silane coupling agent having an amino group include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, γ-chloropropyl trimethoxysilane, and the like, but the invention is not limited thereto.

Any method may be used as the surface treatment method using those surface treatment agents as long as the method is a known method, and the dry method or wet method is used. Moreover, imparting the acceptor compound and surface treatment performed using the surface treatment agent such as a silane coupling agent may be conducted at the same time.

The amount of the silane coupling agent based on the metal oxide particles in the undercoat layer 1 is not limited so long as desired electrophotographic characteristics are obtained. However, the amount is preferably from 0.5% by weight to 10% by weight based on the metal oxide particles.

As the binder resin contained in the undercoat layer 1, any known resin may be used as long as an excellent film is formed, and desired characteristics are obtained. For example, known polymeric resin compounds such as acetal resins like polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins, and known materials such as a zirconium chelate compound, a titanium chelate compound, an aluminum chelate compound, a titanium alkoxide compound, an organic titanium compound, and a silane coupling agent are used.

In addition, as the binder resin contained in the undercoat layer 1, charge transporting resins having a charge transporting group, conductive resins such as polyaniline, or the like may be used. Among these, resins insoluble in a coating solvent of the upper layer is suitable, and particularly, phenol resins, phenol-formaldehyde resins, melamine resins, urethane resins, epoxy resins, and the like are suitable. When these resins are used in combination of two or more kinds thereof, the mixing ratio is set optionally.

The proportion between the metal oxide particles (metal oxide particles to which an acceptor property has been imparted) in which the acceptor compound has been imparted to the surface thereof and the binder resin, or between the metal oxide particles and the binder resin in the coating liquid for forming an undercoat layer is set within a range in which the characteristics of the electrophotographic photoreceptor are obtained.

In addition, various additives may be used for the undercoat layer 1.

As the additives, known materials such as a polycyclic condensed type or azo electron transporting pigment, a zirconium chelate compound, a titanium chelate compound, an aluminum chelate compound, a titanium alkoxide compound, an organic titanium compound, and a silane coupling agent are used. Though used for surface treatment of the inorganic particles as described above, the silane coupling agent may also be further added as an additive to the coating liquid for forming an undercoat layer.

Specific examples of the silane coupling agent as an additive include vinyl trimethoxysilane, γ-methacryloxypropyltris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, γ-chloropropyl trimethoxysilane, and the like.

Examples of the zirconium chelate compound include zirconium butoxide, zirconium acetoethyl acetate, zirconium triethanolamine, acetylacetonate zirconium butoxide, acetoethyl acetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of the titanium chelate compound include tetraisopropyl titanate, tetra-n-butyl titanate, a butyl titanate dimer, tetra(2-ethylhexyl)titanate, titanium acetylacetonate, polytitanium acetylacetonate, titanium octylene glycolate, a titanium lactate ammonium salt, titanium lactate, titanium lactate ethyl ester, titanium triethanol aminate, polyhydroxy titanium stearate, and the like.

Examples of the aluminum chelate compound include aluminum isopropylate, monobutoxyaluminum diisopropylate, aluminum butyrate, diethyl acetoacetate aluminum diisopropylate, aluminum tris(ethylacetoacetate), and the like.

These compounds may be used alone, or used as a mixture or a polycondensate of plural compounds.

The solvent for preparing the coating liquid for forming an undercoat layer is arbitrarily selected from known organic solvents based on, for example, alcohols, aromatic compounds, halogenated hydrocarbons, ketones, ketone alcohols, ethers, esters, and the like.

Specifically, as the solvent, general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene are used, for example.

These solvents may be used alone or used as a mixture of two or more kinds thereof. When the solvents are mixed, any solvent may be used as long as the solvent is able to dissolve the binder resin as a mixed solvent.

As the method of dispersing the metal oxide particles in preparing the coating liquid for forming an undercoat layer, known methods such as a roll mill, a ball mill, a vibration ball mill, an attritor, a sand mill, a colloid mill, or a paint shaker are used.

As the coating method used for providing the undercoat layer 1, a general method such as blade coating, wire bar coating, spray coating, dip coating, bead coating, air knife coating, or curtain coating is used.

By using the coating liquid for forming an undercoat layer obtained in this manner, the undercoat layer 1 is formed on the conductive supporter.

The undercoat layer 1 has a thickness of 7 μm or more, but the thickness is preferably 15 μm or more and more preferably from 15 μm to 50 μm.

The undercoat layer 1 preferably has a Vickers' hardness of 35 or more.

The surface roughness (ten-point average roughness) of the undercoat layer 1 is preferably adjusted to ¼ n (n is a refractive index of the upper layer) to ½λ of a wavelength λ of a laser used for exposure.

In order to adjust the surface roughness, particles of a resin or the like may be added to the undercoat layer. As the resin particles, silicone resin particles, crosslinked polymethyl methacrylate resin particles, and the like are used.

Moreover, the surface of the undercoat layer may be polished to adjust the surface roughness. As the polishing method, buffing, sand blasting, wet honing, grinding, and the like are used. When an incoherent light source such as LED or an organic EL image array is used, a plat and smooth surface may be used.

By drying the coating liquid for forming an undercoat layer described above that has been coated onto the conductive supporter 4, the undercoat layer 1 is obtained. The drying is generally performed at a temperature at which a film may be formed by the evaporation of the solvent.

Charge Generating Layer

The charge generating layer 2 is a layer that contains the charge generating material and the binder resin. Moreover, the charge generating layer 2 may be formed as a vapor-deposition film not containing the binder resin. Particularly, this layer is preferable when an incoherent light source such as LED or an organic EL image array is used.

Examples of the charge generating material include an azo pigment such as bisazo or trisazo, a ring-condensed aromatic pigment such as dibromoanthanthrone, a perylene pigment, a pyrrolopyrrole pigment, a phthalocyanine pigment, zinc oxide, trigonal selenium, and the like. Among these, in order to respond to laser exposure of a near-infrared region, metallic and non-metallic phthalocyanine pigments are preferably used as the charge generating material. Particularly, hydroxy gallium phthalocyanine disclosed in JP-A—S—263007, JP-A—S—279591, and the like, chlorogallium phthalocyanine disclosed JP-A-5-98181, dichlorotin phthalocyanine disclosed in JP-A—S—11172 and JP-A—S—11173, titanyl phthalocyanine disclosed in JP-A-4-189873, JP-A—S—43823, and the like are more preferable. In addition, in order to respond to the laser exposure of a near-ultraviolet region, a ring-condensed aromatic pigment such as dibromoanthanthrone, a thioindigo pigment, a porphyrazine compound, zinc oxide, trigonal selenium, bisazo pigments disclosed in JP-A-2004-78147 and JP-A-2005-181992, and the like are more preferably used as the charge generating material.

Even when an incoherent light source such as LED having a central wavelength of emission at a wavelength of from 450 nm to 780 nm or an organic EL image array is used, the above charge generating materials may be used. However, in view of resolution, when the photosensitive layer is used in the form of a thin film of 20 μm or less, the intensity of electric field in the photosensitive layer is increased, hence decrease in charge caused by the charge injected from a substrate and image defect which is so-called black spots easily occur.

The above phenomenon is markedly caused when charge generating materials that easily cause a dark current in p-type semiconductors such as trigonal selenium and a phthalocyanine pigment are used.

On the other hand, when n-type semiconductors such as a ring-condensed aromatic pigment, a perylene pigment, and an azo pigment are used, a dark current is not easily caused, and the image defect called black spots may be inhibited even in a thin film.

If a flat and smooth substrate and an undercoat layer are formed using an incoherent light source such as LED having a central wavelength of emission at a wavelength of from 450 nm to 780 nm or an organic EL image array, and an n-type charge generating material is used, even if the photosensitive layer is made into a thin film of 20 μm or less, image defect does not occur, and images with a high resolution may be obtained for a long time.

Specific examples of the n-type charge generating material are shown below, but the invention is not limited thereto. In addition, whether a charge generating material is an n-type is determined by the polarity of the photocurrent flowing, by using a time-of-flight method used generally. A material in which electrons flow more easily than holes do is determined to be an n-type.

Structural Formula

CG-1

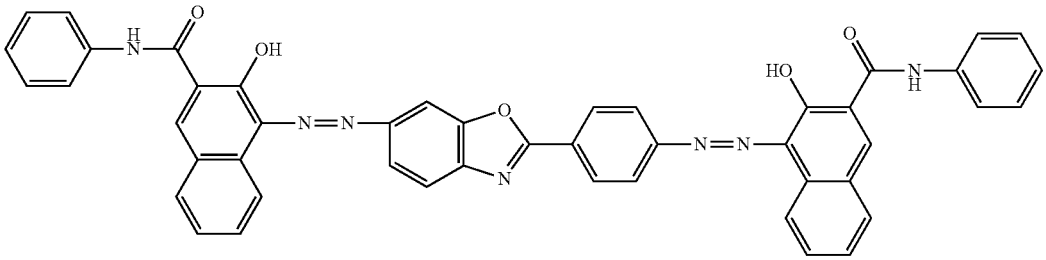

CG-2

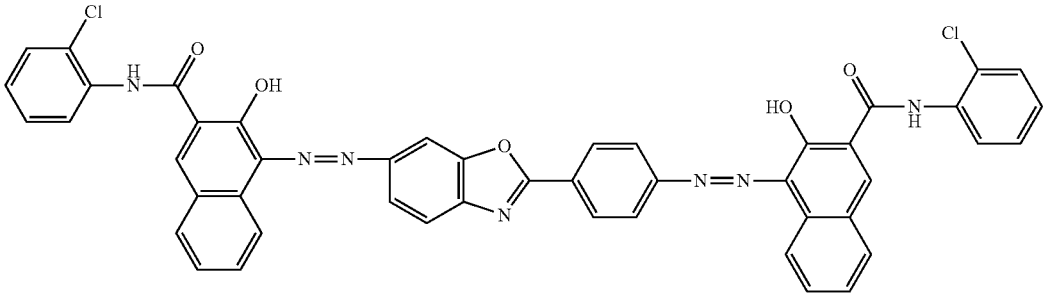

CG-3

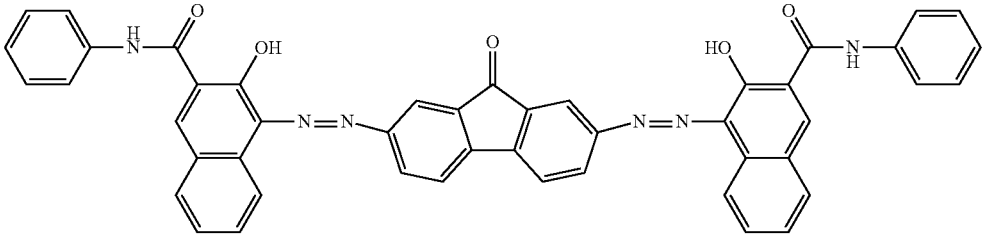

-continued
| | Structural Formula |
|---|---|
| CG-4 | 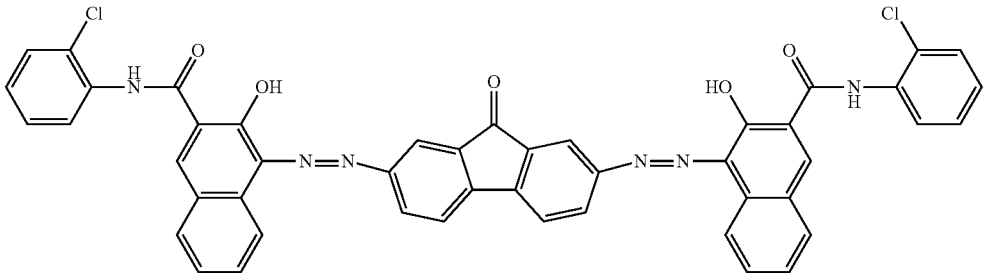 |
| CG-5 | 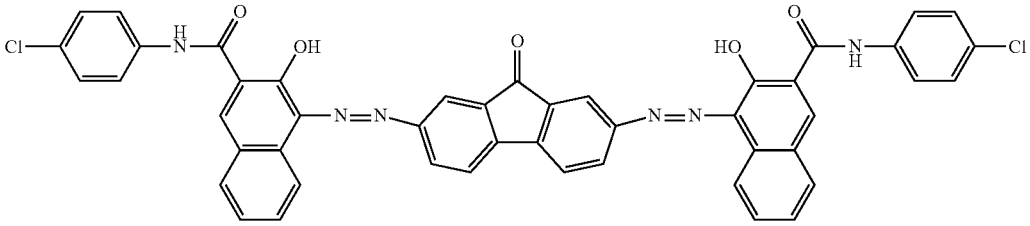 |
| CG-6 | 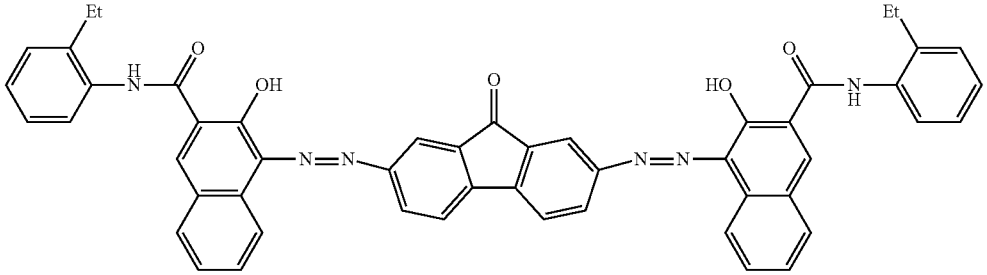 |
| CG-7 | 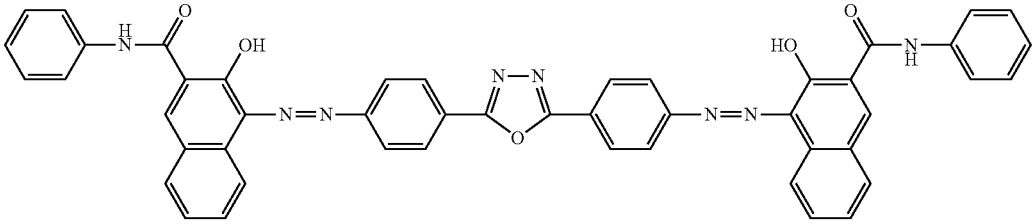 |
| CG-8 | 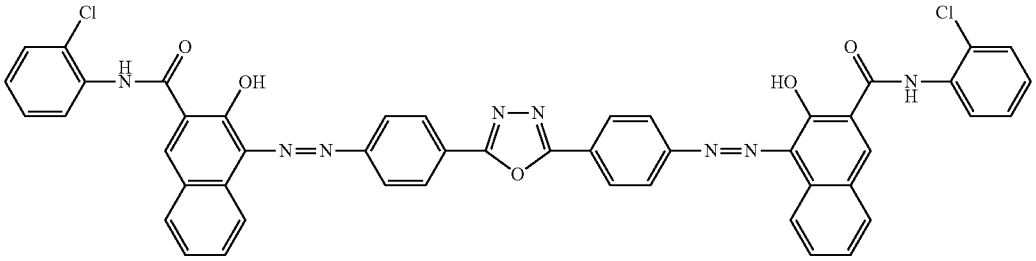 |
| CG-9 | 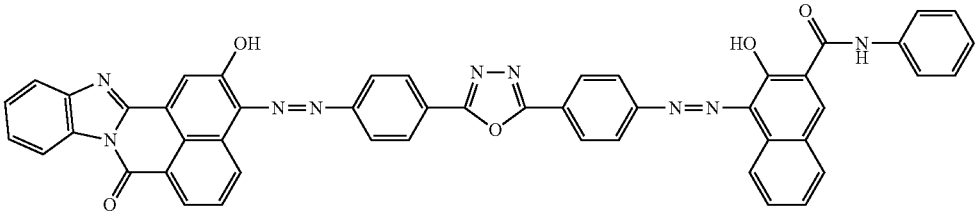 |

-continued
| Structural Formula | |
|---|---|
| CG-10 | 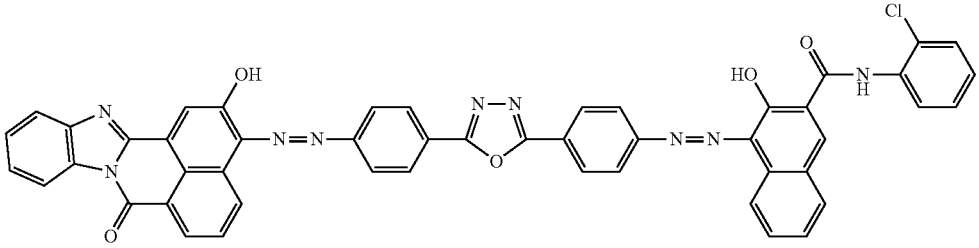 |
| CG-11 | 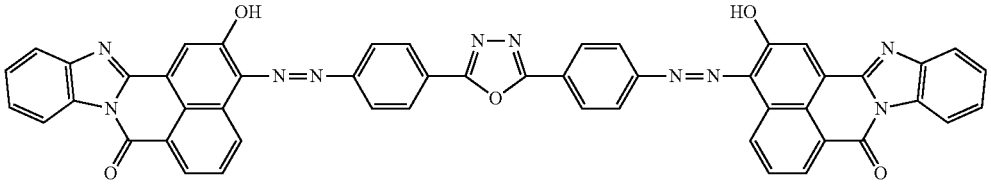 |
| CG-12 | 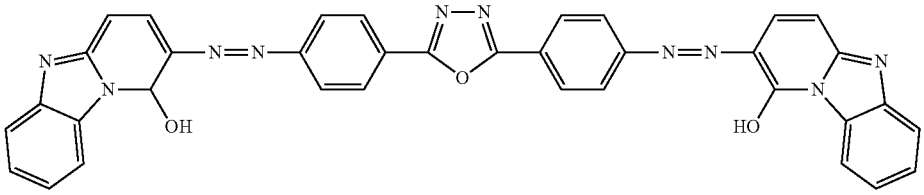 |
| CG-13 | 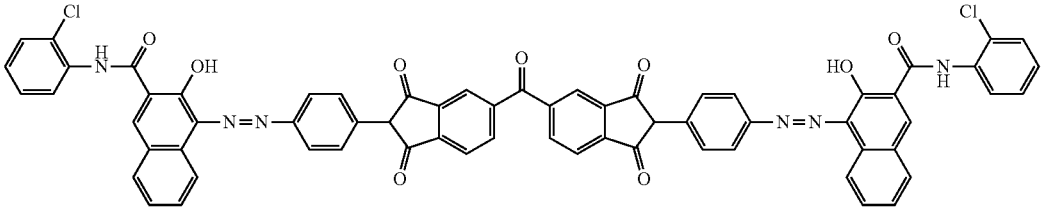 |
| CG-14 | 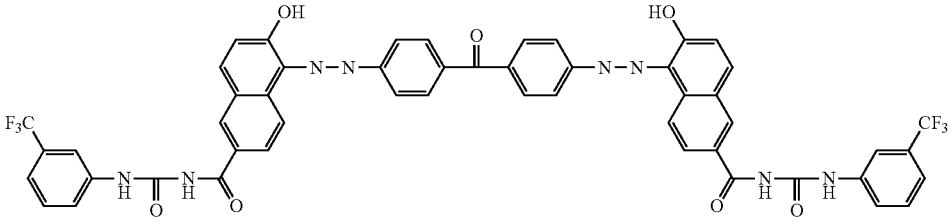 |
| CG-15 | 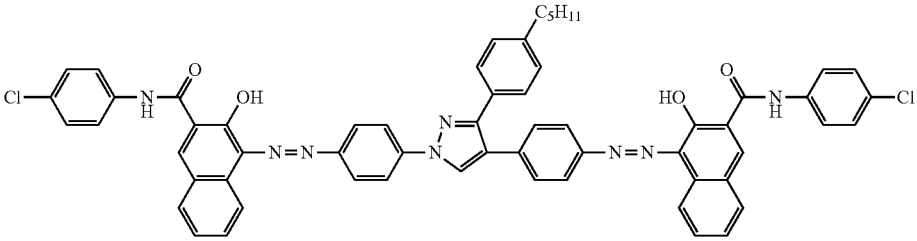 |
| CG-16 | 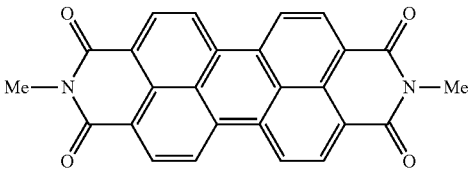 |

-continued
| | Structural Formula |
|---|---|
| CG-17 | 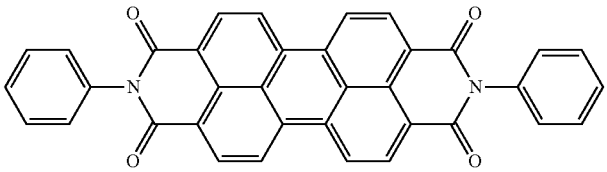 |
| CG-18 | 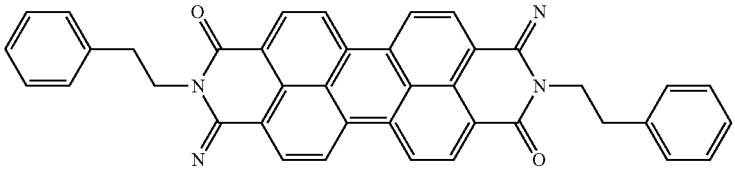 |
| CG-19 | 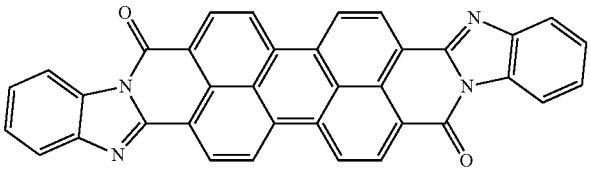 |
| CG-20 | 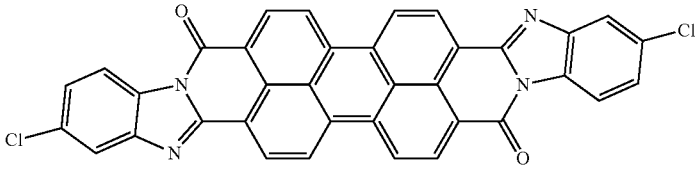 |
| CG-21 | 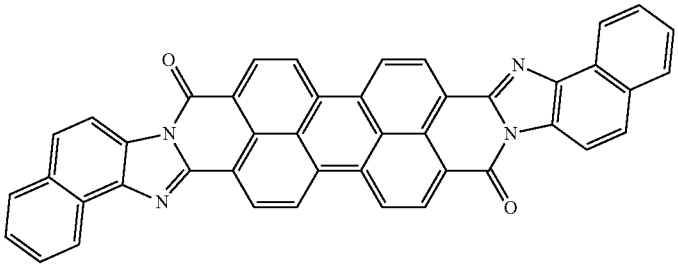 |
| CG-22 | 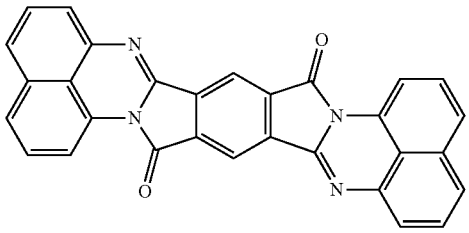 |
| CG-23 | 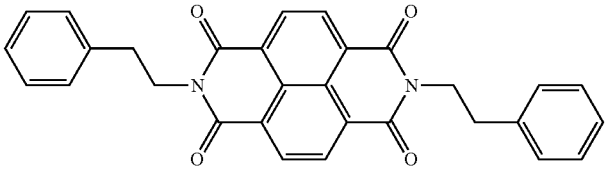 |
| CG-24 | 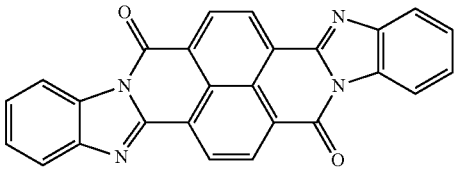 |

-continued

| | Structural Formula |
|---|---|
| CG-25 | 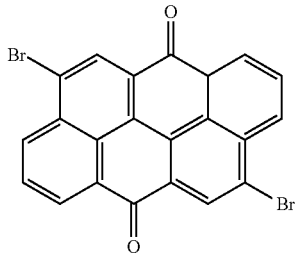 |
| CG-26 | 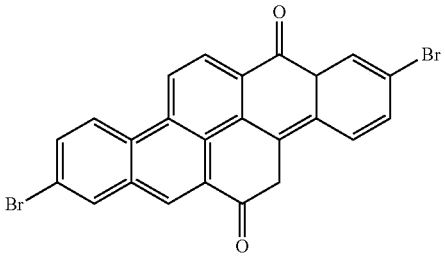 |
| CG-27 | 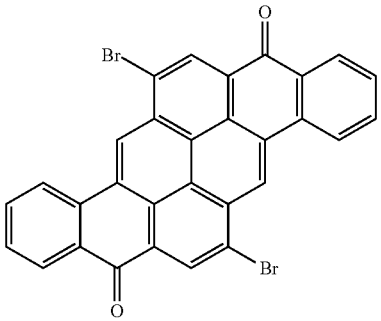 |

The binder resin used for the charge generating layer 2 is selected from a wide range of insulating resins. Moreover, the binder resin may be selected from organic photoconductive polymers such as poly-N-vinylcarbazole, polyvinylanthracene, polyvinylpyrene, and polysilane. Examples of preferable binder resins include polyvinyl butyral resins, polyarylate resins (a polycondensate or the like of bisphenols and aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, polyvinyl pyrrolidone resins, and the like. These binder resins may be used alone or used as a mixture of two or more kinds thereof. The mixing ratio between the charge generating material and the binder resin is preferably ranges from 10:1 to 1:10, in terms of a weight ratio. Herein, the word "insulating" means that the volume resistivity is $10^{13}$ Ωcm or greater.

The charge generating layer 2 is formed using the coating liquid for forming a charge generating layer obtained by dispersing the above charge generating material and the binder resin in a predetermined solvent. In addition, the charge generating layer 2 may be formed as a vapor-deposition film not containing the binder resin, and particularly, a ring-condensed aromatic pigment or a perylene pigment may be preferably used as the vapor-deposition film.

Examples of the solvent used for the dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxanone, tetrahydrofuran, methylene chloride, chloroform, chlorobenzene, toluene, and the like. These solvents may be used alone or used as a mixture of two or more kinds thereof.

As the method of dispersing the charge generating material and the binder resin in a solvent, general methods such as a ball mill dispersing, attritor dispersing, sand mill dispersing, and the like are used. By these dispersing methods, the change of the form of crystals of the charge generating material caused by the dispersion is prevented.

During the dispersion, it is effective to set the average particle diameter of the charge generating material to 0.5 μm or less, preferably 0.3 μm or less, and more preferably 0.15 μm or less.

In forming the charge generating layer 2, general methods such as blade coating, wire bar coating, spray coating, dip coating, bead coating, air knife coating, and curtain coating are used.

The film thickness of the charge generating layer 2 obtained in this manner is preferably from 0.1 μm to 5.0 μm, and more preferably from 0.2 μm to 2.0 μm.

Charge Transport Layer

The charge transport layer 3 is formed by containing the charge transport material and the binder resin, or containing a polymeric charge transport material.

Examples of the charge transport material include electron transporting compounds like quinone compounds such as p-benzoquinone, chloranil, bromanil and anthraquinone, a tetracyanoquinodimethane compound, fluorenone compounds such as 2,4,7-trinitrofluorenone, a xanthone compound, a benzophenone compound, a cyanovinyl compound, and an ethylene compound; and hole-transporting compounds such as a triarylamine compound, a benzidine compound, an arylalkane compound, an aryl-substituted ethylene compound, a stilbene compound, an anthracene compound, and a hydrazone compound. These charge transport materials may be used alone or used as a mixture of two or more kinds thereof, but the invention is not limited thereto.

As the charge transport material, a triarylamine derivative represented by the following Structural Formula (a-1), and a benzidine derivative represented by the following Structural Formula (a-2) are preferable, in view of the charge mobility.

(a-1)

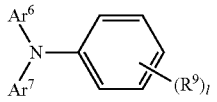

In the Structural Formula (a-1), $R^9$ represents a hydrogen atom, a methyl group, —C($R^{10}$)=C($R^{11}$)($R^{12}$), or —CH=CH—CH=C($R^{13}$)($R^{14}$). 1 represents 1 or 2. Each of $Ar^6$ and $Ar^7$ independently represents a substituted or unsubstituted aryl group, —$C_6H_4$—C($R^{10}$)=C($R^{11}$)($R^{12}$), or —$C_6H_4$—CH=CH—CH=C($R^{13}$)($R^{14}$), and each of $R^{10}$, $R^{11}$, $R^{12}$, $R^{13}$, and $R^{14}$ independently represents a hydrogen atom, a substituted or unsubstituted alkyl group, or a substituted or unsubstituted aryl group.

Examples of substituents of each of the above groups include a halogen atom, an alkyl group having 1 to 5 carbon atoms, an alkoxy group having 1 to 5 carbon atoms, and a substituted amino group substituted with an alkyl group having 1 to 3 carbon atoms.

(a-2)

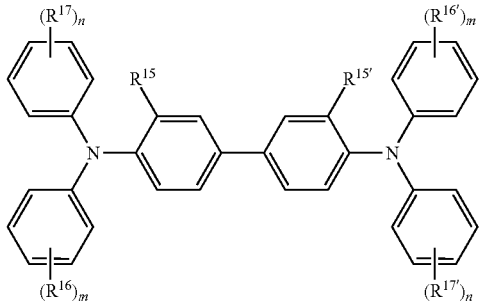

In the Structural Formula (a-2), each of $R^{15}$ and $R^{15'}$ independently represents a hydrogen atom, a halogen atom, an alkyl group having 1 to 5 carbon atoms, or an alkoxy group having 1 to 5 carbon atoms. Each of $R^{16}$, $R^{16'}$, $R^{17}$ and $R^{17'}$ independently represents a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, C($R^{18}$)=C($R^{19}$)($R^{20}$), or —CH=CH—CH=C($R^{21}$)($R^{22}$). Each of $R^{18}$, $R^{19}$, $R^{20}$, $R^{21}$, and $R^{22}$ independently represents a hydrogen atom, a substituted or unsubstituted alkyl group, or a substituted or unsubstituted aryl group. Each of m and n independently represents an integer of 0 to 2.

Among the triarylamine derivative represented by Structural Formula (a-1) and the benzidine derivative represented by Structural Formula (a-2), a triarylamine derivative having "—$C_6H_4$—CH=CH—CH=C($R^{13}$)($R^{14}$)" and a benzidine derivative having "—CH=CH—CH=C($R^{21}$)($R^{22}$)" are particularly preferable, since these are excellent in view of charge mobility, adhesiveness to the protective layer, a ghost image (hereinbelow, referred to as a "ghost" in some cases) caused by the history of the previous image remaining, and the like.

Examples of the binder resin used for the charge transport layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinyl carbozole, polysilane, and the like. The polyester polymeric charge transport material and the like disclosed in JP-A-8-176293 and JP-A-8-208820 may also be used. Among these, polycarbonate resins or polyarylate resins are suitable.

These binder resins are used alone or used as a mixture of two or more kinds thereof. The mixing ratio between the charge transport material and the binder resin is preferably from 10:1 to 1:5 in terms of a weight ratio.

Particularly, when the protective layer (uppermost surface layer) including the cured film of the composition that contains the reactive charge transport material and a polycarbonate resin is provided onto the charge transport layer 3, the viscosity average molecular weight of the binder resin used for the charge transport layer 3 is preferably 50000 or more and more preferably 55000 or more.

The upper limit of the viscosity average molecular weight of the binder resin used for the charge transport layer 3 is preferably 100000 or less.

Herein, the viscosity average molecular weight of the binder resin in the exemplary embodiment is a value that is measured by a capillary viscometer.

In addition, when the uppermost surface layer is the charge transport layer, the viscosity average molecular weight of the binder resin included in the layer below the charge transport layer is preferably in the above-described range.

A polymeric charge transport material may be used as the charge transport material. As the polymeric charge transport material, known materials having the charge transporting property such as poly-N-vinylcarbozole, polysilane, and the like are used. Particularly, the polyester polymeric charge transport material disclosed in JP-A-8-176293, JP-A-8-208820, and the like is particularly preferable. The polymeric charge transport material may form a film as is, but it may be mixed with the binder resin to form a film.

The charge transport layer 3 is formed using a coating liquid for forming a charge transporting layer that contains the above-described constituent materials.

As the solvent used for the coating liquid for forming a charge transporting layer, general organic solvents like aromatic hydrocarbons such as benzene, toluene, xylene, and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether are used alone or used as a mixture of two or more kinds thereof. As the method of dissolving the respective constituent materials, known methods are used.

As the coating method for coating the coating liquid for forming a charge transporting layer onto the charge transport layer 3, general methods such as blade coating, wire bar coating, spray coating, dip coating, bead coating, air knife coating, and curtain coating are used.

The film thickness of the charge transport layer 3 is preferably from 5 μm to 50 μm, and more preferably from 10 μm to 30 μm.

So far, the constitution of each layer in the functional separation type photosensitive layer has been described with reference to the electrophotographic photoreceptor 7A shown in FIG. 1, and this constitution may be applied to each layer in the functional separation type electrophotographic photoreceptor 7B shown in FIG. 2. In addition, in a case of the single layer type photosensitive layer 6 of the electrophotographic photoreceptor 7C shown in FIG. 3, the following embodiment is preferably employed.

That is, the content of the charge generating material in the single layer type photosensitive layer 6 is preferably from 5% by weight to 50% by weight, more preferably from 10% by weight to 40% by weight, and particularly preferably from 15% by weight to 35% by weight, based on the total solid contents of the composition used for forming the protective layer (uppermost surface layer) 5.

As the method of forming the single layer type photosensitive layer 6, the formation method used in the charge generating layer 2 or the charge transport layer 3 may be employed. The film thickness of the single layer type photosensitive layer 6 is preferably from 5 μm to 50 μm and more preferably from 10 μm to 40 μm.

In the above exemplary embodiment, an exemplary embodiment in which the protective layer 5 is the uppermost surface layer was described. However, when the protective layer 5 is not included in the layer constitution, the charge transport layer positioned in the uppermost surface in the layer constitution becomes the uppermost surface layer. When the charge transport layer is the uppermost surface layer, the thickness of the layer is preferably from 7 μm to 70 μm and more preferably from 10 μm to 60 μm.

Image Forming Apparatus/Process Cartridge

The process cartridge according to the exemplary embodiment may include the electrophotographic photoreceptor according to the exemplary embodiment, and at least one unit selected from a group consisting of A) a charging unit that charges a surface of the electrophotographic photoreceptor, B) a latent image forming unit that forms an electrostatic latent image on a charged surface of the electrophotographic photoreceptor, C) a developing unit that develops the electrostatic latent image formed on the surface of the electrophotographic photoreceptor by using a toner to form a toner image, D) a transfer unit that transfers the toner image formed on the surface of the electrophotographic photoreceptor to a recording medium, and E) a cleaning unit that cleans the electrophotographic photoreceptor.

The image forming apparatus according to the exemplary embodiment may include the electrophotographic photoreceptor according to the exemplary embodiment; a charging unit that charges a surface of the electrophotographic photoreceptor; a latent image forming unit that forms an electrostatic latent image on a charged surface of the electrophotographic photoreceptor; a developing unit that develops the electrostatic latent image formed on the surface of the electrophotographic photoreceptor by using a toner to form a toner image; and a transfer unit that transfers the toner image formed on the surface of the electrophotographic photoreceptor to a recording medium.

Figure 4:
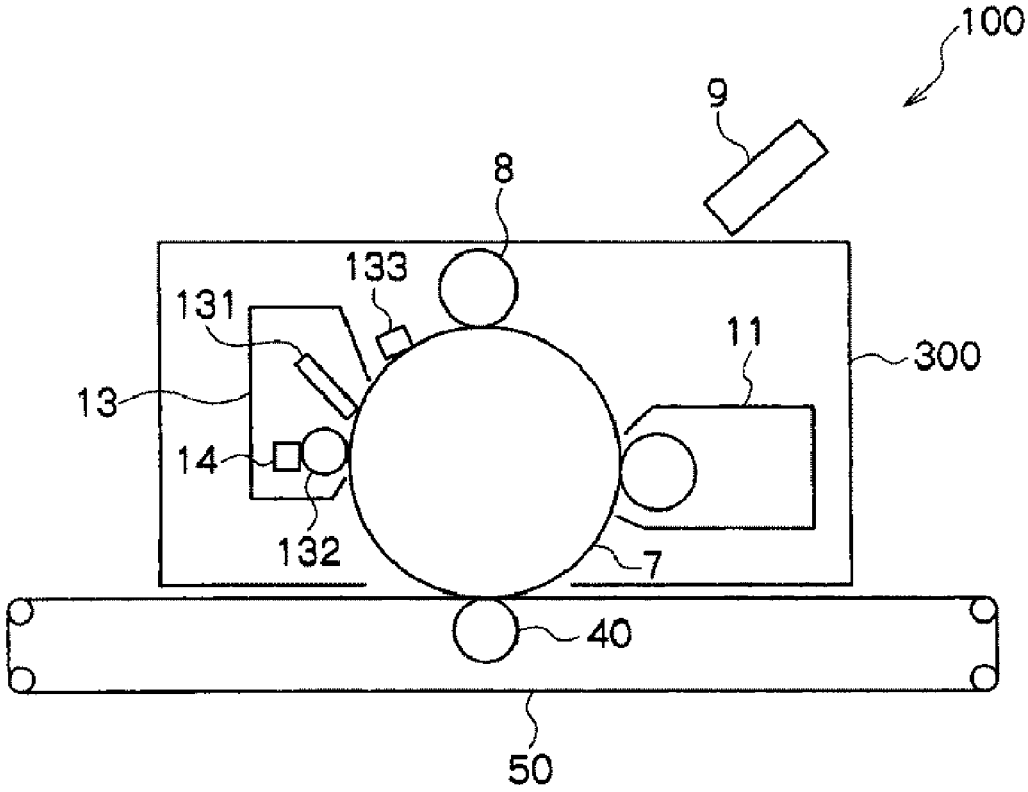
FIG. 4 is a schematic constitutional view showing an example of an image forming apparatus according to the present exemplary embodiment.

FIG. 4 is a schematic constitutional view showing an image forming apparatus 100 according to a first exemplary embodiment.

The image forming apparatus 100 shown in FIG. 4 includes a process cartridge 300 provided with an electrophotographic photoreceptor 7, an exposure device (electrostatic latent image forming unit) 9, a transfer device (transfer unit) 40, and an intermediate transfer member 50. In the image forming apparatus 100, the exposure device 9 is disposed in a position for exposing the electrophotographic photoreceptor 7 through an opening portion of the process cartridge 300, the transfer device 40 is disposed in a position where the transfer device 40 faces the electrophotographic photoreceptor 7 across the intermediate transfer member 50, and the intermediate transfer member 50 is disposed while a portion thereof is in contact with the electrophotographic photoreceptor 7.

The process cartridge 300 in FIG. 4 integrally supports the electrophotographic photoreceptor 7, a charging device (charging unit) 5, a developing device (developing unit) 11, and a cleaning device 13 inside a housing. The cleaning device 13 includes a cleaning blade (cleaning member), and a cleaning blade 131 is disposed so as to contact the surface of the electrophotographic photoreceptor 7. The cleaning member is not limited to the embodiment of cleaning blade 131. The cleaning member may be a conductive or insulating fibrous member, and this fibrous member may be used alone or used concurrently with a blade.

FIG. 4 shows an example that includes fibrous member 132 (roll shape) supplying a lubricant 14 to the surface of the photoreceptor 7 as the cleaning device 13, and uses a fibrous member 133 (flat brush shape) assisting cleaning, but these are optionally used.

As the charging device 8, for example, a contact type charger using a conductive or semiconductive charging roll, a charging brush, a charging film, a charging rubber blade, a charging tube, or the like is used. In addition, known chargers such as a non-contact type of roll charger, a scorotron charger using corona discharge, and a corotron charger may also be used.

Though not shown in the drawing, a photoreceptor heating member for increasing the temperature of the electrophotographic photoreceptor 7 and reducing a relative temperature is provided around the electrophotographic photoreceptor 7 so as to heighten the image stability.

Examples of the exposure device 9 include an optical system instrument or the like that exposes a desired image with light such as a semiconductor laser beam, LED light, or liquid crystal shutter light on the surface of the photoreceptor 7. As the wavelength of a light source, wavelengths in a spectrophotometric region of the photoreceptor are used. As the wavelength of the semiconductor laser, near infrared having an oscillation wavelength near 780 nm is used in most cases. However, the wavelength is not limited thereto, and lasers such as a laser having an oscillation wavelength of about 600 nm and a blue laser having an oscillation wavelength near 400 nm to 450 nm may also be used. In addition, in order to form color images, a surface-emitting type of laser beam source which realizes multi-beam output is also effective.

As the developing device 11, for example, a general developing device may be used which performs developing by bringing or not brining a magnetic or non-magnetic single-component or two-component developer or the like into contact with the photoreceptor. The developing device is not limited as long as it has the function described above, and is selected according to purposes. For example, a known developing device or the like is used which has a function of attaching the single-component or two-component developer to the photoreceptor 7 by using a brush, a roll, or the like. Among these, a developing device that uses a developing roll holding the developer on the surface thereof is preferable.

Hereinafter, a toner used for the developing device 11 will be described.

The average shape factor ($ML^2/A\times\pi/4\times100$, ML herein represents a maximum length of the toner particles, and A represents a projected area of the toner particles) of the toner is preferably from 100 to 150, and more preferably from 100 to 140. The volume average particle diameter of the toner is preferably from 2 μm to 12 μm, more preferably from 3 μm to 12 μm, and even more preferably from 3 μm to 9 μm. If the toner satisfying the above-described average shape factor and volume average particle diameter is used, images having a higher developing property, transfer property, and image quality are obtained, compared to other toners.

The toner is not particularly limited in terms of the production method, as long as the toner is within a range that satisfies the average shape factor and volume average particle diameter described above. For example, a toner is used which is prepared by a kneading and pulverizing method that kneads, pulverizes, and classifies a mixture of a binder resin, a colorant, a release agent, and optionally a charge-controlling agent; a method that changes the shape of the particles obtained by the kneading and pulverizing method by using mechanical impact or heat energy; an emulsion polymerization aggregation method in which polymerizable monomers of a binder resin are emulsion-polymerized to form a dispersion, the dispersion is mixed with a dispersion of a colorant, a release agent, optionally a charge-controlling agent, and the like, followed by aggregation and heat melting, thereby obtaining toner particles; a suspension polymerization method in which polymerizable monomers for obtaining a binder resin, and a solution of a colorant, a release agent, optionally a charge-controlling agent, and the like are suspended in an aqueous solvent, followed by polymerization; a dissolution suspension method in which a binder resin, a colorant, a release agent, optionally a solution of a charge-controlling agent, and the like are suspended in an aqueous solvent to prepare particles; or the like.

In addition, a known method such as a preparation method that forms a core shell structure by further attaching aggregated particles to the toner as a core obtained by the above-described method and performing heat coalescing may also be used. As the preparation method of a toner, the suspension polymerization method preparing a toner by using an aqueous solvent, the emulsion polymerization aggregation method, and the dissolution suspension method are preferable, and particularly, the emulsion polymerization aggregation method is preferable, in view of controlling shape and particle size distribution.

The toner particles contain a binder resin, a colorant, and a release agent, and further contain silica or the charge-controlling agent if necessary.

Examples of the binder resin used for the toner particles include homopolymers or copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, vinyl ketones such as vinyl methyl ketone, vinyl hexyl ketone, and vinyl isopropenyl ketone, and polyester resins obtained by copolymerizing dicarboxylic acids with diols, and the like.

Particularly, examples of typical binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, a polyester resin, and the like. The examples further include polyurethane, an epoxy resin, a silicone resin, polyamide, modified rosin, a paraffin wax, and the like.

Examples of typical colorants include magnetic powder such as magnetite and ferrite, carbon black, aniline blue, calco oil blue, chrome yellow, ultramarine blue, DuPont oil red, quinoline yellow, methylene blue chloride, phthalocyanine blue, malachite green oxalate, lamp black, rose bengal, C. I. pigment red 48:1, C. I. pigment red 122, C. I. pigment red 57:1, C. I. pigment yellow 97, C. I. pigment yellow 17, C. I. pigment blue 15:1, C. I. pigment blue 15:3, and the like.

Examples of typical release agents include low-molecular weight polyethylene, low-molecular weight polypropylene, Fischer-Tropsch wax, montan wax, carnauba wax, rice wax, candelilla wax, and the like.

As the charge-controlling agent, known agents are used, and an azo metal complex compound, a metal complex compound of salicylic acid, and a resin type charge-controlling agent containing a polar group may be used. When the toner is prepared by a wet preparation method, it is preferable to use a material that is not easily dissolved in water so as to control ionic strength and reduce waste water contamination. In addition, the toner may be either a magnetic toner containing a magnetic material or a non-magnetic toner not containing a magnetic material.

The toner used for the developing device 11 is prepared by mixing the toner particles with the external additives described above by using a Henschel mixer or a V blender. When the toner particles are prepared by a wet method, the particles may be externally added by the wet method.

Lubricant particles may be added to the toner used for the developing device 11. As the lubricant particles, solid lubricants such as graphite, molybdenum disulfide, talc, fatty acid, and a fatty acid metal salt, low-molecular weight polyolefins such as polypropylene, polyethylene, and polybutene, silicones obtaining a softening point by heating, aliphatic amides such as oleic acid amide, erucic acid amide, ricinoleic acid amide, and stearic acid amide, plant waxes such as carnauba wax, rice wax, candelilla wax, Japanese wax, and jojoba oil, animal wax such as beeswax, mineral and petroleum waxes such as montan wax, ozokerite, ceresin, a paraffin wax, a micro-crystalline wax, and Fischer-Tropsch wax, and a modified product thereof are used. These may be used alone or used in combination of two or more kinds thereof. Here, the volume average particle diameter thereof preferably ranges from 0.1 μm to 10 μm, and the uniform particle size may be obtained by pulverizing particles having the chemical structure described above. The amount of the lubricant particles added to the toner is preferably ranges from 0.05% by weight to 2.0% by weight, and more preferably ranges from 0.1% by weight to 1.5% by weight.

Inorganic particles, organic particles, complex particles which are obtained by attaching inorganic particles to the organic particles, and the like may be added to the toner used for the developing device 11, so as to remove substances attached to the surface of the electrophotographic photoreceptor or remove deteriorated substances, for example.

As the inorganic particles, various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride are suitably used.

The inorganic particles may be treated with titanium coupling agents such as tetrabutyl titanate, tetraoctyl titanate, isopropyl triisostearoyl titanate, isopropyl tridecyl benzenesulfonyl titanate, and bis(dioctylpyrophosphate)oxyacetate titanate, and silane coupling agents such as γ-(2-aminoethyl) aminopropyl trimethoxysilane, γ-(2-aminoethyl)aminopropyl methyl dimethoxysilane, γ-methacryloxypropyl trimethoxysilane, an N-β-(N-vinylbenzylaminoethyl)γ-aminopropyl trimethoxysilane hydrochloric acid salt, hexamethyldisilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, and p-methylphenyl trimethoxysilane. In addition, inorganic particles treated for hydrophobization by using higher fatty acid metal salts such as silicone oil, aluminum stearate, zinc stearate, and calcium stearate are also preferably used.

As the organic particles, particles of fluorocarbons in which fluorine binds to black lead or graphite, a polytetrafluoroethylene resin (PTFE), a fluorinated perfluoroalkoxy resin (PFA), a tetrafluoroethylene-pentafluoropropylene copolymer (FEP), ethylene-tetrafluoroethylene copolymer (ETFE), polychlorotrifluoroethylene (PCTFE), vinylidene fluoride (PVDF), vinyl fluoride (PVF), and the like are used.

The size of the particles used is preferably from 5 nm to 1000 nm, more preferably from 5 nm to 800 nm, and even more preferably from 5 nm to 700 nm, in terms of a volume average particle diameter. If the volume average particle diameter is less than the lower limit described above, a polishing ability tends to deteriorate. On the other hand, if the volume average particle diameter exceeds the upper limit described above, the surface of the electrophotographic photoreceptor tends to be easily scratched. The sum of the added amount of particles and lubricant particles described above is preferably 0.6% by weight or more.

As other inorganic oxides added to the toner, small size inorganic oxides having a primary particle diameter of 40 nm or less are used, in view of powder fluidity, charge control, and the like. It is preferable to further add inorganic oxides having a size larger than that of the above oxides so as to reduce an adhesive force or to control charge. Known oxides may be used as the inorganic oxide particles, but for precise charge control, it is preferable to concurrently use silica and titanium oxide. If the small sized inorganic particles are surface-treated, dispersibility is improved, and an effect of improving powder fluidity is enhanced. In addition, adding carbonate such as calcium carbonate or magnesium carbonate or inorganic mineral such as hydrotalcite is also preferable for removing corona products.

The color toner for electrophotography is used by being mixed with a carrier, and as the carrier, iron powder, glass beads, ferrite powder, nickel power, or a substance obtained by coating a resin onto the surface of the carrier is used. The mixing ratio between the color toner and the carrier is set arbitrarily.

Examples of the transfer device 40 include known transfer chargers such as a contact-type transfer charger using a belt, a roll, a film, a rubber blade, or the like, a scorotron transfer charger using corona discharge, and a corotron transfer charger.

As the intermediate transfer member 50, semiconductivity-imparted polyimide, polyamideimide, polycarbonate, polyarylate, polyester, or rubber, which is shaped like a belt (intermediate transfer belt), is used. In addition, as an embodiment of the intermediate transfer member 50, a drum-like member is used in addition to the belt-like member.

The image forming apparatus 100 may include, for example, an optical erasing device that performs optical erasing on the photoreceptor 7, in addition to the respective devices described above.

Figure 5:
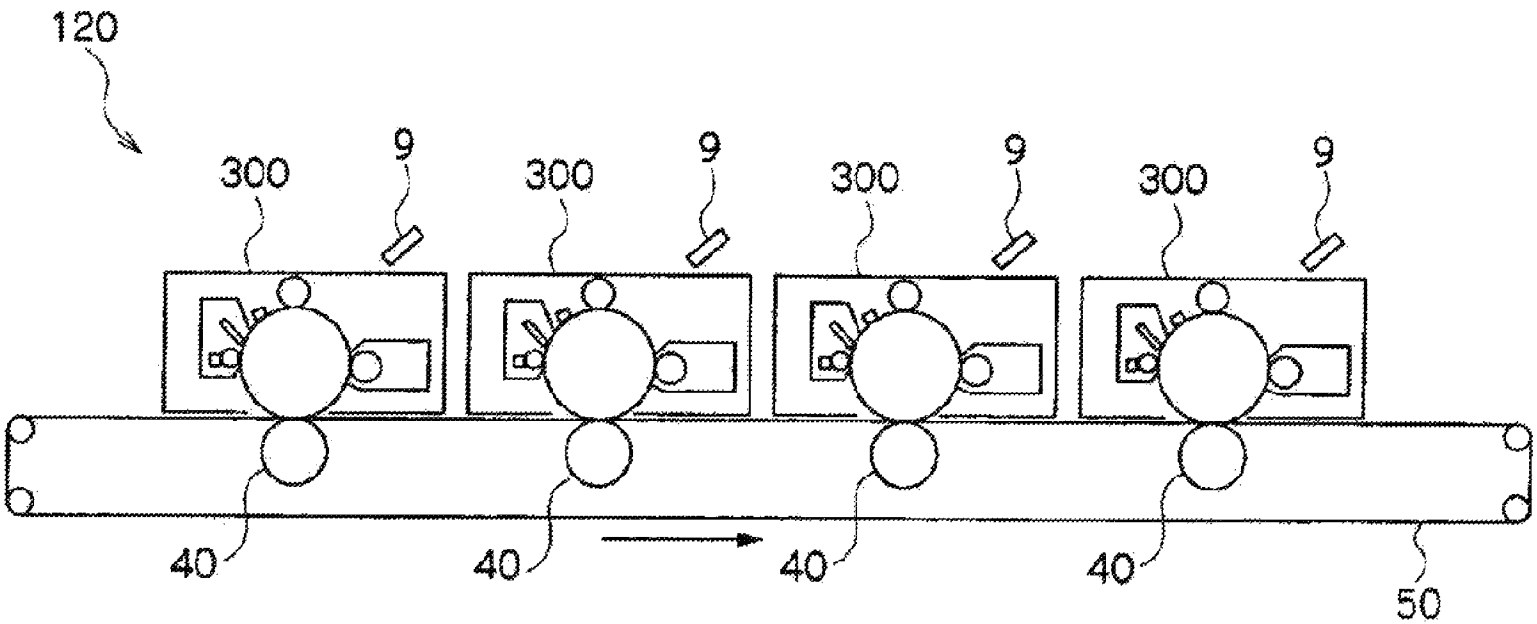
FIG. 5 is a schematic constitutional view showing an example of a tandem type image forming apparatus according to the present exemplary embodiment.

FIG. 5 is a schematic cross-sectional view showing an image forming apparatus 120 according to another exemplary embodiment.

The image forming apparatus 120 shown in FIG. 5 is a tandem type full color image forming apparatus on which four process cartridges 300 are mounted.

The image forming apparatus 120 has a constitution in which the four process cartridges 300 are arranged on the intermediate transfer member 50 in parallel, and one electrophotographic photoreceptor is used for a color. The image forming apparatus 120 has the same constitution as that of the image forming apparatus 100, except that the image forming apparatus 120 is a tandem type.

When the electrophotographic photoreceptor of the present exemplary embodiment is used for the tandem type image forming apparatus, since the electrical characteristics of four photoreceptors are stable, image quality excellent in color balance are obtained for a longer time.

In the image forming apparatus (process cartridge) according to the present exemplary embodiment, the developing device (developing unit) preferably has a developing roll which is a developer holding member moving (rotating) in the opposite direction to the movement direction (rotation direction) of the electrophotographic photoreceptor. Herein, the developing roll includes a cylindrical developing sleeve holding a developer on the surface thereof. Examples of the developing device include those having a constitution that includes a regulation member regulating the amount of a developer supplied to the developing sleeve. When the developing roll of the developing device moves (rotates) in the opposite direction to the rotation direction of the electrophotographic photoreceptor, the surface of the electrophotographic photoreceptor is rubbed against the toner remaining between the developing roll and the electrophotographic photoreceptor. Moreover, when the residual toner on the electrophotographic photoreceptor is cleaned, for example, the pushing pressure of a blade or the like is increased so as to improve the cleaning property of the toner having approximately a spherical shape, and consequently, the surface of the electrophotographic photoreceptor is rubbed strongly.

Due to the rubbing, the electrophotographic photoreceptor known in the related art is severely damaged, and abrasion, scratches, filming of toner, or the like easily occurs, which leads to image deterioration. However, by forming the surface of the electrophotographic photoreceptor that has been heightened by the crosslinked substance of the specific charge transport material (particularly, a material from which a cured film with a high crosslink density that contains an increased number of reactive functional groups at a high concentration is obtained) of the invention and is made into a thick film to obtain excellent electrical characteristics, it is possible to maintain high image quality for a long time. It is considered that the deposition of the corona product is suppressed for a very long time.

In the image forming apparatus of the present exemplary embodiment, the interval between the developing sleeve and the photoreceptor is set to preferably from 200 μm to 600 μm, and more preferably from 300 μm to 500 μm, in view of suppressing the deposition of the corona product for a longer time. From the same point of view, the interval between the developing sleeve and a regulation blade as the above-described regulation member regulating the amount of a developer is set to preferably from 300 μm to 1000 μm, and more preferably from 400 μm to 750 μm.

In addition, in view of suppressing the deposition of the corona product for a longer time, the absolute value of the movement speed of the developing roll surface is set to preferably from 1.5 times to 2.5 times, and more preferably from 1.7 times to 2.0 times the absolute value (process speed) of the movement speed of the photoreceptor surface.

In the image forming apparatus (process cartridge) according to the present exemplary embodiment, the developing device (developing unit) preferably includes a developer holding member having a magnetic material and develops electrostatic latent images with a two-component developer containing a magnetic carrier and a toner. In this constitution, compared to the case of the single-component developer, particularly, the non-magnetic single-component developer, more excellent image quality is obtained in a color image, a higher level of high image quality is realized, and the life of the apparatus is further extended.

For the image forming apparatus (process cartridge) according to the present exemplary embodiment, an image forming apparatus using a dry developer was described. However, the image forming apparatus (process cartridge) may use a liquid developer. Particularly, in the image forming apparatus (process cartridge) using a liquid developer, due to the liquid components in the liquid developer, the uppermost surface layer of the electrophotographic photoreceptor is, for example, swollen, whereby the uppermost surface layer is easily cracked or scratched by cleaning. However, such problems are improved by using the electrophotographic photoreceptor according to the present exemplary embodiment, and consequently, stabilized images are obtained for a long time.

Figure 6:
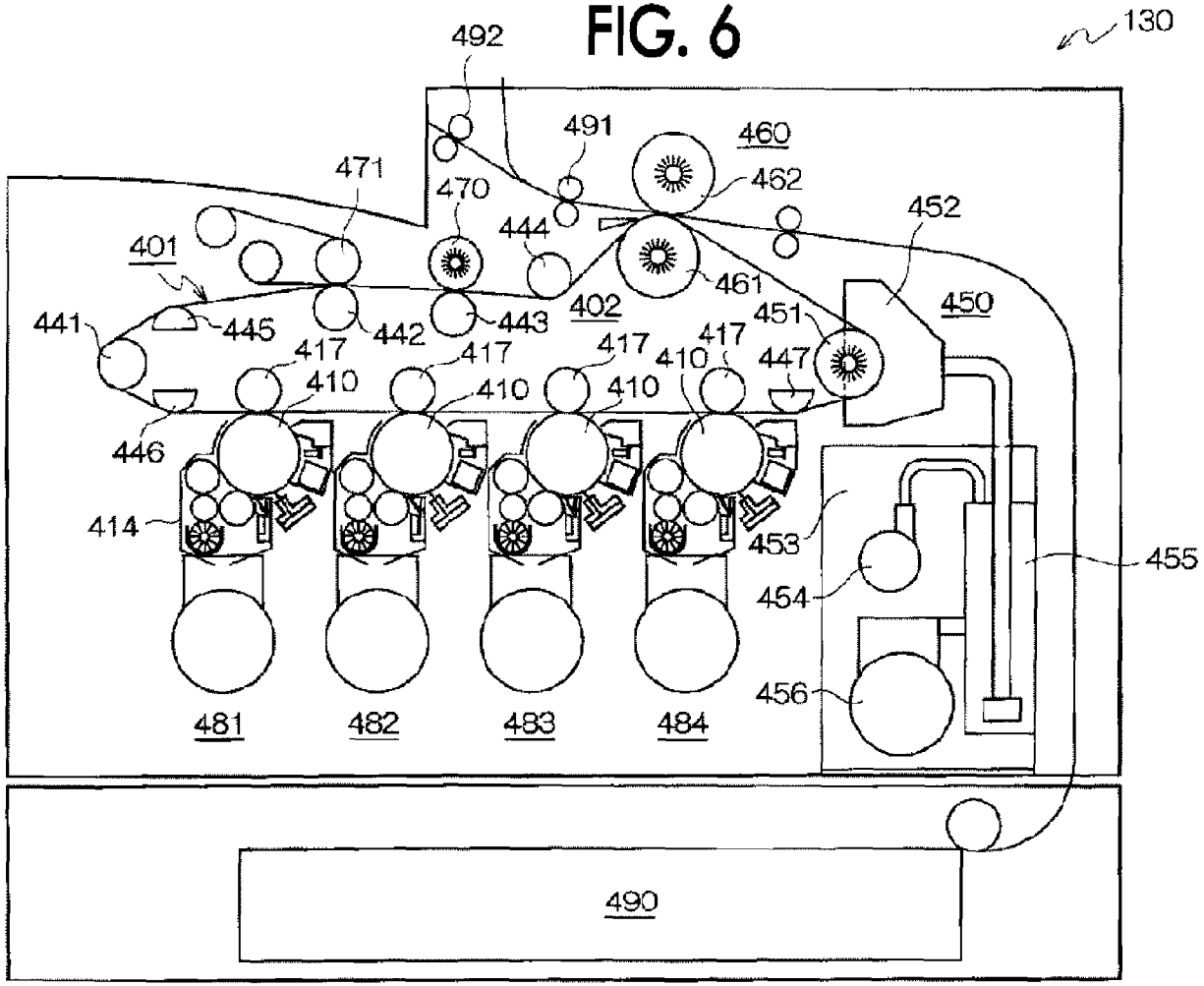
FIG. 6 is a schematic constitutional view showing another example of the image forming apparatus according to the present exemplary embodiment.
Figure 7:
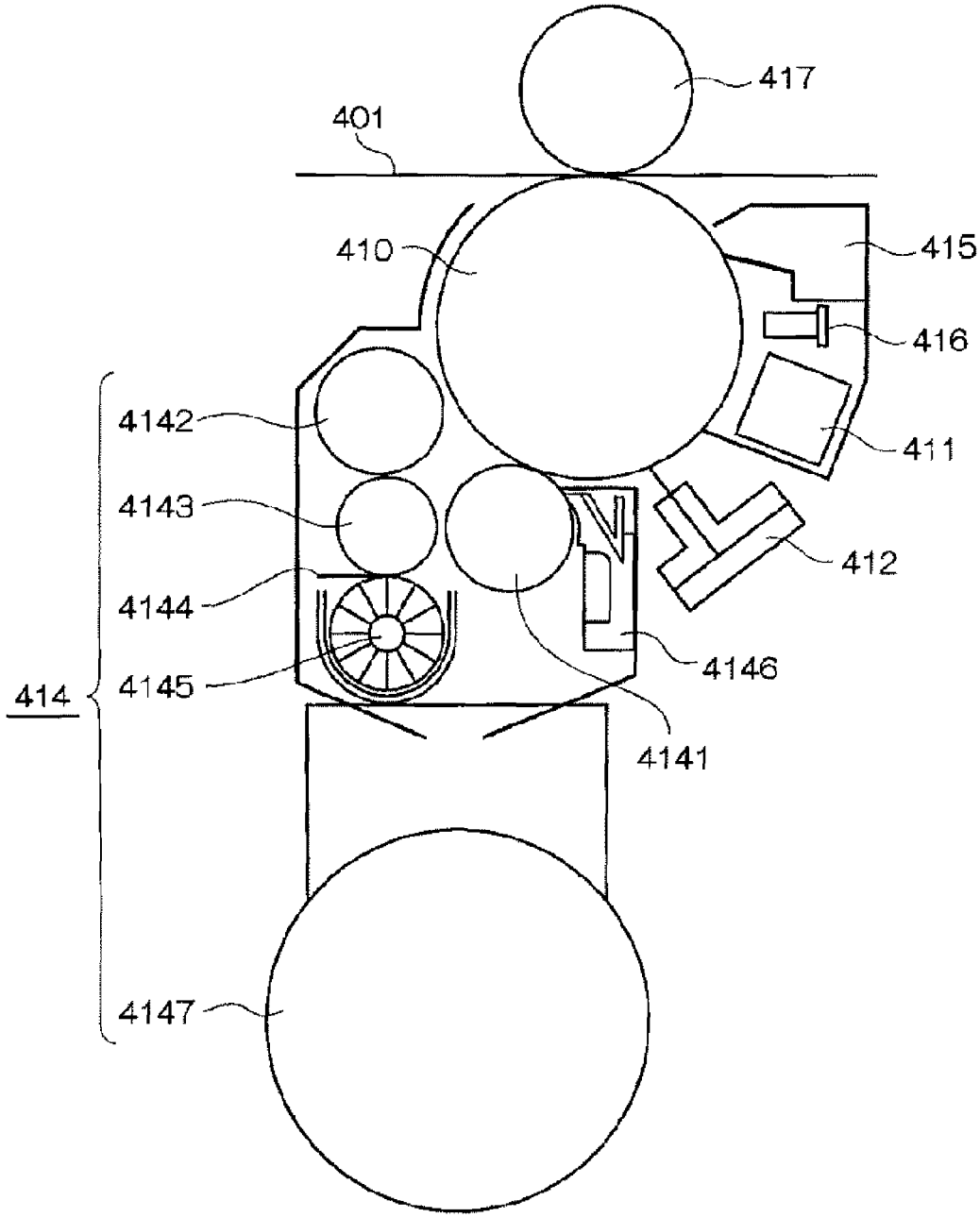
FIG. 7 is a schematic constitutional view showing a developing device in the image forming apparatus shown in FIG. 6.

FIG. 6 is a schematic constitutional view showing an image forming apparatus according to another exemplary embodiment, and FIG. 7 is a schematic constitutional view showing an image forming unit in the image forming apparatus shown in FIG. 6.

An image forming apparatus 130 shown in FIG. 6 is mainly constituted with a belt-like intermediate transfer member 401, image forming units 481, 482, 483, and 484 for each color, a heating portion 450 (an example of a layer forming unit), and a transfer and fixing portion 460.

As shown in FIG. 7, the image forming unit 481 is constituted with an electrophotographic photoreceptor 410, a charging device 411 that charges the electrophotographic photoreceptor 410, an LED array head 412 (an example of an electrostatic latent image forming unit) that performs image exposure for forming an electrostatic latent image on the surface of the charged electrophotographic photoreceptor 410 according to image information, a developing device 414 that develops the electrostatic latent image formed on the electrophotographic photoreceptor 410 by using a liquid developer, a cleaner 415 that cleans the photoreceptor surface, an charge remover 416, and a transfer roll 417 (an example of a primary transfer unit) that is disposed while facing the electrophotographic photoreceptor 410 across the belt-like intermediate transfer member 401 and applied with transfer bias for transferring the developed image which has been formed on the electrophotographic photoreceptor 410 and developed by the liquid developer to the belt-like intermediate transfer member 401.

As shown in FIG. 7, the developing device 414 is provided with a developing roll 4141, a liquid draining roll 4142, a developer cleaning roll 4143, a developer cleaning blade 4144, a developer cleaning brush 4145, a circulating pump (not shown in the drawing), a liquid developer supplying path 4146, and a developer cartridge 4147.

As the liquid developer used herein, a liquid developer in which particles having a heat melting and fixing type of resin such as polyester or polystyrene as a main component are dispersed, or a liquid developer to be a layer (which will be referred "to as to be a film", hereinafter) by removing a surplus dispersion medium (carrier liquid) and increasing the proportion of the solid contents in the liquid developer is used. Specific materials to be a film are described in detail in U.S. Pat. No. 5,650,253 (Column 10, Line 8 to Column 13, Line 14) and U.S. Pat. No. 5,698,616.

The developer to be a film refers to a liquid developer in which micro-substances (such as a micro-toner) having a glass transition point (temperature) lower than room temperature are dispersed in a carrier liquid. Generally, the substances do not contact each other and do not aggregate. However, when the carrier liquid is removed, only the substances remain, and if the substances are attached in a film shape, they bind to each other at room temperature, thereby forming a film. The substance is obtained by mixing ethyl alcohol with methyl methacrylate, and its glass transition temperature is set according to the mixing ratio thereof.

Other image forming units 482, 483, and 484 also have the same constitution. The developing devices of the respective image forming units contain different colors (yellow, magenta, cyan, and black) of liquid developers. In addition, in the respective image forming units 481, 482, 483, and 484, the electrophotographic photoreceptor, the developing device, and the like forms a cartridge.

In the above constitution, examples of the material of the belt-like intermediate transfer member 401 include a PET film (polyethylene terephthalate film) coated with silicone rubber or a fluororesin, a polyimide film, and the like.

The electrophotographic photoreceptor 410 contacts the belt-like intermediate transfer member 401 through the upper surface thereof, and moves at the same speed as the belt-like intermediate transfer member 401.

As the charging device 411, for example, a corona charger is used. As the electrophotographic photoreceptors 410 in the image forming unit 481, 482, 483, and 484, electrophotographic photoreceptors 410 having the same circumferential length are used. In addition, the interval between the respective transfer rolls 417 arranged is constituted so as to be the same as the circumferential length of the electrophotographic photoreceptor 410 or to be an integer multiple of the circumferential length.

The heating portion 450 is constituted with a heating roll 451 that is disposed so as to rotate while contacting the inner surface of the belt-like intermediate transfer member 401, a storage chamber 452 that is disposed so as to face the heating roll 451 and surround the outer surface of the belt-like intermediate transfer member 401, and a carrier liquid collecting portion 453 that collects vapor of the carrier liquid and the carrier liquid from the storage chamber 452. On the carrier liquid collecting portion 453, a suction blade 454 that sucks the vapor of the carrier liquid in the storage chamber 452, a condensing portion 455 that liquefies the vapor of the carrier liquid, and a collecting cartridge 456 that collects the carrier liquid from the condensing portion 455 are mounted.

The transferring and fixing portion 460 (an example of a secondary transfer unit) is constituted with a transfer supporting roll 461 that rotatably supports the belt-like intermediate transfer member 401, and a transferring and fixing roll 462 that rotates while pushing a recording medium passing through the transferring and fixing unit 460 to the belt-like intermediate transfer member 401 side, and also includes a heating element in the inside thereof.

In addition, a cleaning roll 470 and a cleaning web 471 that clean the top of the belt-like intermediate transfer member 401 before a color image is formed on the belt-like intermediate transfer member 401, supporting rolls 441 to 444 that support the rotation driving of the belt-like intermediate transfer member 401, and supporting shoes 445 to 447 are provided.

The belt-like intermediate transfer member 401 constitutes an intermediate member unit 402 with transfer rolls 417 of image forming units for each color, the heating roll 451, the transfer supporting roll 461, the supporting rolls 441 to 444, the supporting shoes 445 to 447, the cleaning roll 470, and a cleaning web 471. The belt-like intermediate transfer member 401 is constituted such that the vicinity of the supporting roll 441 integrally moves up and down based on a vicinity of the heating roll 451 as a supporting point.

Hereinbelow, the operation of the image forming apparatus using the liquid developer shown in FIG. 6 will be described.

First, in the image forming unit 481, the LED array head 412 performs the image exposure on the electrophotographic photoreceptor 410 of which the surface has been charged by the charging device 411, according to yellow image information, whereby an electrostatic latent image is formed. This electrostatic latent image is developed with a yellow liquid developer by the developing device 414.

Herein, the development is performed by the following steps. The yellow liquid developer passes through the liquid developer supplying path 4146 by the circulation pump from the developer cartridge 4147, and is supplied to the vicinity where the developing roll 4141 and the electrophotographic photoreceptor 410 approach. Due to a development field formed between the electrostatic latent image on the electrophotographic photoreceptor 410 and the developing roll 4141, coloring solid contents having charges in the supplied liquid developer move to the electrostatic latent image side to be an image on the electrophotographic photoreceptor 410.

Subsequently, the liquid draining roll 4142 removes the carrier liquid from the top of the electrophotographic photoreceptor 410 so as to yield a proportion of the carrier liquid required for the next transferring. On the surface of the electrophotographic photoreceptor 410 having passed through the developing device 414 in this manner, a yellow image developed by the yellow liquid developer is formed.

In the developing device 414, the developer cleaning roll 4143 removes the liquid developer remaining on the developing roll 4141 after developing operation and the liquid developer attached to a squeeze roll due to a squeeze operation, and the developer cleaning blade 4144 and the developer cleaning brush 4145 clean the developer cleaning roll 4143. In this manner, developing operation is stably performed all the time. The constitution and operations of the developing device is described in detail in JP-A-11-249444.

For the developing roll 4141, the concentration of solid contents ratio in the liquid developer is automatically controlled by at least one of the developing device 414 and the developer cartridge 4147 such that a liquid developer containing a constant ratio of a solid contents is supplied.

The developed yellow image formed on the electrophotographic photoreceptor 410 contacts the belt-like intermediate transfer member 401 through the upper surface thereof by the rotation of the electrophotographic photoreceptor 410. The image is then transferred to the belt-like intermediate transfer member 401 by contact electrostatic transfer, by the transfer roll 417 that is pressed on the electrophotographic photoreceptor 410 while facing the electrophotographic photoreceptor 410 across the belt-like intermediate transfer member 401 and is applied with the transfer bias.

From the electrophotographic photoreceptor 410 having undergone the contact electrostatic transfer, the liquid developer remaining after the transfer is removed by the cleaner 415, and electricity of the electrophotographic photoreceptor 410 is erased by the charge remover 416 so as to be used for the next image formation.

The same operation is performed in other image forming units 482, 483, and 484. The circumferential length of the electrophotographic photoreceptors 410 used in the respective image forming units is the same. In addition, the developed images of each color formed on the respective photoreceptors are sequentially and electrostatically transferred onto the belt-like intermediate transfer member 401, by the transfer rolls arranged in the interval that is as long as the circumferential length of the photoreceptor or is the integer multiple of the circumferential length. Accordingly, the respective developed images of yellow, magenta, cyan, and black, which are formed on the respective electrophotographic photoreceptors 410 in consideration of the overlapped position on the belt-like intermediate transfer member 401, are sequentially transferred onto the belt-like intermediate transfer member 401 by contact electrostatic transfer with a high accuracy, while overlapping with each other without misalignment, even if eccentricity occurs in the electrophotographic photoreceptor 410. In this manner, on the belt-like intermediate transfer member 401 having passed through the image forming unit 484, an image developed by liquid developer of each color is formed.

In the heating portion 450, the developed image formed on the belt-like intermediate transfer member 401 is heated by the heating roll 451 from the back surface of the belt-like intermediate transfer member 401. As a result, the carrier liquid as the dispersion medium is almost completely evaporated, and an image having become a film is formed. This is because if the liquid developer is a liquid developer in which particles having heat melting and fixing type resin as a main component are dispersed, the dispersed particles become a film by being melted through the removal of the surplus dispersion medium and heating by the heating roll 451. Alternatively, this is because the liquid developer is a liquid developer that becomes a film by increasing the solid contents ratio in the liquid developer through the removal of the surplus dispersion medium (carrier liquid).

In the heating portion 450, the vapor of the carrier liquid in the storage chamber 452, which is generated by being heated and evaporated by the heating roll 451, is introduced to the condensing portion 455 by the suction blade 454 in the carrier liquid collecting portion 453 and liquefied. The re-liquefied carrier liquid is guided to the collecting cartridge 456 and collected.

In a transferring and fixing portion 460, the belt-like intermediate transfer member 401 that has passed the heating portion 450 and has a film-like (layer-like) image formed on the top thereof is transferred by heat and pressure to a transfer medium (for example, normal paper) that has been transported in time from a paper storage portion 490 in the lower portion of the apparatus, by the transfer supporting roll 461 and transferring and fixing roll 462. In this manner, an image is formed on the transfer medium and output and discharged outside the apparatus by discharge rolls 491 and 492. In this transferring, the adhesive force of the image having become a film that is formed on the belt-like intermediate transfer member 401 with respect to the belt-like intermediate transfer member 401 is weaker than the adhesive force of the image having become a film with respect to the transfer medium. Since the image is transferred to the transfer medium by such a difference in the adhesive force, an electrostatic force is not imparted during transferring. Moreover, the binding force of the image having become a film as a film is stronger than the adhesive force with respect to the transfer medium.

From the belt-like intermediate transfer member 401 having passed through the transferring and fixing portion 460, the solid contents that remain after the transferring and substances that are contained in the solid contents and hinder the function of the belt-like intermediate transfer member 401 are collected and removed by the cleaning roll 470 and the cleaning web 471 having a heat source in the inside thereof. Thereafter, the belt-like intermediate transfer member 401 is used for the next image formation.

After the image is formed in the above-described manner, in the intermediate member unit 402, the vicinity of the supporting roll 441 moves upward integrally, based on the vicinity of the heating roll 451 as a supporting point. In this manner, the belt-like intermediate transfer member 401 is separated from the electrophotographic photoreceptors 410 of the respective image forming units. The transferring and fixing roll 462 is also separated from the belt-like intermediate transfer member 401 in the same manner.

When there is a request for image formation again, the intermediate member unit 402 operates such that the belt-like intermediate transfer member 401 contacts the electrophotographic photoreceptors 410 of the respective image forming units, and similarly, the transferring and fixing roll 462 also operates to contact the belt-like intermediate transfer member 401. The operation of the transferring and fixing roll 462 may be performed with timing in which the image is transferred to the recording medium.

On the other hand, the image forming apparatus using the liquid developer is not limited to the image forming apparatus 130 shown in FIG. 6. For example, the image forming apparatus may be the image forming apparatus shown in FIG. 8.

Figure 8:
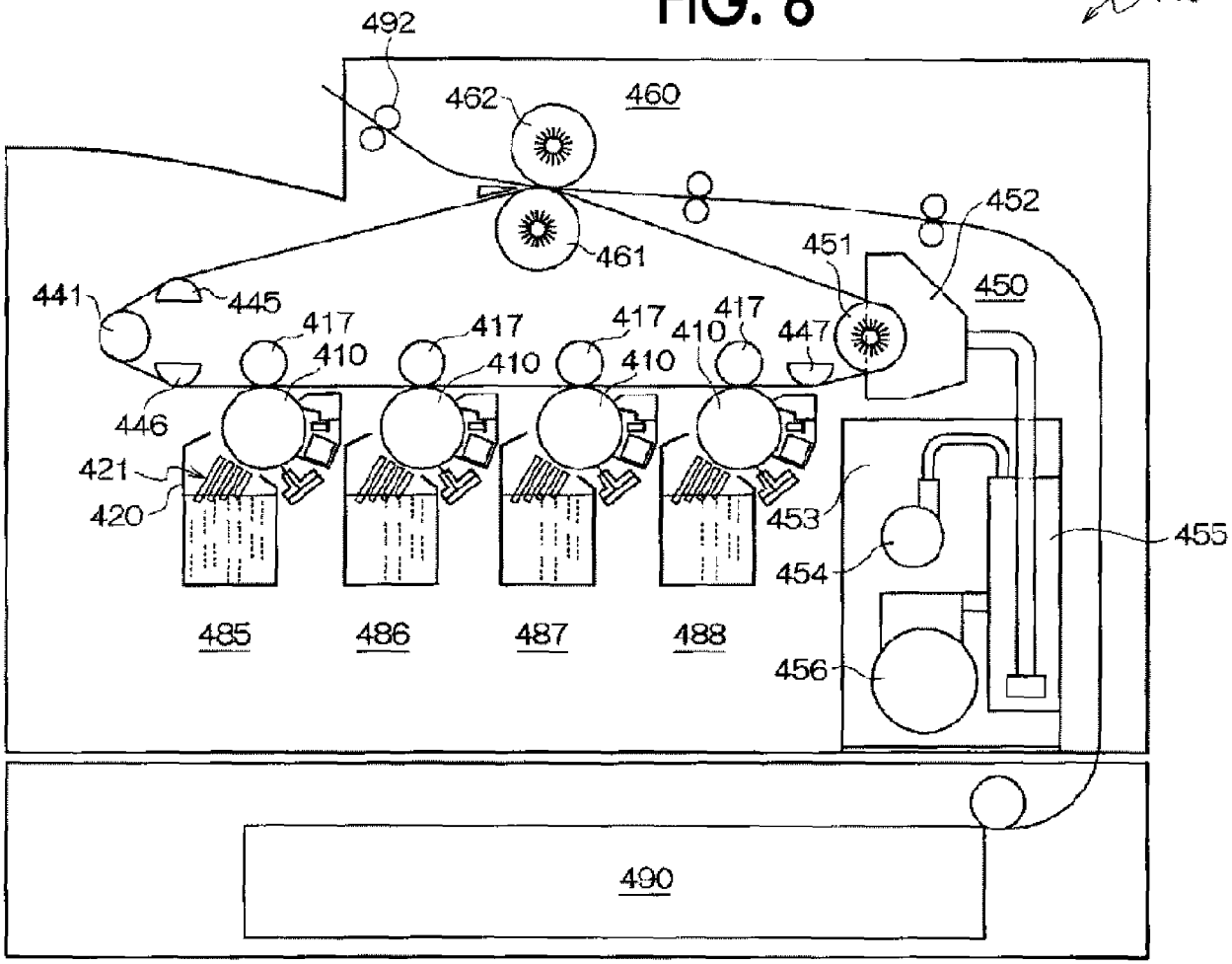
FIG. 8 is a schematic constitutional view showing another example of the image forming apparatus according to the present exemplary embodiment.

FIG. 8 is a schematic constitutional view showing an image forming apparatus according to another exemplary embodiment.

Similarly to the constitution of the image forming apparatus 130 shown in FIG. 6, an image forming apparatus 140 shown in FIG. 8 is mainly constituted with the belt-like intermediate transfer member 401, image forming units 485, 486, 487, and 488 for each color, the heating portion 450, and the transferring and fixing portion 460.

The image forming apparatus 140 shown in FIG. 8 is different from the image forming apparatus 130 shown in FIG. 6 in that the belt-like intermediate transfer member 401 runs approximately in a triangle shape, and in the configuration of a developing device 420 in image forming units 485, 486, 487, and 488 for each color. The heating portion 450 and the transferring and fixing portion 460 are the same as those in the image forming apparatus 130 shown in FIG. 6. In addition, the cleaning roll 470 and the cleaning web 471 are omitted in the drawing.

While rotating and running, the belt-like intermediate transfer member 401 performs a bending operation. Since this bending operation affects the stabilized running and the life of the belt-like intermediate transfer member 401, the belt-like intermediate transfer member 401 is allowed to run approximately in a triangle shape so as to reduce the bending operation as much as possible.

In the developing device 420, recording heads 421 that selectively fly and attach the liquid developer to the electrostatic latent image formed on the electrophotographic photoreceptor 410 are arranged in plural columns, instead of the developing roll, the liquid draining roll, and the like.

In each column of the recording heads 421, a large number of recording electrodes 422 are evenly arranged in the longitudinal direction of the electrophotographic photoreceptor 410, and a flying electric field is formed between the potential of the electrostatic latent image formed on the electrophotographic photoreceptor 410 and the flying bias potential applied to the recording electrodes 422. In addition, coloring solid contents having charges in the liquid developer supplied to the recording electrodes 422 move to the electrostatic latent image side to be an image portion on the electrophotographic photoreceptor 410 and develop the image.

Figure 9:
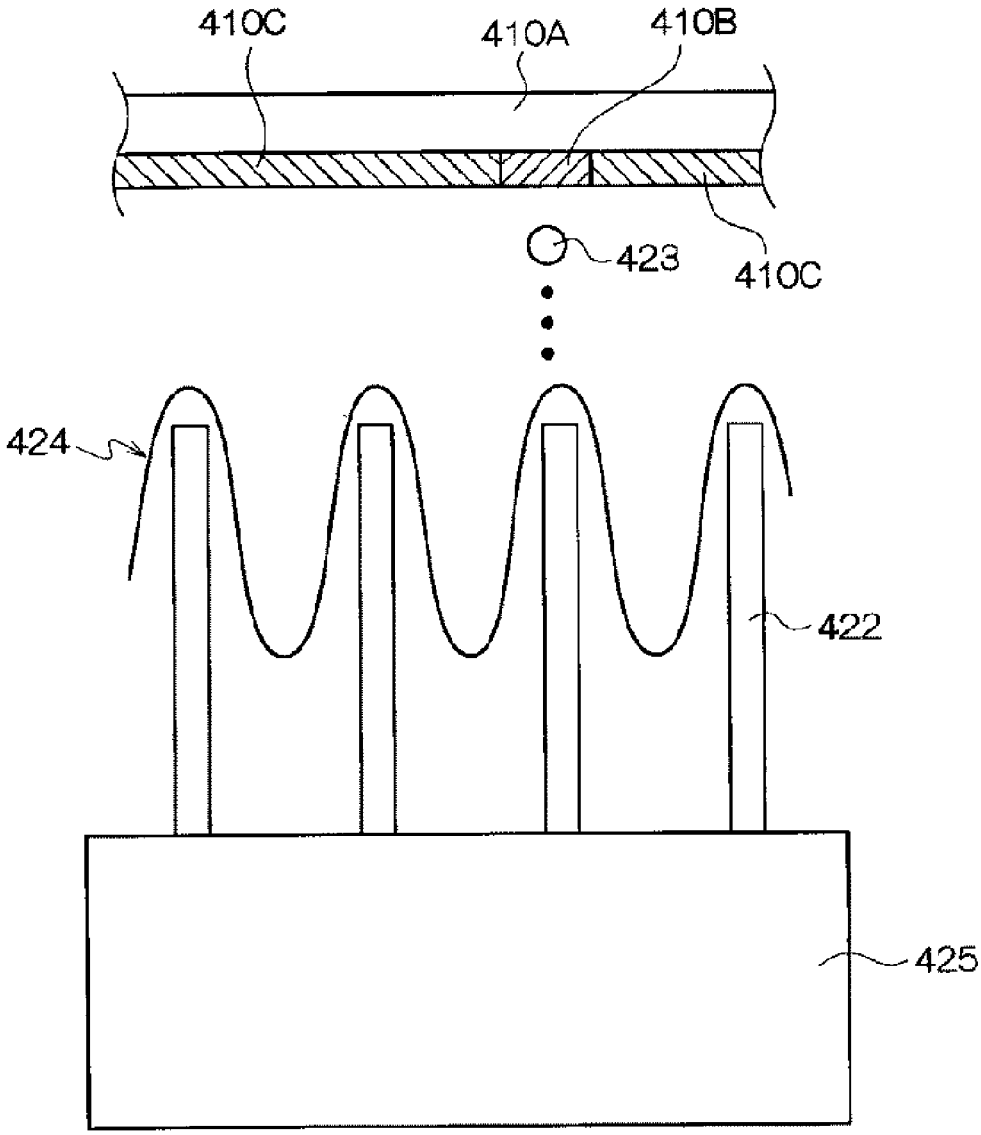
FIG. 9 is a schematic view showing a meniscus of a liquid developer formed around printing electrodes of the developing device and how liquid moves to an image portion in the image forming apparatus shown in FIG. 8.

Around the recording electrodes 422, a meniscus (a liquid-holding form that is formed on a member or between members contacting a liquid due to the viscosity or surface tension of the liquid, and the surface energy of the surface of the contacting member) 424 of the liquid developer is formed. FIG. 9 is a view showing the state of the meniscus. On an electrophotographic photoreceptor 410A to which liquid particles 423 of the liquid developer fly, an electrostatic latent image to be an image portion is formed. At this time, an electrostatic latent image potential of from about 50 V to about 100 V has been applied to an image portion 410B, and a potential of from about 500 V to about 600 V has been applied to a non-image portion 410C. At this time, when a flying bias potential of about 1000 V is applied to the recording electrodes 422 via a bias voltage supplying portion 425, due to electric field concentration, a liquid developer having a higher solid contents ratio compared to the supplied liquid developer, that is, a high concentration liquid developer is supplied to the tip of the recording electrodes 422. Moreover, due to a potential difference (a threshold of a potential difference required of about 700 V to about 800 V to fly) between the electrostatic latent image potential of the image portion 410C on the electrophotographic photoreceptor 410A and the flying bias potential of the recording electrodes 422, the liquid particles 423 from the high concentration liquid developer fly and are attached to the electrostatic latent image portion (image portion) on the electrophotographic photoreceptor 410A. In addition, in the developing device 420, the developing device itself plays a role of a developer cartridge.

The operation of the image forming apparatus 140 shown in FIG. 8 is the same as that of the image forming apparatus 130 shown in FIG. 6, except for the running pattern of the belt-like intermediate transfer member 401 and the operation of the developing device 420. Therefore, description thereof is omitted.

Figure 10:
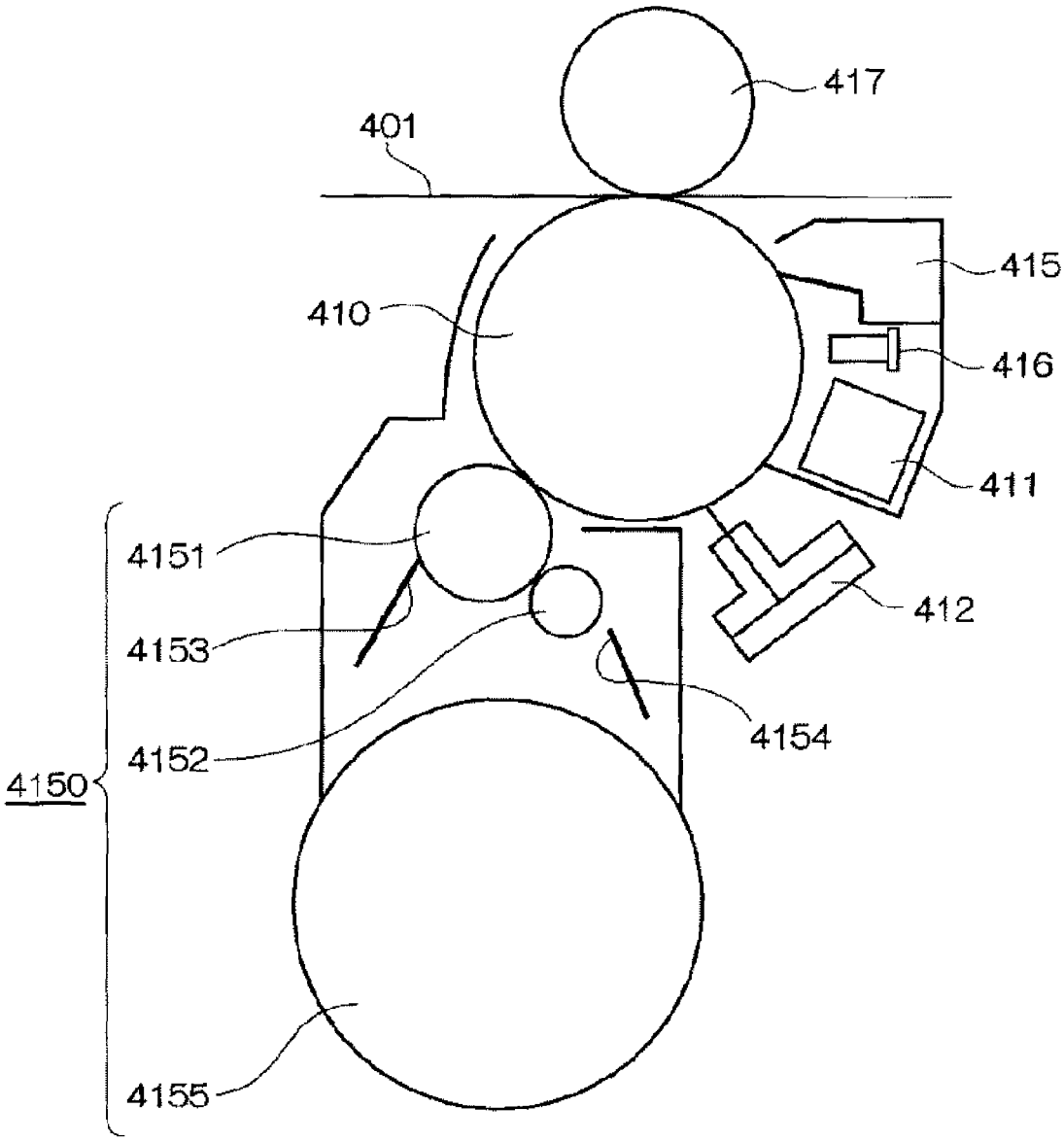
FIG. 10 is a schematic constitutional view showing another example of the developing device in the image forming apparatus shown in FIGS. 6 and 8.

Herein, in the image forming apparatus using the liquid developer, the developing device is not limited to the above-described constitution, and the developing device may be, for example, the developing device shown in FIG. 10.

FIG. 10 is a schematic constitutional view showing another developing device in the image forming apparatus shown in FIG. 6 or 8.

When the electrostatic latent image formed on the electrophotographic photoreceptor 410 is developed using a developing roll 4151 in the image forming apparatus 130 or 140 shown in FIG. 6 or 8, a developing device 4150 shown in FIG. 10 forms a liquid developer layer including a solid contents ratio higher than that of the liquid developer supplied from a developer cartridge 4155 on the developing roll 4151, and develops an image by using the liquid developer layer of which the concentration has been increased.

In order to form the liquid developer layer having an increased solid contents ratio on the developing roll 4151, an electric field is formed by creating a potential difference between a supplying roll 4152 and the developing roll 4151, whereby the liquid developer layer having a higher solid contents ratio compared to the ratio of solid contents in the liquid developer from the developer cartridge 4155 is formed on the developing roll 4151. For the developing roll 4151 and the supplying roll 4152, cleaning blades 4153 and 4154 are arranged to clean the surface of the respective rolls.

In the exemplary embodiment described so far, a case has been described in which the uppermost surface layer of the electrophotographic photoreceptor is formed using the composition for forming a charge transporting film according to the present exemplary embodiment, but the invention is not limited thereto. The cured film cured using the composition for forming a charge transporting film according to the present exemplary embodiment may be applied to, for example, photoelectric conversion devices such as an organic electroluminescence element, an organic solar cell, a memory device, and a wavelength conversion element.

EXAMPLES

Hereinbelow, the present invention will be described in detail based on examples, but the invention is not limited thereto. In addition, in the following description, "part(s)" and "%" are based on weight, unless otherwise specified.

Example 1

Preparation of Electrophotographic Photoreceptor

Preparation of Undercoat Layer 100 parts by weight of zinc oxide (average particle diameter of 70 nm: manufactured by TAYCA: specific surface area of 15 $m^2/g$) is mixed with 500 parts by weight of toluene under stirring, and 1.3 parts by weight of a silane coupling agent (KBM503: manufactured by Shin-Etsu Chemical Co., Ltd.) is added thereto, followed by stirring for 2 hours. Thereafter, toluene is distilled away through distillation under reduced pressure, and the resultant is baked at 120° C. for 3 hours, thereby obtaining zinc oxide surface-treated with the silane coupling agent.

110 parts by weight of the surface-treated zinc oxide is mixed with 500 parts by weight of tetrahydrofuran under stirring, and a solution obtained by dissolving 0.6 part by weight of alizarin in 50 parts by weight of tetrahydrofuran is added thereto, followed by stirring at 50° C. for 5 hours. Thereafter, the alizarin-imparted zinc oxide is filtered by filtration under reduced pressure, followed by drying under reduced pressure at 60° C., thereby obtaining the alizarin-imparted zinc oxide.

38 parts by weight of a solution obtained by dissolving 60 parts by weight of the alizarin-imparted zinc oxide, 13.5 parts by weight of a curing agent (blocked isocyanate Sumidur 3175, manufactured by Sumitomo Bayer Urethane Co., Ltd.), and 15 parts by weight of a butyral resin (S-LEK BM-1, manufactured by SEKISUI CHEMICAL CO., LTD.) in 85 parts by weight of methyl ethyl ketone is mixed with 25 parts by weight of methyl ethyl ketone, and the resultant is dispersed with a sand mill for 2 hours by using glass beads having a diameter of 1 mmϕ, thereby obtaining a dispersion.

To the obtained dispersion, 0.005 part by weight of dioctyltin dilaurate and 40 parts by weight of silicone resin particles (Tospearl 145, manufactured by GE Toshiba Silicones, Co., Ltd.) are added as a catalyst, thereby obtaining a coating liquid for forming an undercoat layer.

As a conductive supporter, a cylindrical aluminum supporter having a diameter of 30 mm, a length of 340 mm, and a thickness of 1 mm is prepared, and the obtained coating liquid for forming an undercoat layer is coated onto this cylindrical aluminum supporter by dip coating, followed by drying and curing at 170° C. for 40 minutes, thereby obtaining an undercoat layer having a thickness of 18.7 μm.

Preparation of Charge Generating Layer

A mixture including 15 parts by weight of hydroxy gallium phthalocyanine as a charge generating material in which the Bragg angle (2θ±0.2°) of an X-ray diffraction spectrum using X-rays having Cukα characteristics has diffraction peaks at positions of at least 7.3°, 16.0°, 24.9°, and 28.0°, 10 parts by weight of a vinyl chloride-vinyl acetate copolymer resin (VMCH, manufactured by Nippon Unicar Co., Ltd.) as a binder resin, and 200 parts by weight of n-butyl acetate is dispersed with a sand mill for 4 hours by using glass beads having a diameter of 1 mmϕ. To the obtained dispersion, 175 parts by weight of n-butyl acetate and 180 parts by weight of methyl ethyl ketone are added, followed by stirring, thereby obtaining a coating liquid for forming a charge generating layer.

The obtained coating liquid for forming a charge generating layer is coated onto the undercoat layer formed as above in the cylindrical aluminum supporter by dip coating, followed by drying at room temperature (25° C.) thereby forming a charge generating layer having a film thickness of 0.2 μm.

Preparation of Charge Transport Layer 40 parts of N,N'-diphenyl-N,N'-bis(3-methylphenyl)-[1,1']biphenyl-4,4'-diamine (TPD), 10 parts of N,N-bis(3,4-dimethylphenyl)biphenyl-4-amine, and 55 parts of a bisphenol Z polycarbonate resin (PC(Z): viscosity average molecular weight: 60000) are added to 800 parts of chlorobenzene so as to be dissolved, thereby obtaining a coating liquid for forming a charge transport layer. This coating liquid is coated onto the charge generating layer, followed by drying at 130° C. for 45 minutes, thereby forming a charge transport layer having a film thickness of 25 μm.

Preparation of Coating Liquid for Forming a Surface Protective Layer

Thereafter, 5 parts by weight of Lubron L5 (manufactured by DAIKIN INDUSTRIES, Ltd.), 0.2 part of a fluorine graft polymer (Aaron GF300: manufactured by TOAGOSEI., CO., LTD.), and 300 parts of ethyl acetate (dielectric constant: 7.6) are subjected to 10 minutes of a dispersing treatment repeated three times by using an ultrasonic homogenizer (manufactured by NISSEI Corporation) in a constant temperature bath at 20° C., thereby obtaining a suspension. To the suspension, the compound represented by the above (I)-7 as a chain-polymerizable monomer having a charge transporting structure and 2 parts of VE-73 (manufactured by Wako Pure Chemical Industries, Ltd.) as a polymerization initiator are added, followed by mixing under stirring for 12 hours at room temperature, thereby preparing a coating liquid for forming a surface protective layer.

Preparation of Surface Protective Layer

The obtained coating liquid for forming a surface protective layer is coated onto the charge transport layer formed on the above cylindrical aluminum supporter by ring coating at a push-up rate of 150 mm/min. Thereafter, by using a nitrogen drier having an oxygen content meter, a curing reaction is performed at an oxygen concentration of 200 ppm or less for 60 minutes at 160±5° C., thereby forming a surface protective layer. The film thickness of the surface protective layer is 7 μm.

An electrophotographic photoreceptor is prepared in the above manner.

Examples 2 to 18 and Comparative Examples 1 to 5

By the method disclosed in Example 1, an undercoat layer, a charge generating layer, and a charge transport layer are sequentially formed on a cylindrical aluminum supporter by coating. Thereafter, a surface protective layer is formed by the same method as disclosed in Example 1, except that the composition of the coating liquid for forming a surface protective layer is changed according to the following Table 1, thereby preparing an electrophotographic photoreceptor.

Evaluation 1

Dispersibility of the fluorine-containing resin particles in the electrophotographic photoreceptor obtained in each example is evaluated by the following method. From the substrate of the photoreceptor, a slice of a laminate including layers from the undercoat layer to the surface layer is cut off using a single blade razor for trimming (manufactured by Nisshin EM Corporation), and the slice is embedded in a photocurable acrylic resin (product name D-800: manufactured by Nippon Electronics Datum Co., Ltd.). Subsequently, by a microtome method (microtome device: manufactured by LEICA) using a diamond knife, the slice is cut such that the cross-section of the slice of laminate is shown. The cross-section of the slice is observed using a laser microscope OLS-1100 manufactured by Olympus Optical Co., Ltd. under a condition of a stepping amount of 0.01 μm, and the dispersibility is judged by the following criteria.

A: Particles are evenly dispersed without aggregation.

B: Particles are slightly partially aggregated.

C: Particles are aggregated to a large extend.

Evaluation 2

The electrophotographic photoreceptor obtained in each example is mounted on Docucentre-IV C2260 manufactured by Fuji Xerox Co., Ltd., and in an environment of 28.5° C. and 85% RH, 10000 sheets of images having a solid color image portion with an image density of 100%, a half tone image portion with an image density of 20%, and a fine line image portion are formed by being continuously printed on A4 paper.

For the initial image of the $100^{th}$ sheet and the image of the $10000^{th}$ sheet that is obtained after elapse of time, the following test for image evaluation is performed. In addition, scratch resistance of the electrophotographic photoreceptor is also evaluated. The results are shown in Table 2.

In addition, for the image formation test, P paper (A4 size, supplied in the transverse direction) manufactured by Fuji Xerox Co., Ltd. is used.

Evaluation of Initial Streak-Like Image Defect

Initial streak-like image defect is evaluated by visually observing the half tone image portion of the $100^{th}$ image printed, and the image defect is judged by the following criteria.

A: Streak-like image defect is not caused.

B: Streak-like image defect is partially caused.

C: Streak-like image defect that is problematic in image quality is caused.

Evaluation of Streak-Like Image Defect Caused after Elapse of Time

Streak-like image defect caused after elapse of time is evaluated by visually observing the half tone image portion of the $10000^{th}$ image printed, and the image defect is judged by the following criteria.

A: Streak-like image defect is not caused.

B: Streak-like image defect is partially caused.

C: Streak-like image defect that is problematic in image quality is caused.

Evaluation of Initial Fine Line

In order to evaluate initial fine lines, the fine line image portion of the $100^{th}$ image printed is enlarged using a 10× magnifier, and whether there is a blur is visually observed and judged by the following criteria.

A: There is practically no blur.

B: There is a slight blur.

C: There is a blur that is problematic in image quality.

Evaluation of Fine Line after Elapse of Time

In order to evaluate fine lines after elapse of time, the fine line image portion of the $10000^{th}$ image printed is enlarged using a 10× magnifier, and whether there is a blur is visually observed and judged by the following criteria.

A: There is practically no blur.

B: There is a slight blur.

C: There is a blur that is problematic in image quality.

Evaluation of Scratch Resistance

The surface of the electrophotographic photoreceptor after 10000 sheets of printing is visually observed and judged by the following criteria.

A+: There is no scratching.

A: Scratching is caused only in a small portion.

B: Scratching is caused partially.

C: Scratching is caused in the whole photoreceptor.

Details of the respective materials shown in tables will be shown below.

Chain-Polymerizable Monomer (a-1): Compound represented by (I)-7

(a-2): Compound represented by (I)-363

(a-3): Compound represented by (I)-143

(a-4): Compound represented by (I)-43

(a-5): Compound represented by (I)-178

(a-6): Compound represented by (I)-226

(a-7): Compound represented by (I)-238

(a-8): Compound represented by the following structural formula

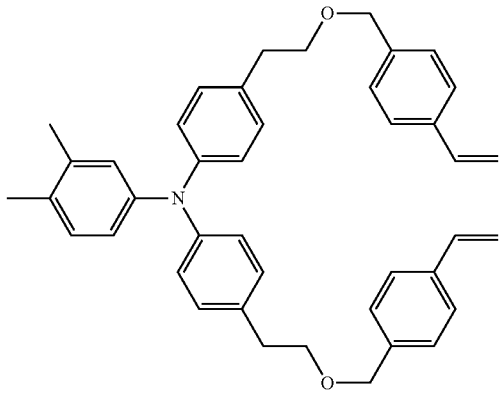

Solvent (b-1): Ethyl acetate (b-2): Tetrahydrofuran (b-3): Methyl isobutyl ketone (b-4): Dioxane (b-5): Cyclopentyl methyl ether The dielectric constant of the solvent used in each example is a value measured by a dielectric constant meter for liquid, Model 871, manufactured by Nihon Rufuto Co., Ltd., and shown in Table 2.

Polymerization Initiator (c-1): V-59 (manufactured by Wako Pure Chemical Industries, Ltd)

(c-2): VE-73 (manufactured by Wako Pure Chemical Industries, Ltd)

(c-3): OTazo-15 (manufactured by Otsuka Chemical Co., Ltd.)

(c-4): Perhexyl Z (manufactured by NOF CORPORATION)

Compound not Having Chain-Polymerizable Reactive Group but Having Charge Transporting Skeleton (d-1): N,N'-diphenyl-N,N'-bis(3-methylphenyl)-[1,1']biphenyl-4,4'-diamine Compound Having Chain-Polymerizable Reactive Group but not Having Charge Transporting Skeleton (e-1): t-butyl acrylate (manufactured by Wako Pure Chemical Industries, Ltd)

(e-2): Ethoxylated bisphenol A methacrylate (manufactured by Shin-Nakamura Chemical Co., Ltd.)

(e-3): Trimethylolpropane triacrylate (manufactured by NIPPON KAYAKU Co., Ltd.)

Binder Resin (f-1): PCZ-400 (bisphenol (Z) polycarbonate manufactured by MITSUBISHI GAS CHEMICAL COMPANY, INC.)

TABLE 1

| | (a) Compound having chain-polymerizable functional group and charge transporting skeleton | | (b) Solvent | | (c) Polymerization initiator | | (d) Compound not having chain-polymerizable reaction group but having charge transporting skeleton | | (e) Compound having chain-polymerizable reaction group but not having charge transporting skeleton | | (f) Binder resin | |
|---|---|---|---|---|---|---|---|---|---|---|---|---|
| | Type | Parts by weight | Type | Parts by weight | Type | Parts by weight | Type | Parts by weight | Type | Parts by weight | Type | Parts by weight |
| Example 1 | a-1 | 100 | b-1 | 300 | c-2 | 2 | — | — | — | — | — | — |
| Example 2 | a-2 | 100 | b-1 | 300 | c-2 | 2 | — | — | — | — | — | — |
| Example 3 | a-3 | 100 | b-1 | 300 | c-2 | 2 | — | — | — | — | — | — |
| Example 4 | a-4 | 100 | b-1 | 300 | c-2 | 2 | — | — | — | — | — | — |
| Example 5 | a-5 | 100 | b-1 | 300 | c-2 | 2 | — | — | — | — | — | — |
| Example 6 | a-6 | 100 | b-1 | 300 | c-2 | 2 | — | — | — | — | — | — |
| Example 7 | a-7 | 100 | b-1 | 300 | c-2 | 2 | — | — | — | — | — | — |
| Example 8 | a-7 | 100 | b-2 | 300 | c-2 | 2 | — | — | — | — | — | — |
| Example 9 | a-7 | 100 | b-3 | 150 | c-2 | 2 | — | — | — | — | — | — |
| Example 10 | a-7 | 100 | b-1/b-3 | 150/150 | c-2 | 2 | — | — | — | — | — | — |
| Example 11 | a-7 | 100 | b-1 | 300 | c-1 | 2 | — | — | — | — | — | — |
| Example 12 | a-7 | 100 | b-1 | 300 | c-3 | 2 | — | — | — | — | — | — |
| Example 13 | a-7 | 100 | b-1 | 300 | c-4 | 2 | — | — | — | — | — | — |
| Example 14 | a-7 | 100 | b-1 | 300 | c-2 | 2 | d-1 | 25 | — | — | — | — |
| Example 15 | a-7 | 100 | b-1 | 300 | c-2 | 2 | d-1 | 25 | e-1 | 10 | — | — |
| Example 16 | a-7 | 100 | b-1 | 300 | c-2 | 2 | d-1 | 25 | e-2 | 10 | — | — |
| Example 17 | a-7 | 100 | b-1 | 300 | c-2 | 2 | d-1 | 25 | e-3 | 10 | — | — |
| Example 18 | a-7 | 100 | b-1 | 300 | c-2 | 2 | d-1 | 25 | e-1 | 10 | f-1 | 10 |
| Comparative Example 1 | a-7 | 100 | b-4 | 300 | c-1 | 2 | — | — | — | — | — | — |
| Comparative Example 2 | a-7 | 100 | b-5 | 300 | c-1 | 2 | — | — | — | — | — | — |
| Comparative Example 3 | a-7 | 100 | b-1/b-4 | 150/150 | c-1 | 2 | — | — | — | — | — | — |
| Comparative Example 4 | a-8 | 100 | b-1 | 300 | c-2 | 2 | — | — | — | — | — | — |
| Comparative Example 5 | a-8 | 100 | b-2 | 300 | c-2 | 2 | — | — | — | — | — | — |

TABLE 2

| | Dielectric constant | | Evaluation 2 | | | | |
|---|---|---|---|---|---|---|---|
| | of solvent having low dielectric constant | Evaluation 1 Dispersibility Evaluation | Initial streak-like image defect Evaluation | Streak-like image defect after elapse of time Evaluation | Scratch resistance Evaluation | Initial fine line Evaluation | Fine line after elapse of time Evaluation |
| Example 1 | 7.6 | A | A | A | A | A | A |
| Example 2 | 7.6 | A | A | A | A | A | A |
| Example 3 | 7.6 | A | A | A | A | A | A |
| Example 4 | 7.6 | A | A | A | A | A | A |
| Example 5 | 7.6 | A | A | A | A | A | A |
| Example 6 | 7.6 | A | A | A | A | A | A |
| Example 7 | 7.6 | A | A | A | A | A | A |
| Example 8 | 6.4 | A | A | A | A | A | A |
| Example 9 | 13.5 | A | A+ | A | A | A | A |
| Example 10 | 7.6 | A | A+ | A | A | A | A |
| Example 11 | 7.6 | A | A | A | A | A | A |
| Example 12 | 7.6 | A | A | A | A+ | A | A |
| Example 13 | 7.6 | A | A | A | A | A | A |
| Example 14 | 7.6 | A | A | A | A | A | A |
| Example 15 | 7.6 | A | A | A | A | A | A |
| Example 16 | 7.6 | A | A | A | A | A | A |
| Example 17 | 7.6 | A | A | A | A | A | A |
| Example 18 | 7.6 | A | A | A | A | A | A |
| Comparative Example 1 | 2.2 | C | C | C | C | A | A |
| Comparative Example 2 | 4.8 | B | B | C | C | A | A |

TABLE 2-continued

| | Dielectric constant of solvent having low dielectric constant | Evaluation 1 Dispersibility Evaluation | Evaluation 2 Initial streak-like image defect Evaluation | Streak-like image defect after elapse of time Evaluation | Scratch resistance Evaluation | Initial fine line Evaluation | Fine line after elapse of time Evaluation |
|---|---|---|---|---|---|---|---|
| Comparative Example 3 | 2.2 | C | B | C | C | A | A |
| Comparative Example 4 | 7.6 | A | A | A | A | B | C |
| Comparative Example 5 | 6.4 | A | A | A | A | B | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A composition for forming a charge transporting film, comprising:

a solvent having a dielectric constant of 5.0 or more;

a compound represented by the following Formula (II);

fluorine-containing resin particles; and a fluorine-containing dispersant,

Formula (II)

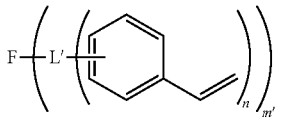

wherein F represents a charge transporting skeleton, L' represents a linking group with a valency of (n+1) having one or more kinds selected from a group consisting of tri- or tetravalent groups derived from alkane, an alkylene group, an alkenylene group, —C(═O)—, —N(R)—, —S—, and —O—, R represents a hydrogen atom, an alkyl group, an aryl group, or an aralkyl group, m' represents an integer of 1 to 6, and n represents an integer of 2 to 3.

2. The composition for forming a charge transporting film according to claim 1, wherein the compound represented by Formula (II) is represented by the following Formula (V), (V)

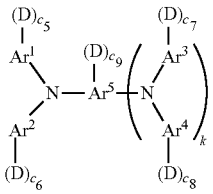

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VIII), each of c5 to c9 represents an integer of 0 to 2, k represents 0 or 1, and the total number of D is an integer of 1 to 8, (VIII)

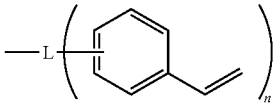

wherein L represents a linking group having a valency of (n+1) that is a combination of tri- or tetravalent groups derived from alkane and one or more kinds selected from a group consisting of, an alkylene group, an alkenylene group, —C(═O)—, —N(R)—, —O—, and —S—, R represents a hydrogen atom, an alkyl group, an aryl group, or an aralkyl group, and n represents an integer of 2 to 3.

3. The composition for forming a charge transporting film according to claim 1, wherein a group linked to the charge transporting skeleton represented by F of the compound represented by Formula (II) is a group represented by the following Formula (VIII-1) or (VIII-2), (VIII-1)

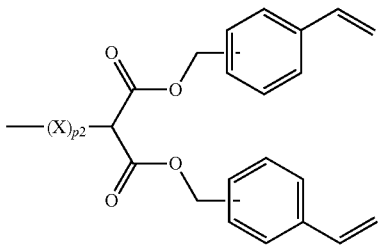

(VIII-2)

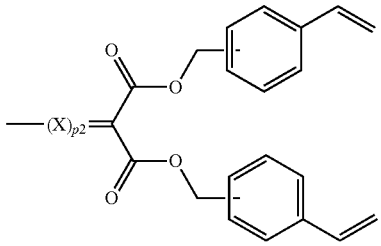

wherein X represents a divalent group, and p2 represents an integer 0 or 1.

4. The composition for forming a charge transporting film according to claim 1, wherein a group linked to the charge transporting skeleton represented by F of the compound represented by Formula (II) is a group represented by the following Formula (VIII-3) or (VIII-4), (VIII-3)

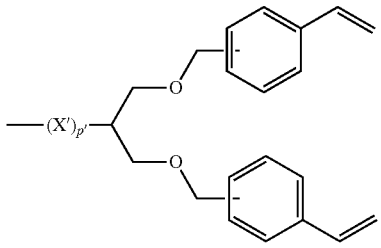

(VIII-4)

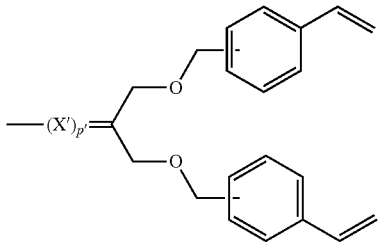

wherein X' represents a divalent group, and p' represents an integer 0 or 1.

5. The composition for forming a charge transporting film according to claim 1, further comprising a thermal radical generator or a derivative thereof.

6. An electrophotographic photoreceptor comprising:

a conductive supporter; and a photosensitive layer, wherein a surface layer of the electrophotographic photoreceptor is a cured film formed of the composition for forming a charge transporting film according to claim 1.

7. The electrophotographic photoreceptor according to claim 6, wherein the compound represented by Formula (II) of the composition for forming a charge transporting film is represented by the following Formula (V), (V)

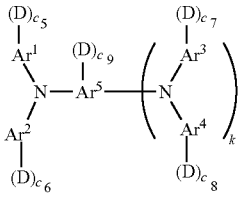

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VIII), each of c5 to c9 represents an integer of 0 to 2, k represents 0 or 1, and the total number of D is an integer of 1 to 8, (VIII)

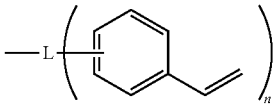

wherein L represents a linking group having a valency of (n+1) that is a combination of tri- or tetravalent groups derived from alkane and one or more kinds selected from a group consisting of, an alkylene group, an alkenylene group, —C(=O)—, —N(R)—, —O—, and —S—, R represents a hydrogen atom, an alkyl group, an aryl group, or an aralkyl group, and n represents an integer of 2 to 3.

8. The electrophotographic photoreceptor according to claim 6, wherein a group linked to the charge transporting skeleton of the composition for forming a charge transporting film that is represented by F of the compound represented by Formula (II) is a group represented by the following Formula (VIII-1) or (VIII-2), (VIII-1)

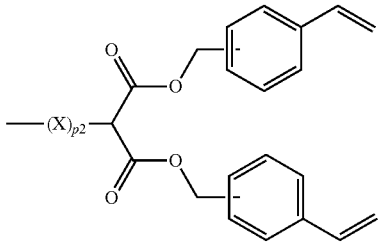

(VIII-2)

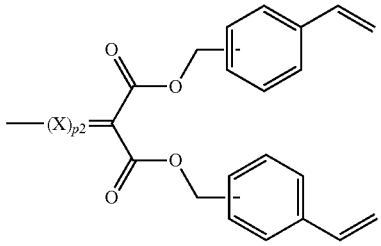

wherein X represents a divalent group, and p2 represents an integer 0 or 1.

9. The electrophotographic photoreceptor according to claim 6, wherein a group linked to the charge transporting skeleton of the composition for forming a charge transporting film that is represented by F of the compound represented by Formula (II) is a group represented by the following Formula (VIII-3) or (VIII-4), (VIII-3)

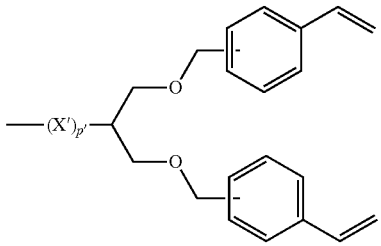

-continued (VIII-4)

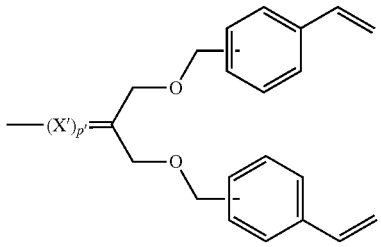

wherein X' represents a divalent group, and p' represents an integer 0 or 1.

10. The electrophotographic photoreceptor according to claim 6, wherein the composition for forming a charge transporting film contains a thermal radical generator or a derivative thereof.

11. A process cartridge comprising:

an electrophotographic photoreceptor; and at least one unit selected from a group consisting of A) a charging unit that charges a surface of the electrophotographic photoreceptor, B) a latent image forming unit that forms an electrostatic latent image on a charged surface of the electrophotographic photoreceptor, C) a developing unit that develops the electrostatic latent image formed on the surface of the electrophotographic photoreceptor by using a toner to form a toner image, D) a transfer unit that transfers the toner image formed on the surface of the electrophotographic photoreceptor to a recording medium, and E) a cleaning unit that cleans the electrophotographic photoreceptor, wherein the electrophotographic photoreceptor is the electrophotographic photoreceptor according to claim 6.

12. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor by using a toner to form a toner image; and a transfer unit that transfers the toner image formed on the surface of the electrophotographic photoreceptor to a recording medium, wherein the electrophotographic photoreceptor is the electrophotographic photoreceptor according to claim 6.

13. A composition for forming a charge transporting film, comprising:

a solvent having a dielectric constant of 5.0 or more;

a compound represented by the following Formula (V):

(V)

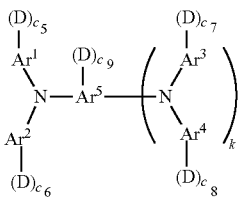

wherein each of $Ar^1$ to $Ar^4$ independently represents a substituted or unsubstituted aryl group, $Ar^5$ represents a substituted or unsubstituted aryl group or a substituted or unsubstituted arylene group, D represents a group represented by the following Formula (VII), each of $c_5$ to $c_9$ represents an integer of 0 to 2, k represents 0 or 1, and the total number of D is from 1 to 8, (VII)

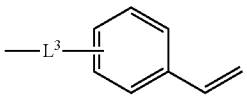

wherein $L^3$ represents a divalent linking group having one or more groups selected from a group consisting of —C(=O)—, —N(R)—, —S—, and a group that is a combination of —C(=O)— with —O—, —N(R)—, or —S—, and R represents a hydrogen atom, an alkyl group, an aryl group, or an aralkyl group, and wherein the group represented by Formula (VII) is a group represented by the following Formula (VII-1), (VII-1)

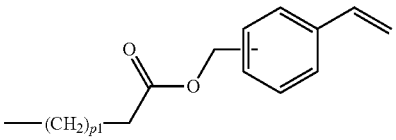

wherein p1 represents an integer of 0 to 4.

14. An electrophotographic photoreceptor comprising:

a conductive supporter; and a photosensitive layer, wherein a surface layer of the electrophotographic photoreceptor is a cured film formed of the composition for forming a charge transporting film according to claim 13.

15. A process cartridge comprising:

an electrophotographic photoreceptor; and at least one unit selected from a group consisting of A) a charging unit that charges a surface of the electrophotographic photoreceptor, B) a latent image forming unit that forms an electrostatic latent image on a charged surface of the electrophotographic photoreceptor, C) a developing unit that develops the electrostatic latent image formed on the surface of the electrophotographic photoreceptor by using a toner to form a toner image, D) a transfer unit that transfers the toner image formed on the surface of the electrophotographic photoreceptor to a recording medium, and E) a cleaning unit that cleans the electrophotographic photoreceptor, wherein the electrophotographic photoreceptor is the electrophotographic photoreceptor according to claim 14.

16. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor by using a toner to form a toner image; and a transfer unit that transfers the toner image formed on the surface of the electrophotographic photoreceptor to a recording medium, wherein the electrophotographic photoreceptor is the electrophotographic photoreceptor according to claim 14.

* * * * *